US009411269B2

(12) United States Patent
Sato

(10) Patent No.: US 9,411,269 B2
(45) Date of Patent: Aug. 9, 2016

(54) IMAGE FORMING APPARATUS AND DEVELOPING AGENT CARTRIDGE

(71) Applicant: Brother Kogyo Kabushiki Kaisha, Nagoya-shi, Aichi-ken (JP)

(72) Inventor: Shougo Sato, Seto (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/665,941

(22) Filed: Mar. 23, 2015

(65) Prior Publication Data

US 2015/0261141 A1 Sep. 17, 2015

Related U.S. Application Data

(63) Continuation of application No. 14/456,735, filed on Aug. 11, 2014, now Pat. No. 8,989,624, which is a continuation of application No. 14/060,259, filed on Oct. 22, 2013, now Pat. No. 8,805,236, which is a (Continued)

(30) Foreign Application Priority Data

Jul. 25, 2006 (JP) ..... 2006-202611
Jul. 25, 2006 (JP) ..... 2006-202612
Jul. 25, 2006 (JP) ..... 2006-202613

(51) Int. Cl.
*G03G 15/00* (2006.01)
*G03G 15/16* (2006.01)

(Continued)

(52) U.S. Cl.
CPC ..... *G03G 15/1605* (2013.01); *G03G 15/0121* (2013.01); *G03G 15/0142* (2013.01);

(Continued)

(58) Field of Classification Search
CPC ..... G03G 15/1605; G03G 2215/0119; G03G 2221/18
USPC ..... 399/110, 111, 119, 262
See application file for complete search history.

(56) References Cited

U.S. PATENT DOCUMENTS 6,343,200 B1 1/2002 Hatano et al.
6,347,199 B1 * 2/2002 Morihara ..... 399/27

(Continued)

FOREIGN PATENT DOCUMENTS

CN 1755555 A 4/2006
EP 1184741 A2 3/2002

(Continued)

OTHER PUBLICATIONS

Partial EP Search Report Jan. 24, 2008, EP Appln. 07014540.4-2209.

(Continued)

*Primary Examiner* — David Bolduc
*Assistant Examiner* — Barnabas Fekete
(74) *Attorney, Agent, or Firm* — Banner & Witcoff, Ltd.

(57) ABSTRACT

An image forming apparatus may include a casing, and a plurality of image carriers arranged in parallel along one direction in the casing and formed with an electrostatic latent image. The apparatus can further include a plurality of developing agent carriers opposed to the image carriers, for visualizing the electrostatic latent image by feeding a developing agent to the image carriers, and a plurality of developing agent cartridges, arranged in parallel in the one direction to be opposed to the developing agent carriers in the longitudinal direction of the developing agent carriers, and configured to be together attachable/detachable to/from the casing along the one direction, for accommodating the developing agent fed to the developing agent carriers.

30 Claims, 25 Drawing Sheets

Related U.S. Application Data continuation of application No. 13/692,023, filed on Dec. 3, 2012, now Pat. No. 8,571,441, which is a continuation of application No. 13/411,878, filed on Mar. 5, 2012, now Pat. No. 8,326,177, which is a continuation of application No. 12/968,931, filed on Dec. 15, 2010, now Pat. No. 8,139,978, which is a continuation of application No. 12/685,744, filed on Jan. 12, 2010, now Pat. No. 7,877,039, which is a continuation of application No. 11/782,917, filed on Jul. 25, 2007, now Pat. No. 7,657,206.

(51) Int. Cl.

| | |
|---|---|
| ***G03G 15/01*** | (2006.01) |
| ***G03G 21/16*** | (2006.01) |
| ***G03G 15/08*** | (2006.01) |

(52) U.S. Cl.

CPC ..... *G03G15/0194* (2013.01); *G03G 15/0855* (2013.01); *G03G 15/0865* (2013.01); *G03G 15/0875* (2013.01); *G03G 15/0886* (2013.01); *G03G 21/1604* (2013.01); *G03G 21/1619* (2013.01); *G03G 2215/0119* (2013.01); *G03G 2221/18* (2013.01)

(56) References Cited

U.S. PATENT DOCUMENTS

| | | | | |
|---|---|---|---|---|
| 6,708,011 | B2 | 3/2004 | Nomura et al. | |
| 7,317,886 | B2 | 1/2008 | Takuwa | |
| 7,778,567 | B2 | 8/2010 | Igarashi et al. | |
| 2003/0059230 | A1 | 3/2003 | Yokoi et al. | |
| 2003/0185589 | A1* | 10/2003 | Fujita | 399/111 |
| 2005/0238387 | A1 | 10/2005 | Ueno et al. | |
| 2005/0281581 | A1 | 12/2005 | Kitozaki | |
| 2006/0067734 | A1 | 3/2006 | Igarashi et al. | |
| 2006/0083544 | A1 | 4/2006 | Okabe | |
| 2006/0104673 | A1 | 5/2006 | Sasae et al. | |
| 2007/0019985 | A1 | 1/2007 | Kim et al. | |
| 2007/0048009 | A1 | 3/2007 | Izumi et al. | |
| 2008/0226339 | A1 | 9/2008 | Sato | |
| 2009/0190955 | A1 | 7/2009 | Igarashi et al. | |

FOREIGN PATENT DOCUMENTS

| | | | |
|---|---|---|---|
| EP | 1273980 | A2 | 1/2003 |
| EP | 1577712 | A2 | 9/2005 |
| EP | 1643315 | A2 | 4/2006 |
| JP | 03-132671 | A | 6/1991 |
| JP | 04-060673 | A | 2/1992 |
| JP | 6-194886 | A | 7/1994 |
| JP | 07-210038 | A | 8/1995 |
| JP | 10-069159 | A | 3/1998 |
| JP | 2002-162871 | A | 6/2002 |
| JP | 2002-268356 | A | 9/2002 |
| JP | 2003-015378 | A | 1/2003 |
| JP | 2006-091331 | A | 4/2006 |
| JP | 2006-098772 | A | 4/2006 |
| JP | 2006-171072 | A | 6/2006 |
| JP | 2008-216451 | A | 9/2008 |

OTHER PUBLICATIONS

Extended EP Search Report dtd Apr. 7, 2009, EP Appln. 07014540.4-2209.

CN Office Action dtd May 11, 2011, CN Appln. 200710139879.8, partial English translation.

JP Office Action dtd Jul. 12, 2011, JP Appln. 2006-202611, partial English translation.

Notification of Reasons for Refusal dispatched Sep. 6, 2011, JP Appln. 2006-202613, English translation.

Notification of Reasons for Refusal dispatched Aug. 23, 2011, JP Appln. 2006-202612, English translation.

CN Office Action dtd Oct. 10, 2011, CN Appln. 200710139879.8, English translation.

Extended EP Search Report dtd Oct. 6, 2011, EP Appln. 11169260.4.

CN Office Action dtd Apr. 1, 2012, CN Appln. 200710139879.8, English Translation.

EP Communication mailed Jan. 13, 2014, EP Appln. 11169260.4.

CN Second Office Action mailed Mar. 31, 2014, CN Appln. 201210238282.X, English translation.

Aug. 15, 2014—(CN) The Third Office Action—App 201210238282.X—Eng Tran.

* cited by examiner

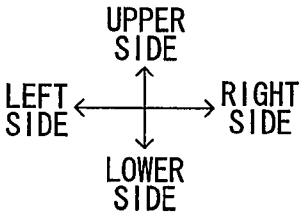
FIG. 11(b)
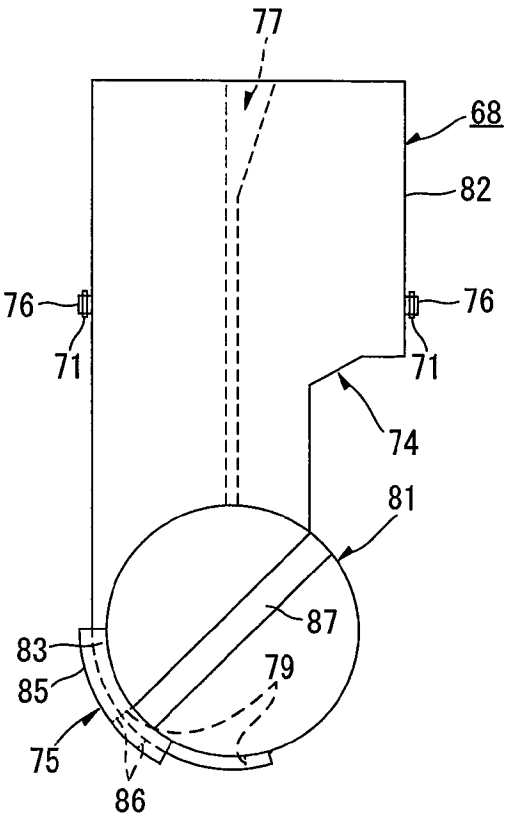
FIG. 11(a)
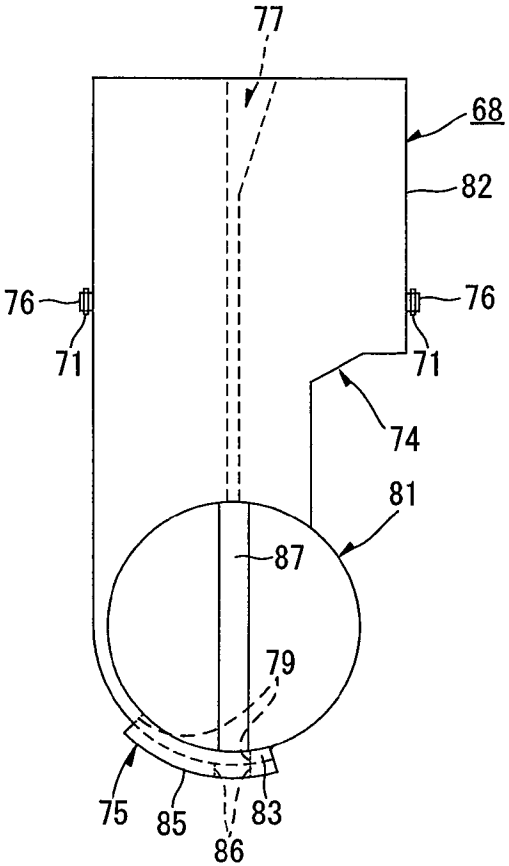

UPPER SIDE
LOWER SIDE
FRONT SIDE
REAR SIDE
103
95
100
112
106
117
120
101
69
108
109
110
96
123
107
104
114
119
116

UPPER SIDE
LOWER SIDE
RIGHT SIDE
LEFT SIDE
128
129
124
131
130

UPPER SIDE
LOWER SIDE
LEFT SIDE
RIGHT SIDE
118
119

IMAGE FORMING APPARATUS AND DEVELOPING AGENT CARTRIDGE

CROSS REFERENCE TO RELATED APPLICATIONS

This application is a continuation of prior U.S. application Ser. No. 14/456,735, filed Aug. 11, 2014, which is a continuation of prior U.S. application Ser. No. 14/060,259, filed Oct. 22, 2013, now U.S. Pat. No. 8,805,236, issued Aug. 12, 2014, which is a continuation of prior U.S. application Ser. No. 13/692,023, filed Dec. 3, 2012, now U.S. Pat. No. 8,571,441, issued Oct. 29, 2013, which is a continuation of prior U.S. application Ser. No. 13/411,878, filed Mar. 5, 2012, now U.S. Pat. No. 8,326,177, issued Dec. 4, 2012, which is a continuation of prior U.S. application Ser. No. 12/968,931, filed Dec. 15, 2010, now U.S. Pat. No. 8,139,978, issued Mar. 20, 2012, which is a continuation application of prior U.S. application Ser. No. 12/685,744, filed Jan. 12, 2010, now U.S. Pat. No. 7,877,039, issued Jan. 25, 2011, which is a continuation application of prior U.S. application Ser. No. 11/782,917, filed Jul. 25, 2007, now U.S. Pat. No. 7,657,206, issued Feb. 2, 2010, which claims priority to Japanese Patent Applications Nos. 2006-202611, 2006-202612 and 2006-202613 filed on Jul. 25, 2006, the disclosures of which are hereby incorporated into the present application by reference.

TECHNICAL FIELD

Aspects of the present invention relate to an image forming apparatus such as a color laser printer and a developing agent cartridge installed in the image forming apparatus.

BACKGROUND

Conventionally known is the so-called tandem-type color laser printer having photosensitive drums forming electrostatic latent images, developing rollers developing the electrostatic latent images and toner boxes accommodating toners fed to the developing rollers, arranged correspondingly to four colors, i.e. yellow, magenta, cyan and black, respectively.

The tandem-type color laser printer forms generally simultaneously toner images of the respective colors on the respective photosensitive drums and sequentially transfers the toner images of the respective colors from the photosensitive drums to a sheet sequentially passing through the photosensitive drums, and therefore can form color images at a speed generally identical to that of a monochromatic laser printer.

For example, there has been proposed a tandem-type color laser printer having image forming stations, each including a photosensitive member, a developing unit having a developing roller and storing a developing agent and a transfer unit, provided correspondingly to respective colors, and forming color images by passing a transfer medium through the image forming stations of the respective colors.

In the tandem-type color laser printer, a set of four photosensitive members as well as a coroner charger and a cleaner arranged around the photosensitive member can be drawn out and detached from the printer body, and mounted on and attached to the printer body, as an integral photosensitive cartridge. Further, developing devices belonging to the photosensitive members are detachably mountable to the photosensitive cartridge.

Also known is a color image forming apparatus in which a plurality of developing machines are arranged correspondingly to respective colors and toner hoppers for supplementing toners to the developing machines are parallelly provided above side portions of the developing machines in a detachably mountable manner to the developing machines respectively.

However, each of the developing devices storing the toners corresponding to the respective colors must be increased in size in order to ensure sufficient volumes of the toners.

In the tandem-type color laser printer, on the other hand, the each developing device is attached/detached to/from the photosensitive cartridge. Therefore, if the developing devices are increased in size in order to ensure sufficient volumes of toners, the photosensitive cartridge must also be increased in size. Then, the printer body to/from which the photosensitive cartridge is attached/detached is inevitably increased in size.

In order to exchange each developing device in the tandem-type color laser printer, further, the photosensitive cartridge must be drawn out and detached from the printer body to exchange each developing device with a new one in the detached photosensitive cartridge, and must thereafter be mounted on and attached to the printer body again. In other words, the photosensitive cartridge including the photosensitive bodies, the coroner charger and the cleaner must be detached from and then attached to the printer body, in order to exchange each developing device. Thus, much labor is required for detaching the photosensitive cartridge from the printer body and thereafter attaching the photosensitive cartridge to the printer body.

Further, while each developing device storing the toner is provided with members such as a feed roller, a developing roller and a regulation blade necessary for developing a toner image, the developing device must be exchanged when the toner is used up, even if these members are still operable. Therefore, the running cost is increased.

The color laser printer can be undesirably increased in size due to the aforementioned structure including the plurality of photosensitive drums, the plurality of developing rollers and the plurality of toner boxes corresponding to the respective colors.

If the toner boxes are reduced in size in order to miniaturize the color laser printer, the volumes of the toners that can be accommodated in the toner boxes are reduced, so that the toner boxes must be frequently exchanged, leading to troublesome maintenance.

On the other hand, when sufficient volumes of toners are ensured in the toner boxes while miniaturizing the color laser printer, the toner boxes are limited in size reduction to inevitably occupy a large volume ratio in the color laser printer. Thus, arrangement of other parts in the color laser printer is restricted.

When the toner boxes are respectively provided with agitators for agitating the toners accommodated therein, for example, it is difficult to provide mechanisms for supplying driving force to the agitators on all the toner boxes in the limited space of the color laser printer.

When the developing machines and the toner hoppers are formed independently of each other as in the color image forming apparatus, for example, shutter members must be provided on all the toner hoppers respectively such that the toner hoppers communicate with the developing machines by opening the shutter members for feeding the toners to the developing machines and the toner hoppers are sealed by closing the shutter members for preventing the toners from leaking.

In this case, it is difficult to provide mechanisms for opening/closing the shutter members on all the toner hoppers in the limited space of the color laser printer.

SUMMARY

One aspect of the present invention may provide an image forming apparatus reducible in size while ensuring a sufficient volume of developing agent in developing agent cartridge, excellent in operability and capable of reducing the maintenance cost.

Another aspect of the present invention may provide an image forming apparatus capable of reliably supplying driving force to an agitating member provided in each developing agent cartridge while ensuring a sufficient volume of developing agent in the developing agent cartridge when the image forming apparatus is reduced in size, and a developing agent cartridge installed in this image forming apparatus.

Still another aspect of the present invention may provide an image forming apparatus capable of reliably opening/closing a shutter member provided on each developing agent cartridge while ensuring a sufficient volume of developing agent in the developing agent cartridge when the image forming apparatus is reduced in size, and a developing agent cartridge installed in this image forming apparatus.

The same or different aspect of the present invention may provide an image forming apparatus including: a casing; a plurality of image carriers parallelly arranged along one direction in the casing, and formed with an electrostatic latent image; a plurality of developing agent carriers opposed to the image carriers, for visualizing the electrostatic latent image by feeding a developing agent to the image carriers; and a plurality of developing agent cartridges, parallelly arranged in the one direction to be opposed to the developing agent carriers in the longitudinal direction of the developing agent carriers, and configured to be together attachable/detachable to/from the casing along the one direction, for accommodating the developing agent fed to the developing agent carriers.

One or more aspects of the present invention provide an image forming apparatus including: a plurality of image carriers formed with an electrostatic latent image; a plurality of developing agent carriers visualizing the electrostatic latent image by feeding a developing agent to the image carriers; a plurality of developing agent cartridges accommodating the developing agent fed to the developing agent carriers; an agitating member provided in the developing agent cartridge and supplied with driving force to agitate the developing agent accommodated in the developing agent cartridges; a drive unit supplying the driving force to the agitating member of at least any developing agent cartridge; and a transmission unit transmitting the driving force supplied by the drive unit, from the agitating member of a first developing agent cartridge to the agitating member of a second developing agent cartridge adjacent to the first developing agent cartridge.

One or more aspects of the present invention provide a developing agent cartridge, accommodating a developing agent fed to a developing agent carrier, including: a first agitating member supplied with driving force to be rotated for agitating the accommodated developing agent; a first rotating shaft extending along one direction and provided with the first agitating member, for serving as the rotation center of the first agitating member; an input transmission portion provided on one end portion of the first rotating shaft in the one direction, for receiving the driving force; and an output transmission portion provided on the other end portion of the first rotating shaft in the one direction, for outputting the driving force received by the input transmission portion.

One or more aspects of the present invention provide an image forming apparatus including: a plurality of image carriers parallelly arranged along one direction and formed with an electrostatic latent image; a plurality of developing agent carriers visualizing the electrostatic latent image by feeding a developing agent to the image carriers; a plurality of developing agent cartridges provided correspondingly to the developing agent carriers and parallelly arranged along the one direction to be opposed to the developing agent carriers in a longitudinal direction of the developing agent carriers, for accommodating the developing agent fed to the developing agent carriers; an agitating member provided in the developing agent cartridge, supplied with driving force to be rotated for agitating the developing agent accommodated in the developing agent cartridge; and a rotating shaft extending along the one direction and provided with the agitating member, for serving as a rotation center of the agitating member.

One or more aspects of the present invention provide an image forming apparatus including: a plurality of image carriers formed with an electrostatic latent image; a plurality of developing agent carriers visualizing the electrostatic latent image by feeding a developing agent to the image carriers; a plurality of developing agent cartridges accommodating the developing agent fed to the developing agent carrier, and formed with a cartridge-side opening passing the developing agent therethrough; a first shutter member provided on the developing agent cartridge, for opening/closing the cartridge-side opening; and an opening/closing member collectively opening/closing all of the first shutter members.

One or more aspects of the present invention provide a developing agent cartridge, accommodating a developing agent fed to a developing agent carrier, and detachably mounted on a casing of an image forming apparatus, including: a cartridge case including a generally cylindrical portion, and formed with a cartridge-side opening passing the developing agent therethrough on a peripheral surface of the generally cylindrical portion; a first shutter member shaped along the generally cylindrical portion, for pivotably opening/closing the cartridge-side opening; a first projection engaging with an opening/closing member opening/closing the first shutter member, for opening/closing the first shutter member in association with operation of the opening/closing member; and a second projection engaging with a second shutter member opening/closing a casing-side opening formed in the casing to communicate with the cartridge-side opening, for opening/closing the second shutter member in association with the first projection, wherein the first projection and the second projection are provided on the first shutter member.

BRIEF DESCRIPTION OF THE DRAWINGS

FIGS. 11(*a*) and 11(*b*) are front elevation views of the cartridge receiving section, with an operation lever located on a lever closing position and a lever opening position respectively.

FIGS. 14(*a*) and 14(*b*) show a first projection, a second projection, a first projection exposing hole, a second projection exposing hole, an inner-cylinder-side opening and an outer-cylinder-side opening on the same plane, for the convenience of illustration.

FIGS. 17(*a*) and 17(*b*) show the first projection, the second projection, the first projection exposing hole, the second projection exposing hole, the inner-cylinder-side opening, the outer-cylinder-side opening and an opening/closing main portion engaging hole on the same plane, for the convenience of illustration.

FIGS. 20(*a*) and 20(*b*) show the first projection, the second projection, the first projection exposing hole, the second projection exposing hole, the inner-cylinder-side opening, the outer-cylinder-side opening, the opening/closing main portion engaging hole, a partition-wall-side feed hole and a partition-wall-side return hole on the same plane, for the convenience of illustration.

DETAILED DESCRIPTION

Embodiments of one or more aspects of the present invention are now described with reference to the drawings.

First Embodiment

1. General Structure of Color Laser Printer

Figure 1:
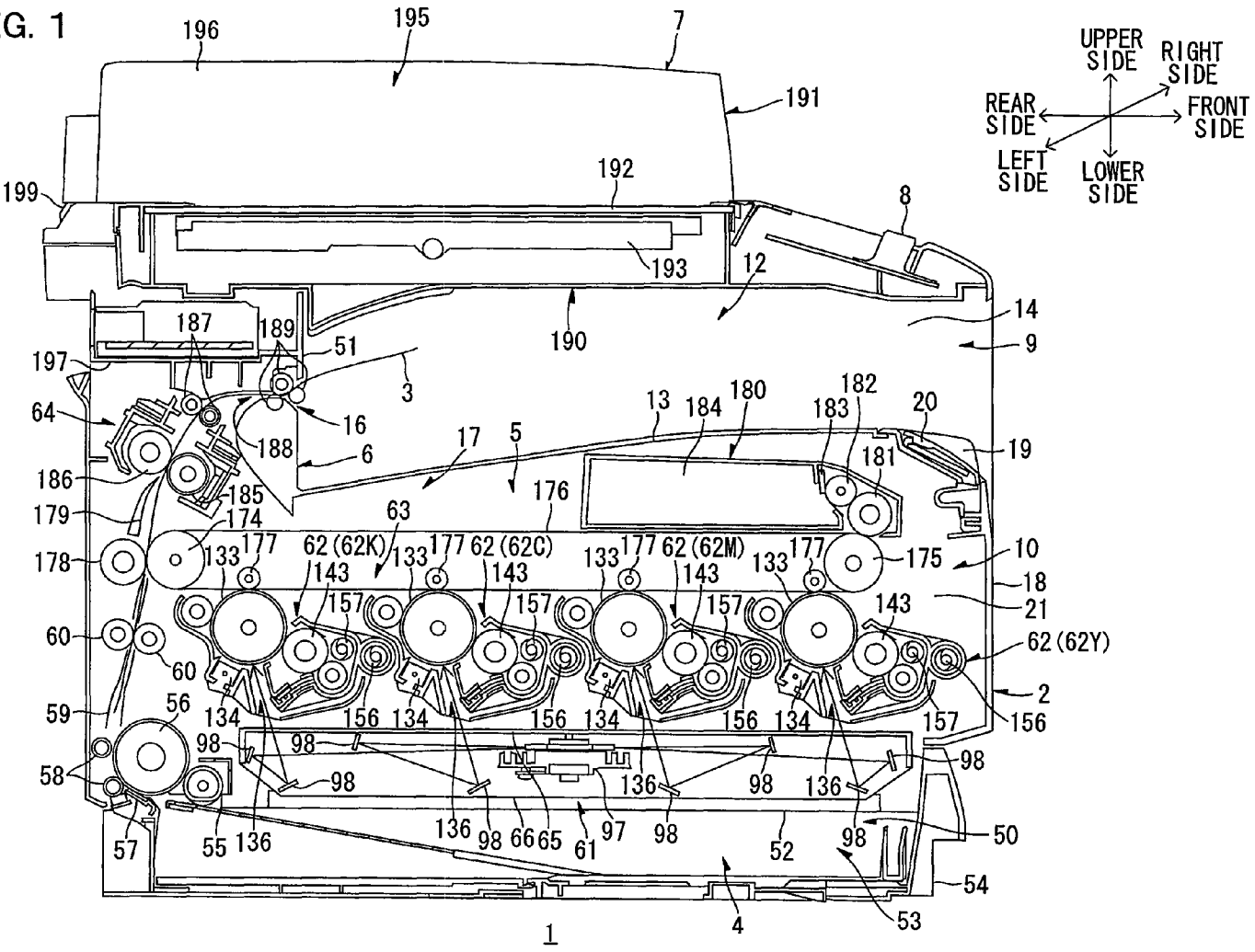
FIG. 1 is a left-side sectional view showing an illustrative aspect of a color laser printer as an example of an image forming apparatus of one or more aspects of the present invention.

FIG. 1 is a left-side sectional view showing an illustrative aspect of a color laser printer as an example of an image forming apparatus of one or more aspects of the present invention.

As shown in FIG. 1, this color laser printer 1 is a tandem-type color laser printer having a plurality of processing sections 62 horizontally arranged in parallel with each other. The color laser printer 1 includes a sheet feeding section 4 for feeding a sheet 3, an image forming section 5 for forming images on the fed sheet 3 and a sheet ejecting section 6 for ejecting the sheet 3 formed with the images, in a boxy main body casing 2 as an example of a casing. The color laser printer 1 further includes a scanning unit 7 provided above the main body casing 2 as an example of an image reading unit for reading image information from a document, and is formed as the so-called composite printer.

In the following description, it is assumed that the right and left sides in the plane of FIG. 1 are the front and rear sides of the color laser printer 1 respectively in a state where toner cartridges 69 and the processing sections 62 described later are mounted in the main body casing 2. It is also assumed that this side and the other side of FIG. 1 along the thickness thereof are the left and right sides of the color laser printer 1 respectively. The right-and-left direction may also be referred to as a width direction.

(1) Main Body Casing

Figure 2:
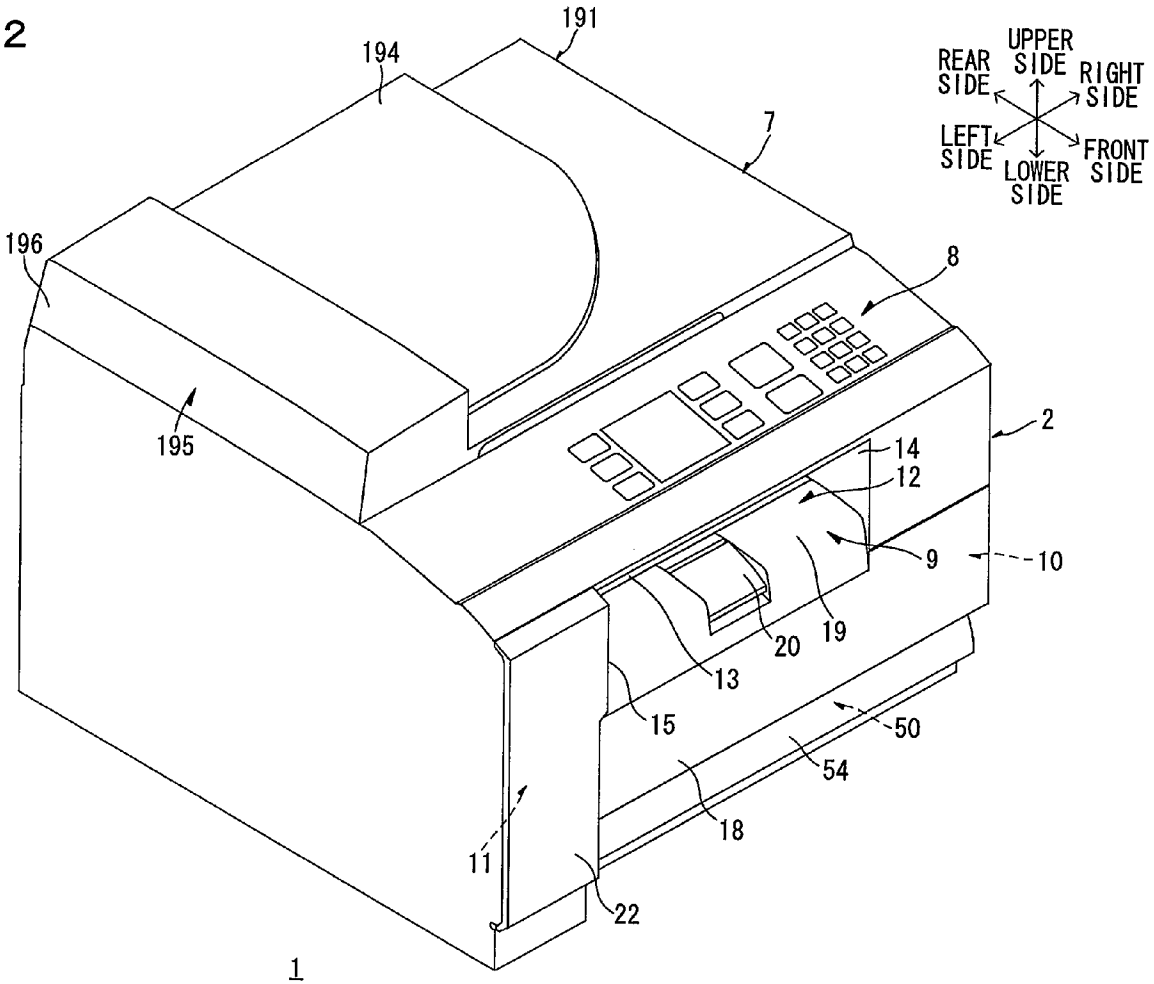
FIG. 2 is a left-side perspective view of the color laser printer.
Figure 3:
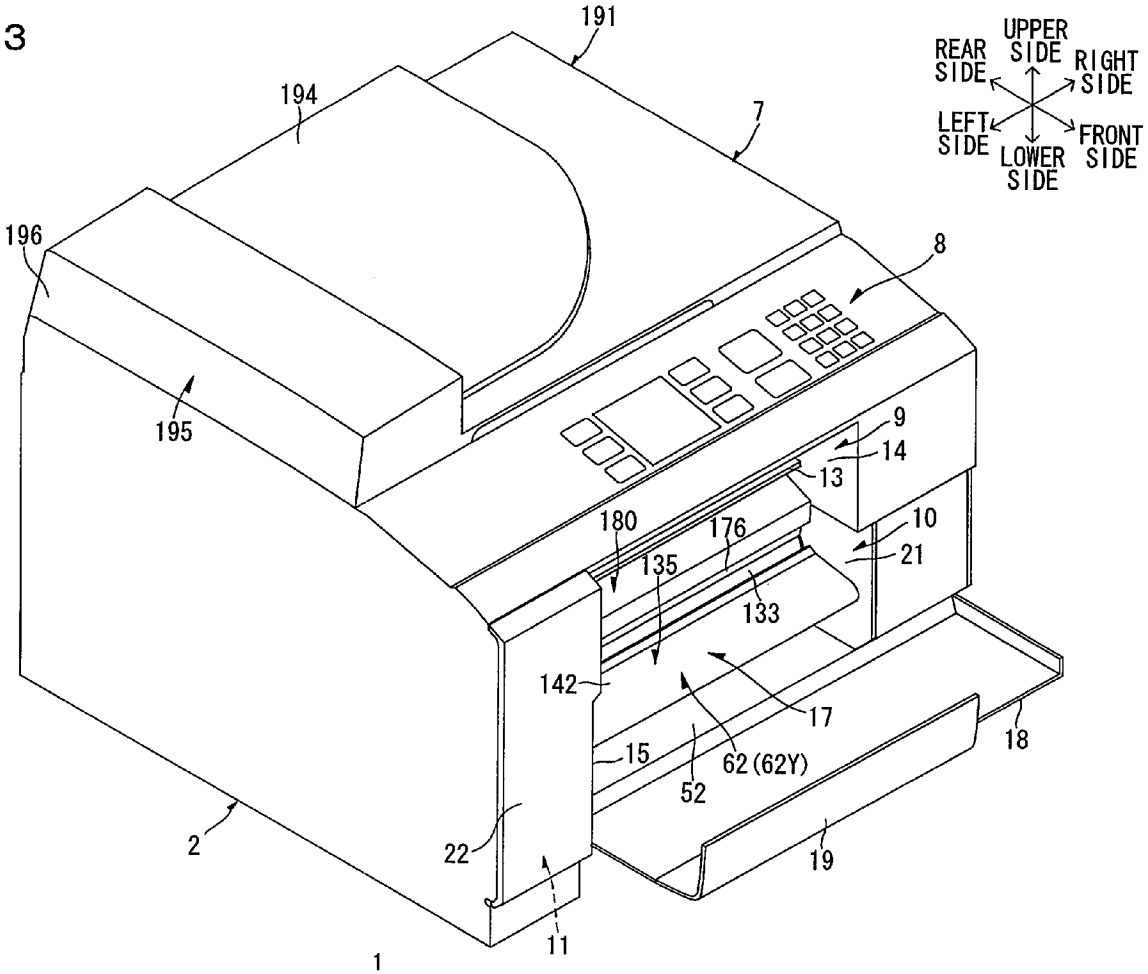
FIG. 3 illustrates a state where only a second cover is opened in FIG. 2.
Figure 4:
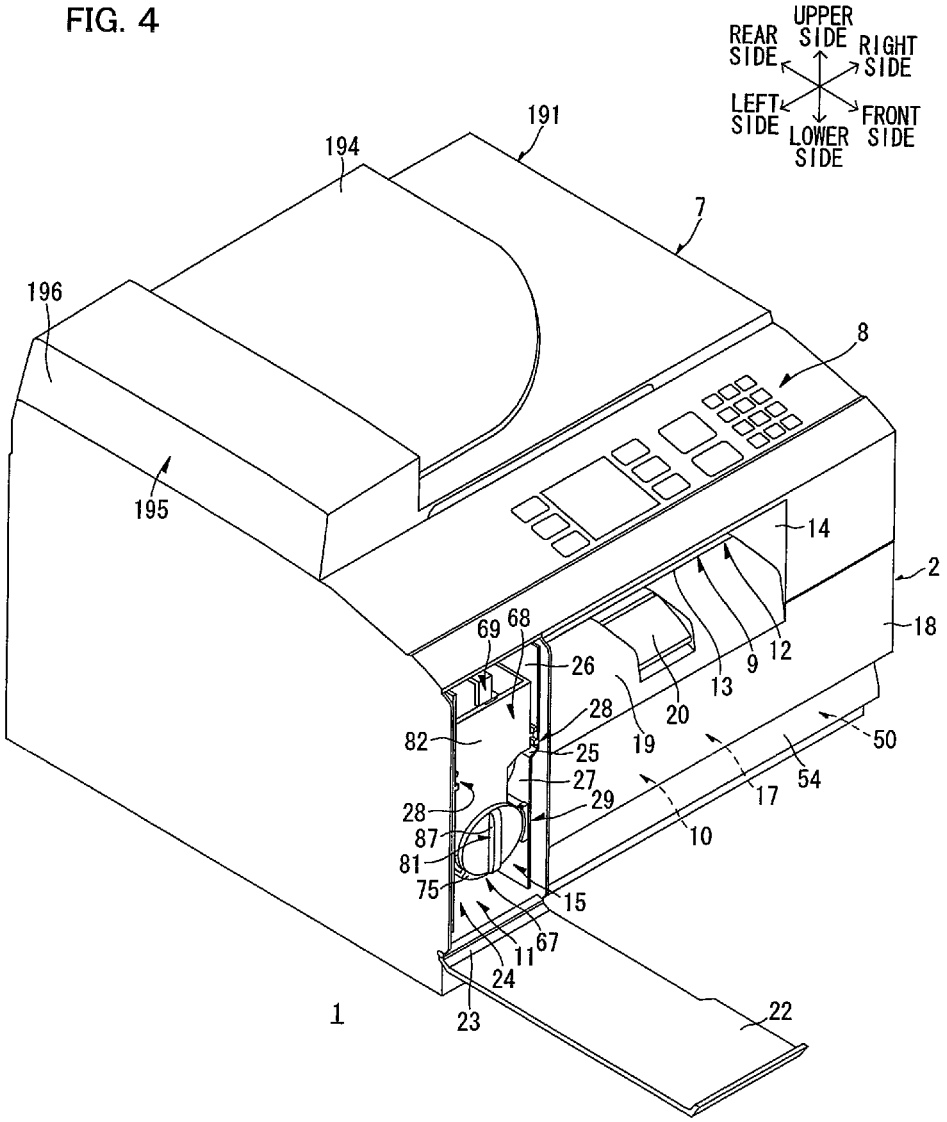
FIG. 4 illustrates a state where only a first cover is opened in FIG. 2.
Figure 5:
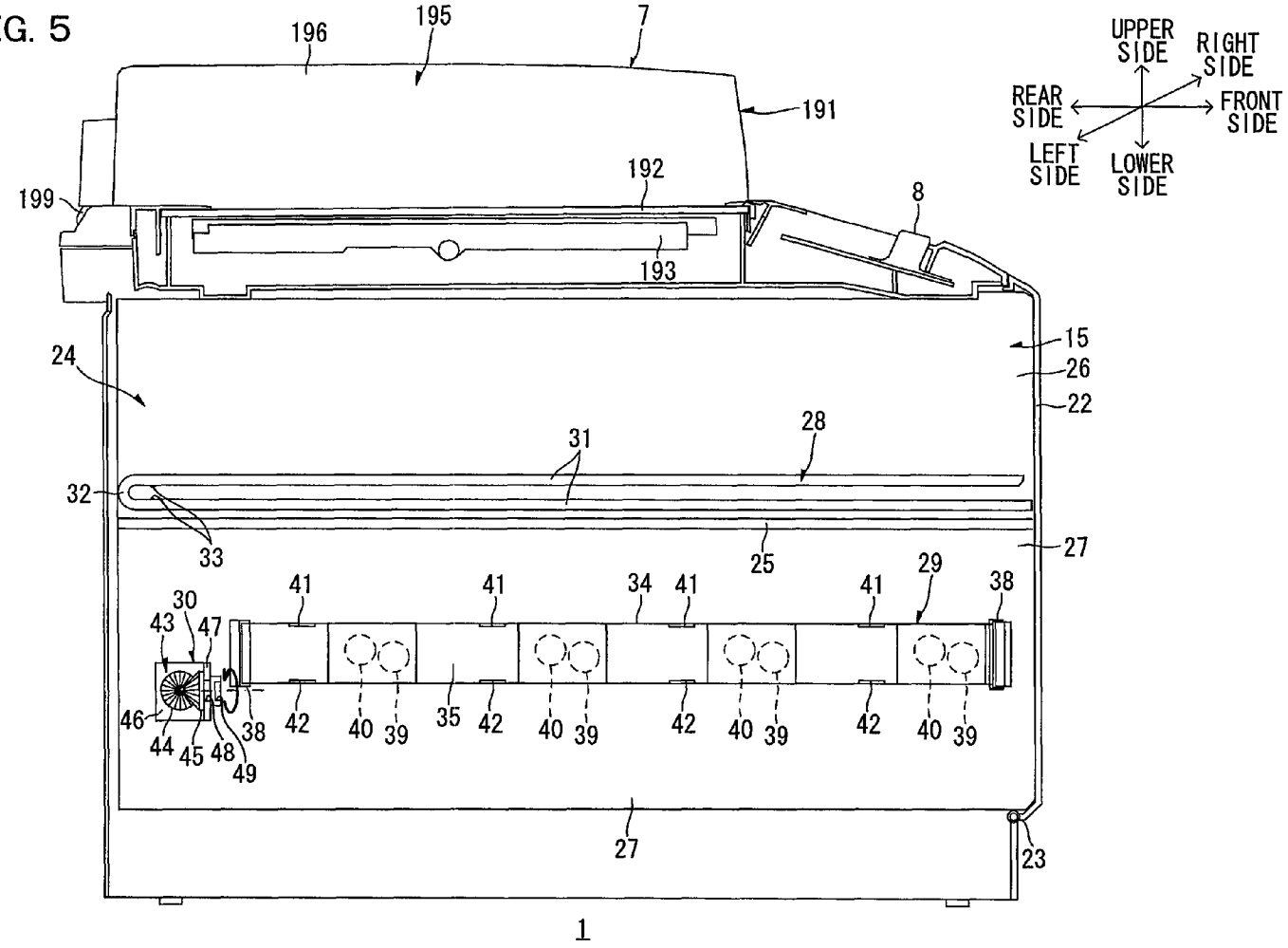
FIG. 5 is a left-side sectional view of the color laser printer cut along a position where the left side surface of a partition wall is exposed.

FIG. 2 is a left-side perspective view of the color laser printer. FIG. 3 illustrates a state where only a second cover is opened in FIG. 2. FIG. 4 illustrates a state where only a first cover is opened in FIG. 2. FIG. 5 is a left-side sectional view of the color laser printer cut along a position where the left side surface of a partition wall is exposed.

The main body casing 2 is in the form of a box as described above, the upper side surface of the front end of the upper sidewall thereof is inclined downward obliquely toward the front side, and an operation panel 8 including operation keys and an LED display section is embedded in this front end. The scanning unit 7 is arranged on a portion of the upper sidewall of the main body casing 2 rearward beyond the operation panel 8. A cartridge receiving section mounting port 11 serving as an example of a first opening, a sheet ejection port 9, a processing section mounting port 10 serving as an example of a second opening and a sheet feeding tray mounting port 50 are formed on the front wall, i.e., the front surface of the main body casing 2.

(1-1) Cartridge Receiving Section Mounting Port

The cartridge receiving section mounting port 11 has a generally rectangular shape vertically longitudinal in front elevation view as shown in FIG. 4. The cartridge receiving section mounting port 11 is provided with the first cover 22 covering the cartridge receiving section mounting port 11 in an openable/closable manner.

The first cover 22 is rotatably supported by a hinge 23 connecting the proximal end portion of the first cover 22 and the lower end portion of the front wall of the main body casing 2 with each other.

When the first cover 22 is pivoted about the pivoting shaft (not shown) of the hinge 23 counterclockwise in left-side elevation view and closed, the cartridge receiving section mounting port 11 is closed with the first cover 22, as shown in FIG. 2.

When the first cover 22 is pivoted about the pivoting shaft (not shown) of the hinge 23 clockwise in left-side elevation view and opened, on the other hand, the cartridge receiving section mounting port 11 is opened as shown in FIG. 4.

The main casing 2 is formed therein with a cartridge receiving section accommodation space 24, serving as an example of a first accommodation space, defined generally in the form of a rectangular parallelepiped for communicating with the cartridge receiving section mounting port 11.

The cartridge receiving section accommodation space 24 is defined by the upper, lower and left sidewalls of the main body casing 2 and the partition wall 15 in the up-and-down (vertical) and right-and-left (horizontal) directions. The partition wall 15 is provided in the main body casing 2, to parallelly extend along the left sidewall of the main body casing 2 inside the left sidewall of the main body casing 2 in the width direction. The rear portion of the cartridge receiving section accommodation space 24 is closed with the rear wall of the main body casing 2. The partition wall 15 is rightwardly separated from the left sidewall of the main body casing 2 by a distance corresponding to about ¼ of the width-directional size of the main body casing 2, as described later in detail. The cartridge receiving section accommodation space 24 accommodates a cartridge receiving section 68 serving as an example of a receiving section described later.

(1-2) Sheet Ejection Port

The sheet ejection port 9, adjacent to the right side of the cartridge receiving section mounting port 11 through the partition wall 15, has a generally rectangular shape width-directionally longitudinal in front elevation view at the width-directional central position of the upper half of the front wall of the main body casing 2. A sheet ejection space 12 defined generally in the form of a rectangular parallelepiped is formed in the main body casing 2 to communicate with the sheet ejection port 9.

In the up-and-down direction, the sheet ejection space 12 is defined by the upper sidewall of the main body casing 2 and an ejection tray 13 (see FIG. 1) opposed in the right-and-left direction to the upper sidewall of the main body casing 2 at an interval. In the right-and-left direction, the sheet ejection space 12 is defined by a first right-side inner wall 14 and the partition wall 15. The first right-side inner wall 14 is provided in the main body casing 2, to parallelly extend along the right sidewall of the main body casing 2 inside the right sidewall of the main body casing 2 in the width direction. The rear portion of the sheet ejection space 12 is closed with an ejection wall 51 extending upward from the rear end portion of the ejection tray 13 to a portion close to the lower side surface of the upper sidewall of the main body casing 2, as shown in FIG. 1. This ejection wall 51 is arranged on a position separated frontward from the rear end of the main body casing 2 by a distance corresponding to about ¼ of the anteroposterior (horizontal) size of the main body casing 2.

The ejection tray 13 is so formed as to loosely extend upward obliquely toward the front side from the rear end thereof. A rectangular ejection hole 16 width-directionally longitudinal in front elevation view is formed on a generally central position of the ejection wall 51 in the up-and-down direction. The width-directional size of the ejection hole 16 is set larger than that of the sheet 3. The sheets 3 formed with color images is ejected frontward from the ejection hole 16 and placed on the ejection tray 13 in a stackable manner, as described later. Therefore, the user can take out the sheets 3 placed on the ejection tray 13 by accessing the sheet ejection space 12 through the sheet ejection port 9.

(1-3) Processing Section Mounting Port

As shown in FIG. 3, the processing section mounting port 10 is adjacent to the right side of the cartridge receiving section mounting port 11 through the partition wall 15 and located under the sheet ejection port 9, and has a generally rectangular shape width-directionally longitudinal in front elevation view. This processing section mounting port 10 is formed longer than the sheet ejection port 9 in the width direction so that the right edge thereof is located rightward beyond that of the sheet ejection port 9. The processing section mounting port 10 has the second cover 18 provided adjacently to the first cover 22 for covering the processing section mounting port 10 in an openable/closable manner.

The second cover 18 is pivotably supported on a second cover pivoting shaft (not shown) inserted into the proximal end portion thereof. An L-shaped portion 19 bent counterclockwise in left-side elevation view is formed on the distal end of the second cover 18, i.e., the radial outer end portion around the second cover rotating shaft (not shown). The width-directional size of the L-shaped portion 19 is formed smaller than that of the sheet ejection port 9. A folding sheet stopper 20 is provided at the width-directional center of the L-shaped portion 19 in a swingable manner (see FIG. 2).

When pivoted about the second cover pivoting shaft (not shown) counterclockwise in left-side elevation view, the second cover 18 closes the processing section mounting port 10. At this time, the L-shaped portion 19 is accommodated in the sheet ejection space 12 from the sheet ejection port 9 as shown in FIG. 2, to come into contact and engage with the front end portion of the ejection tray 13 as shown in FIG. 1. Therefore, the pivot of the second cover 18 is restricted so that the second cover 18 keeps the state where the processing section mounting port 10 is closed. When the second cover 18 thus closes the processing section mounting port 10, the upper side surfaces of the L-shaped portion 19 and the ejection tray 13 are continuous with each other.

When the tip end of the L-shaped portion 19 and the front end portion of the ejection tray 13 are disengaged from each other, the second cover 18 is allowed to pivot. When the second cover 18 is pivoted about the second cover pivoting shaft (not shown) clockwise in left-side elevation view, the processing section mounting port 10 is opened as shown in FIG. 3.

The main body casing 2 is further formed therein with a process accommodation space 17, serving as an example of a second accommodation space, defined generally in the form of a rectangular parallelepiped to communicate with the processing section mounting port 10.

In the up-and-down direction, the process accommodation space 17 is defined by the ejection tray 13, a connecting wall 197 and a midway wall 52, as shown in FIG. 1. The connecting wall 197 corresponds to a portion of the upper sidewall of the main body casing 2 located rearward beyond the ejection tray 13. The midway wall 52, located between the ejection tray 13 and the lower sidewall of the main body casing 2 in the up-and-down direction, extends parallelly along the lower sidewall of the main body casing 2. In the right-and-left direction, on the other hand, the process accommodation space 17 is defined by the partition wall 15 and a second right-side inner wall 21 width-directionally opposed to the partition wall 15 at an interval on a position rightwardly under the first right-side inner wall 14, as shown in FIG. 3. The rear side of the process accommodation space 17 is closed with the rear wall of the main body casing 2, as shown in FIG. 1. More specifically, the process accommodation space 17 is defined generally in an L shape in left-side sectional view by the ejection wall 51, the ejection tray 13, the second cover 18, the midway wall 52, the rear sidewall of the main body casing 2 and the connecting wall 197. The process accommodation space 17 accommodates the image forming section 5.

(1-4) Sheet Feeding Tray Mounting Port

The sheet feeding tray mounting port 50, adjacent to the lower portion of the processing section mounting port 10 through the midway wall 52, has a generally rectangular shape width-directionally longitudinal in front elevation view.

The main body casing 2 is formed therein with a sheet feeding tray accommodation space 53 defined generally in the form of a rectangular parallelepiped communicating with the sheet feeding tray mounting port 50.

The sheet feeding tray accommodation space 53 is defined by the midway wall 52, the lower and right sidewalls of the main body casing 2 and the partition wall 15 in the up-and-down and right-and-left directions. The rear side of the feeding tray accommodation space 53 is closed with the rear wall of the main body casing 2. This feeding tray accommodation space 53 accommodates a sheet feeding tray 54 described later.

(1-5) Partition Wall

Figures 6A, 6B:
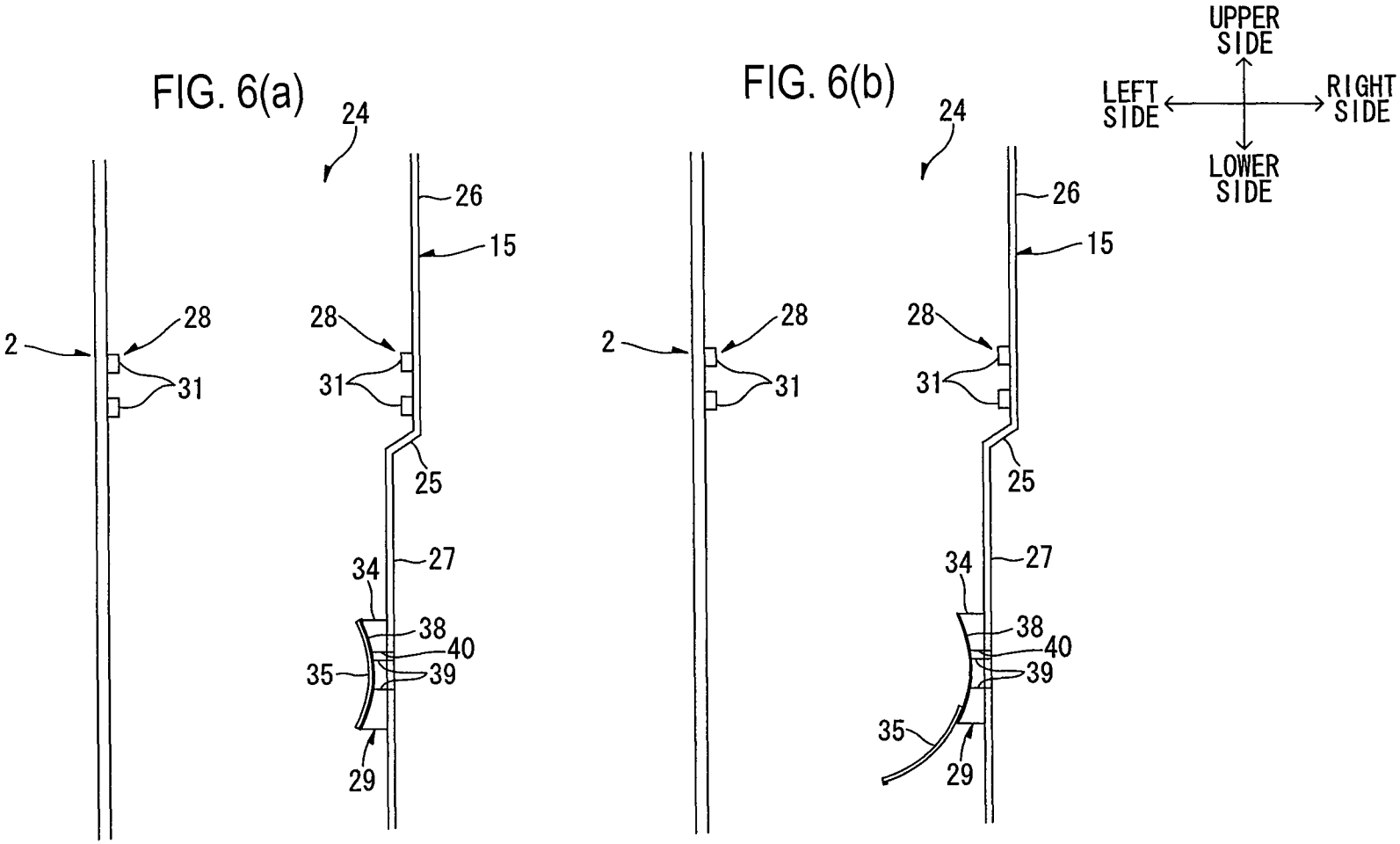
FIGS. 6(*a*) and 6(*b*), excerpting a cartridge receiving section accommodation space from the color laser printer in front elevation view, illustrate a closed state (partition-wall-side shutter closing position) and an opened state (partition-wall-side shutter opening position) of a partition-wall-side shutter respectively.

FIGS. 6(*a*) and 6(*b*), excerpting the cartridge receiving section accommodation space from the color laser printer in front elevation view, illustrate a closed state (partition-wall-side shutter closing position) and an opened state (partition-wall-side shutter opening position) of a partition-wall-side shutter respectively.

The partition wall 15 separates the sheet ejection space 12 and the process accommodation space 17 from the cartridge receiving section accommodation space 24 (see FIG. 4) between the sheet ejection port 9 and the cartridge receiving section mounting port 11, and between the processing section mounting port 10 and the cartridge receiving section mounting port 11, as described above.

The partition wall 15 is generally rectangular in side elevation view as shown in FIG. 5, and bent at a generally central portion 25 in the up-and-down direction generally in the form of a crank in front elevation view as shown in FIGS. 6(*a*) and 6(*b*), and integrally includes a partition wall upper portion 26 and a partition wall lower portion 27 located upward and downward beyond the bent portion 25 respectively. The partition wall lower portion 27 is formed so as to extend parallelly along the partition wall upper portion 26 on the left side of the partition wall upper portion 26.

As shown in FIG. 5, the partition wall 15 includes a guide rail 28, a partition-wall-side shutter mechanism 29, and a driving mechanism 30 serving as an example of a drive unit. The guide rail 28 is provided on a position of the left side surface of the partition wall upper portion 26 adjacent to the bent portion 25. The partition-wall-side shutter mechanism 29 is provided on a generally central position of the left side surface of the partition wall lower portion 27 in the up-and-down direction while the driving mechanism 30 is provided at the back of the partition-wall-side shutter mechanism 29.

The guide rail 28 is generally U-shaped in side elevation view with an open front side, and includes a pair of ridges 31 protruding leftward from the left side surface of the partition wall upper portion 26 to extend in the anteroposterior direction. The front edges of the pair of ridges 31 are located slightly rearward beyond the front end edge of the partition wall 15, while the rear end portions thereof are curvedly connected with each other. The upper ridge 31 of the pair of ridges 31 is formed with an inclined surface obliquely inclined upward toward the front end edge, on the front end portion of a portion opposed to the lower ridge 31. A pair of guide rail positioning projections 33 slightly projecting inward to face the pair of ridges 31 respectively are provided on positions of the opposed portions of the pair of ridges 31 located frontward beyond the portion (referred to as a connecting portion 32) connecting the rear end portions with each other as described above. Another guide rail 28 is provided on the right side surface of the left sidewall of the main body casing 2, and opposed to the guide rail 28 of the partition wall 15 in the width direction (see FIGS. 6(*a*) and 6(*b*)).

As shown in FIGS. 6(*a*) and 6(*b*), the partition-wall-side shutter mechanism 29 is arranged slightly under a generally central portion of the partition wall lower portion 27 in the up-and-down direction, and includes a partition-wall-side toner passing portion 34 and the partition-wall-side shutter 35 serving as an example of a second shutter member.

The partition-wall-side toner passing portion 34, having a generally prismatic shape longitudinal in the anteroposterior direction, has a left side surface provided in the form of an arc smoothly recessed rightward in front elevation view and a right side surface fixed to the left side surface of the partition wall lower portion 27. Leftwardly protruding partition-wall-side shutter support portions 38 are respectively provided on both anteroposterior end portions (see FIG. 5) of the left side surface of the partition-wall-side toner passing portion 34.

As shown in FIG. 5, partition-wall-side feed holes 39 and partition-wall-side return holes 40 adjacent to the rear sides of the partition-wall-side feed holes 39 are respectively formed on four portions of the partition-wall-side toner passing portion 34 anteroposteriorly separated at the same intervals. The partition-wall-side feed holes 39 and the partition-wall-side return holes 40 are circular in side elevation view, and pass through the partition-wall-side toner passing portion 34 and the partition wall lower portion 27 in the width direction. The partition-wall-side feed holes 39 and the partition-wall-side return holes 40 serve as examples of partition-wall-side openings and casing-side openings respectively. Partition wall sealing members (not shown) of felt, sponge or the like are provided around the partition-wall-side feed holes 39 and the partition-wall-side return holes 40 to protrude leftward.

The partition-wall-side shutter 35 is in the form of an arcuate thin plate longitudinal in the anteroposterior direction along the left side surface (see FIGS. 6(*a*) and 6(*b*)) of the partition-wall-side toner passing portion 34 in front elevation view. Downwardly recessed upper notches 41 are respectively formed on four portions of the upper end edge of the partition-wall-side shutter 35 separated at the same intervals in the anteroposterior direction. More specifically, each upper notch 41 is located rearward beyond the corresponding partition-wall-side return hole 40. Further, upwardly recessed lower notches 42 are respectively formed on positions of the lower end edge of the partition-wall-side shutter 35 opposed to the upper notches 41 in the up-and-down direction.

The partition-wall-side shutter support portions 38 support both anteroposterior end portions of the partition-wall-side shutter 35, so that the partition-wall-side shutter 35 is slidable along the arcuate left side surface (see FIGS. 6(*a*) and 6(*b*)) of the partition-wall-side toner passing portion 34. Therefore, the partition-wall-side shutter 35 is slidably movable between the partition-wall-side shutter closing position for closing all the partition-wall-side feed holes 39 and all the partition-wall-side return holes 40 from the left side as shown in FIG. 6(*a*), and the partition-wall-side shutter opening position for opening all the partition-wall-side feed holes 39 and all the partition-wall-side return holes 40 from the left side as shown in FIG. 6(*b*). The partition-wall-side shutter 35 is provided on both anteroposterior end portions (see FIG. 5) thereof with engaging portions (not shown) engaging with the partition-wall-side shutter support portions 38 when the partition-wall-side shutter support portions 38 support both anteroposterior end portions of the partition-wall-side shutter 35. Thus, the partition-wall-side shutter 35 is prevented from undesirable detachment from the partition-wall-side shutter support portions 38. Clearances (see FIG. 6(*a*)) formed between the partition-wall-side shutter 35 located on the partition-wall-side shutter closing position and the peripheral edges of the partition-wall-side feed holes 39 and the partition-wall-side return holes 40 are sealed with the aforementioned partition wall sealing members (not shown) in the right-and-left direction.

As shown in FIG. 5, the driving mechanism 30 is arranged slightly downward beyond a generally central position of the partition-wall-side toner passing portion 34 in the up-and-down direction and rearward beyond the partition-wall-side toner passing portion 34, and includes a gear support portion 43, a first gear 44 and a second gear 45.

The gear support portion 43 is in the form of a thin plate generally L-shaped in plan view, and integrally includes a first support portion 46 and a second support portion 47.

The first support portion 46 is generally rectangular in left-side elevation view, and the front side surface thereof is fixed to the left side surface of the partition wall lower portion 27. A first support hole (not shown) passing through the first support portion 46 and the partition wall lower portion 27 in the width direction is formed at the central position of the first support portion 46 in the anteroposterior and up-and-down directions.

The second support portion 47 is generally rectangular in front elevation view, and the right end portion thereof is connected to the front end portion of the first support portion 46. A second support hole 48 circular in front elevation view is formed at the central position of the second support portion 47 in the right-and-left and up-and-down directions, to pass through the second support portion 47 in the anteroposterior direction.

The first gear 44 is a bevel gear, and a portion (tooth portion) provided with teeth is exposed in the cartridge receiving section accommodation space 24 from the left side surface of the partition wall lower portion 27. The rotating shaft of the first gear 44 is inserted into a first support hole (not shown) of the first support portion 46 along the width direction, and the first support portion 46 rotatably supports the first gear 44. Another portion of the first gear 44 opposed to the tooth portion along the rotating shaft is arranged rightward beyond the partition wall lower portion 27, and connected to an agitator driving motor (not shown).

The second gear 45 is a bevel gear, whose rotating shaft is inserted into the second support hole 48 of the second support portion 47 along the anteroposterior direction, and the second support portion 47 rotatably supports the second gear 45. A portion (tooth portion) of the second gear 45 provided with teeth is arranged rearward beyond the second support portion 47, and meshes with the tooth portion of the first gear 44 generally perpendicularly in plan view. A portion of the rotating shaft of the second gear 45 located frontward beyond the second support portion 47 is in the form of a cylinder having a larger diameter than that of the second support hole 48, and a rearwardly recessed connecting hole 49 is formed on the front side surface thereof. The connecting hole 49 is formed generally in the figure of "8" in front elevation view.

When the agitator driving motor (not shown) is driven in the driving mechanism 30, the first gear 44 is rotated clockwise in left-side elevation view while the second gear 45 is rotated counterclockwise (along the arrow in FIG. 5) in rear elevation view following the rotation of the first gear 44.

(2) Sheet Feeding Section

As shown in FIG. 1, the sheet feeding section 4 includes the sheet feeding tray 54 accommodating the sheets 3, a sheet feeding roller 55 provided above the rear end portion of the sheet feeding tray 54, and a separation roller 56 and a separation pad 57 opposed to each other at the back of the sheet feeding roller 55. The sheet feeding section 4 further includes two assist rollers 58 opposed to the separation roller 56 above the separation pad 57, a sheet feeding transport path 59 extending generally upward from the opposed portion between the upper assist roller 58 and the separation roller 56, and a pair of transport rollers 60 provided on a midway of the sheet feeding transport path 59.

The sheet feeding tray 54 is generally in the form of a box having an open upper portion, and anteroposteriorly slidably attached/detached to/from the sheet feeding tray accommodation space 53 of the main body casing 2 from the front side. When the sheet feeding tray accommodation space 53 accommodates the sheet feeding tray 54, the front sidewall of the sheet feeding tray 54 closes the sheet feeding tray mounting port 50.

The sheets 3 are stacked in the sheet feeding tray 54, and the uppermost sheet 3 is fed to the opposed portion between the separation roller 56 and the separation pad 57 through rotation of the sheet feeding roller 55, separated and thereafter guided by the assist rollers 58 to be fed generally upward along the outer circumferential surface of the separation roller 56. This sheet 3 is delivered to the sheet feeding transport path 59 from the opposed portion between the upper assist roller 58 and the separation roller 56. The sheet 3 delivered to the sheet feeding transport path 59 is advanced generally upward in the sheet feeding transport path 59 through the transport rollers 60, and transported to a secondary transfer position between a secondary transfer roller 178 and an intermediate transfer belt 176 described later.

(3) Image Forming Section

Figure 7:
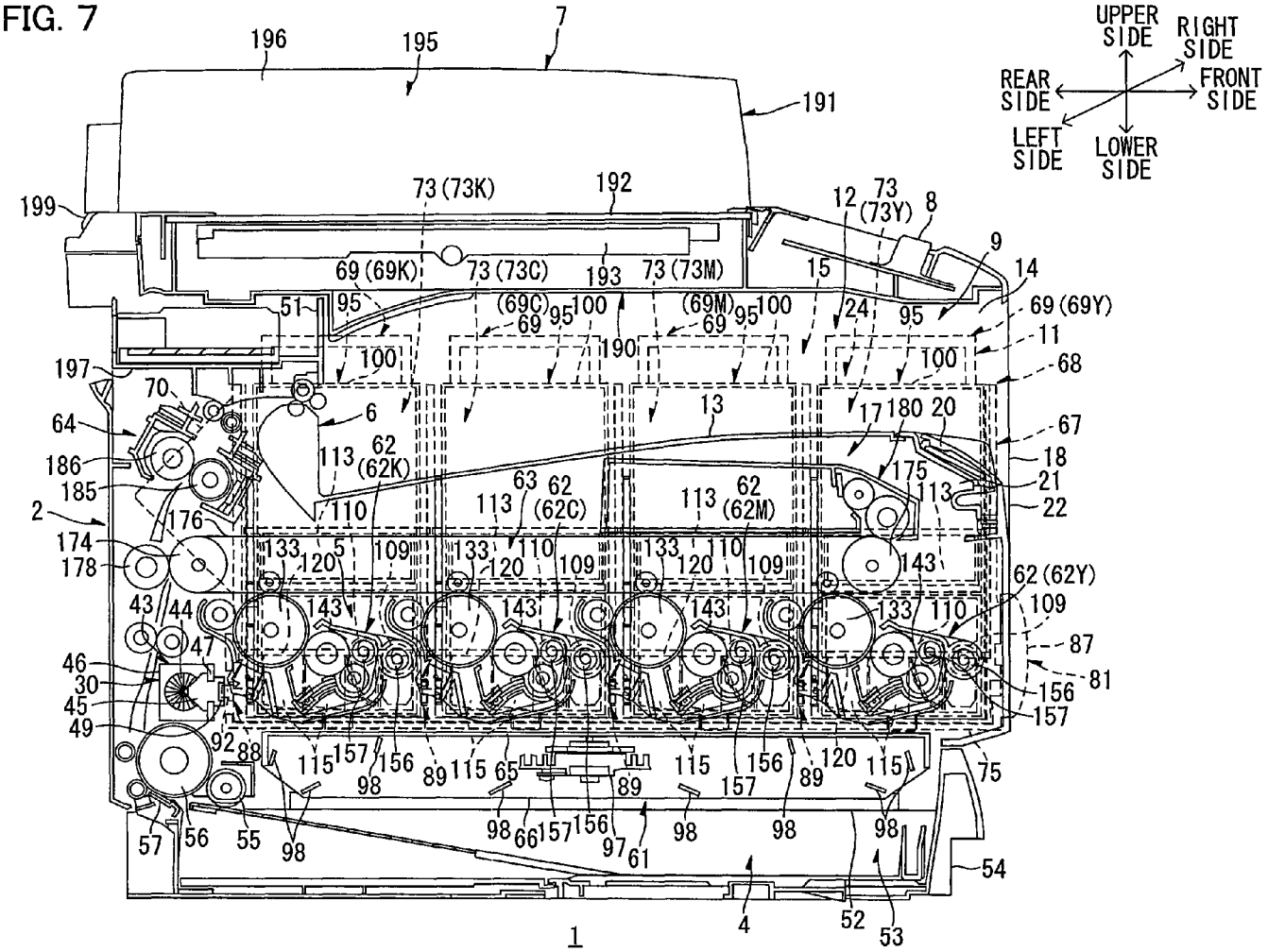
FIG. 7 is a left-side sectional view of the color laser printer cut along a position where a cartridge receiving section is exposed.

FIG. 7 is a left-side sectional view of the color laser printer cut along a position where the cartridge receiving section 68 is exposed.

The image forming section 5 includes a scanner unit 61, a toner feeding section 67 (see FIG. 7), the processing sections 62, a transferring section 63 and a fixing section 64.

(3-1) Scanner Unit

As shown in FIG. 7, the scanner unit 61 is arranged in a lower portion of the process accommodation space 17 of the main body casing 2 under the plurality of processing sections 62 described later. This scanner unit 61 includes a scanner frame 65 fixed to the aforementioned midway wall 52 and a scanner casing 66 fixed to the scanner frame 65. The scanner frame 65 and the scanner casing 66 are provided with exit windows (not shown) corresponding to the processing sections 62 respectively. Optical members such as a light source, a polygonal mirror 97, an f□ lens, reflecting mirrors 98 and a face tangle error correcting lens are arranged in the scanner casing 66, and a laser beam emitted from the light source on the basis of image data is deflected and scanned by the polygonal mirror 97, passes through the f□ lens and the face tangle error correcting lens, is reflected by the reflecting mirrors 98 and thereafter applied onto the surface of a photosensitive drum 133 serving as an example of an image carrier, described later, of the processing section 62 through the exit window (not shown) by high-speed scanning, as shown by arrows in FIG. 1.

(3-2) Toner Feeding Section

Figure 8:
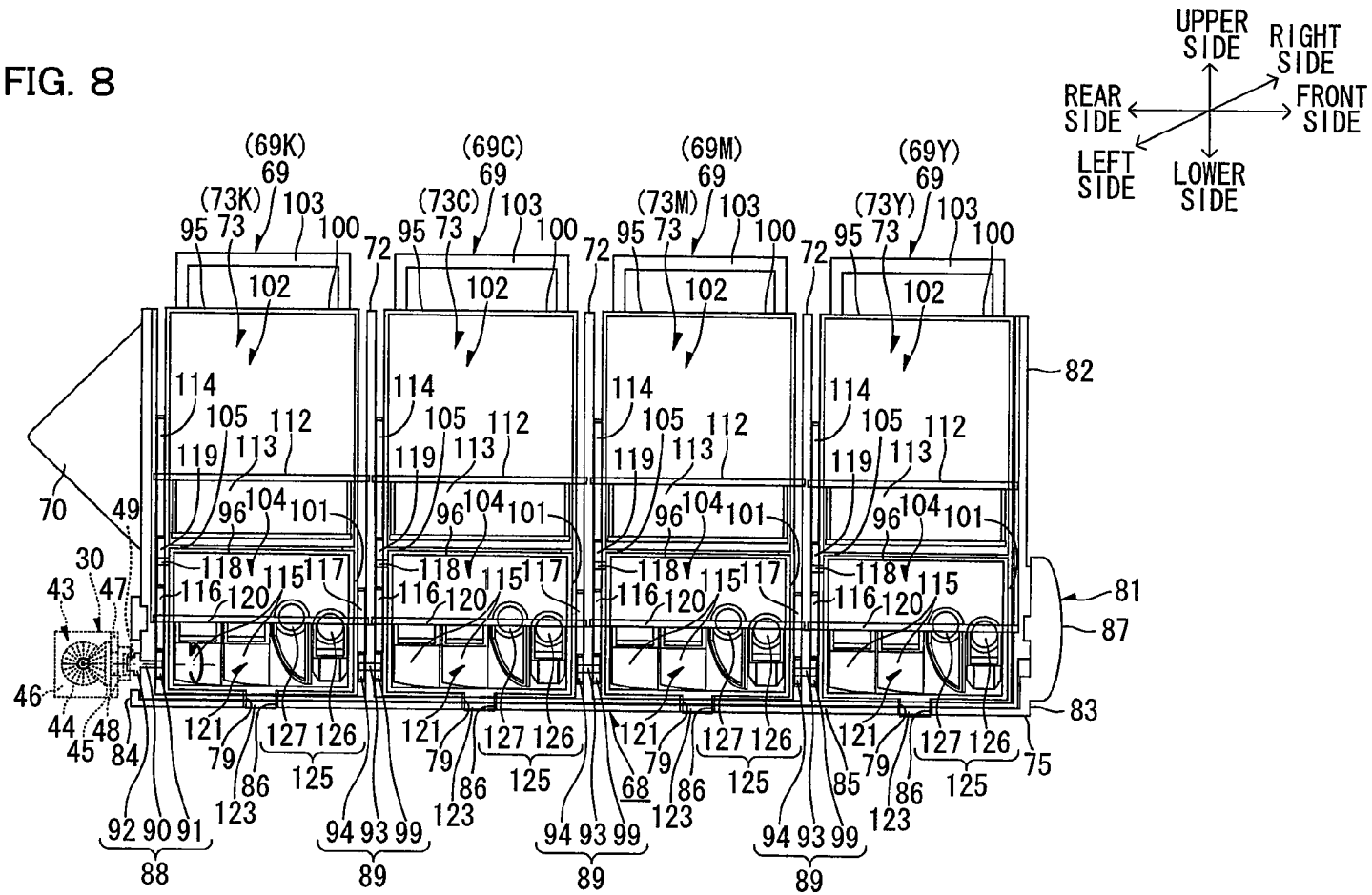
FIG. 8 is a left-side sectional view of the cartridge receiving section accommodating all toner cartridges.
Figure 9:
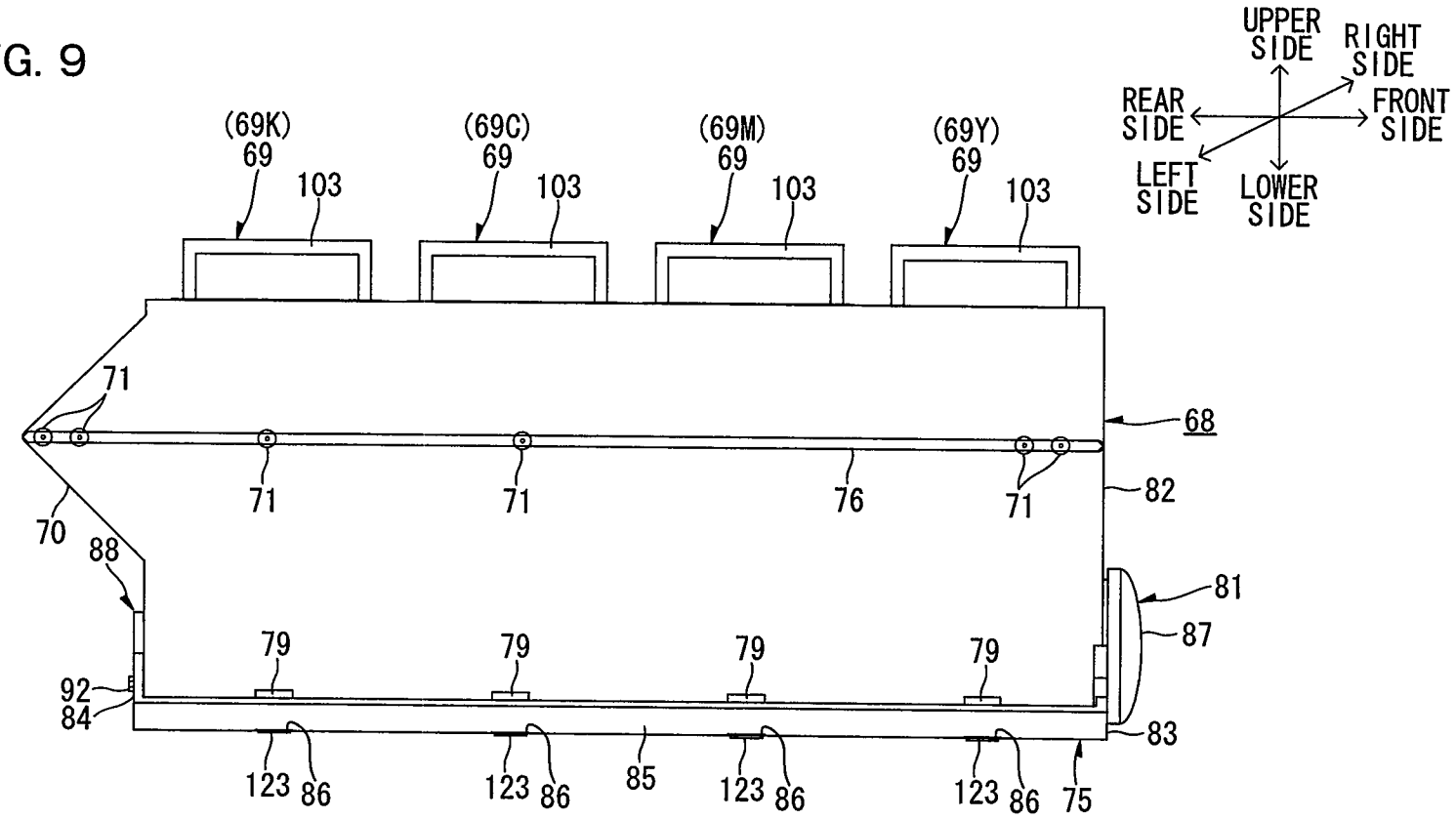
FIG. 9 is a left-side elevation view of the cartridge receiving section accommodating all toner cartridges.
Figure 10:
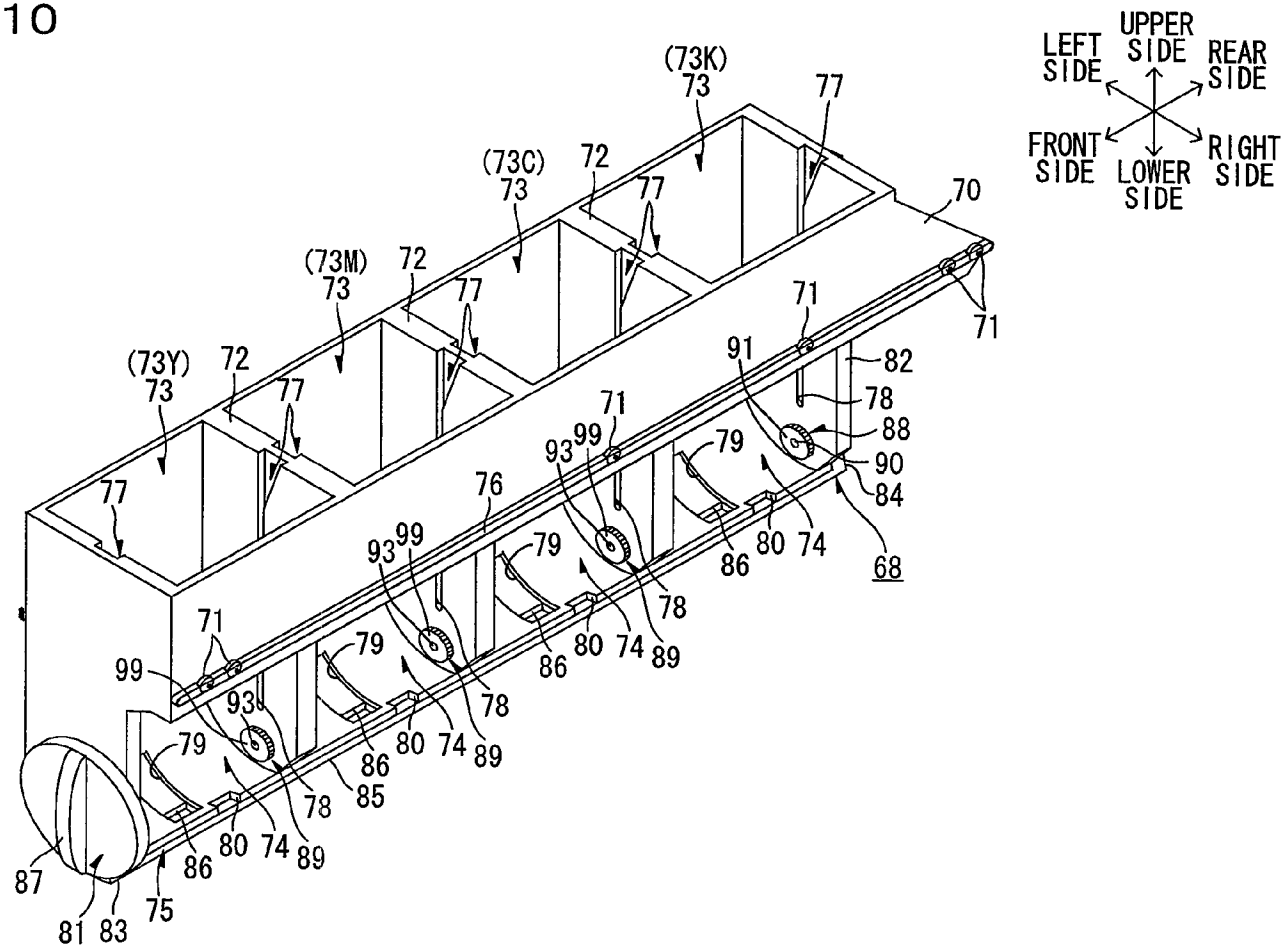
FIG. 10 is a right-side perspective view of the cartridge receiving section accommodating no toner cartridges.

FIG. 8 is a left-side sectional view of the cartridge receiving section accommodating all toner cartridges. FIG. 9 is a left-side elevation view of the cartridge receiving section accommodating all toner cartridges. FIG. 10 is a right-side perspective view of the cartridge receiving section accommodating no toner cartridges. FIGS. 11(*a*) and 11(*b*) are front elevation views of the cartridge receiving section, with an operation lever located on a lever closing position and a lever opening position respectively.

The toner feeding section 67 is arranged in the cartridge receiving section accommodation space 24 of the main body casing 2 as shown in FIG. 4, and includes the cartridge receiving section 68 and the toner cartridges 69 serving as examples of developing agent cartridges as shown in FIG. 8.

(3-2-1) Cartridge Receiving Section

The cartridge receiving section 68 includes a receiving section casing 82, roller support portions 76 (see FIG. 9), an opening/closing member 75, the operation lever 81 serving as an example of an operation member, a first transmission portion 88 and second transmission portions 89.

The receiving section casing 82 is generally in the form of a box having an open upper portion. More specifically, the receiving section casing 82 generally has an inverted L shape with an upper half wider than the lower half, and the lower half has a generally arcuate lower end portion, in front elevation view, as shown in FIGS. 11(*a*) and 11(*b*). A triangular projection 70 generally triangularly protruding rearward in side elevation view is integrally formed on the upper half of the rear end portion of the receiving section casing 82, as shown in FIGS. 9 and 10. The left and right side surfaces of the triangular projection 70 are flush with the corresponding left and side surfaces of the receiving section casing 82 respectively. An opening exposing the interior of the receiving section casing 82 is formed in the lower half of the right side surface of the receiving section casing 82, as shown in FIG. 10.

Three receiving section partition walls 72 arranged at the same intervals along the anteroposterior direction are integrally provided in the receiving section casing 82, to partition the interior of the receiving section casing 82 into four receiving chambers 73 along the anteroposterior direction. The receiving section partition walls 72 also partition the aforementioned opening provided in the lower half of the right side surface of the receiving section casing 82 into four receiving-section-side openings 74 along the anteroposterior direction. The receiving-section-side openings 74 serve as examples of passage-side openings.

Attachment/detachment guide grooves 77 are respectively formed on the same positions of side surfaces anteroposteriorly opposed to each other in the front and rear sidewalls of the receiving section casing 82 and in the receiving section partition walls 72. The attachment/detachment guide grooves 77, generally Y-shaped in front or rear elevation view, are so formed that the width thereof is gradually reduced downward from the upper end edges of the front and rear sidewalls of the receiving section casing 82 and of the side surfaces the receiving section partition walls 72 to reach a constant level in intermediate portions. The lower end portion of each attachment/detachment guide groove 77 is located on a position separated upward from the lower end of the receiving section casing 82 by a distance corresponding to about ⅕ of the up-and-down size of the receiving section casing 82. In the groove walls of the attachment/detachment guide grooves 77, receiving section positioning projections 78 slightly protruding in the direction where the groove walls are opposed to each other are respectively provided on positions slightly upward beyond the lower end edges of the groove walls.

The lower end portion of the receiving section casing 82 is generally arcuate in front elevation view as described above, whereby the lower sidewall of the receiving section casing 82 is also generally arcuate in front elevation view. The right end edge of the receiving section casing 82 defines the lower end edges of the receiving-section-side openings 74. Receiving section penetration holes 79 longitudinal in the right-and-left direction in right-side elevation view are respectively formed on anteroposterior centers of portions of the lower sidewall of the receiving section casing 82 corresponding to the receiving chambers 73 respectively, to pass through the lower sidewall of the receiving section casing 82 along the thickness direction.

Leftwardly recessed receiving section notches 80 are respectively formed on portions of the right end edge of the lower sidewall of the receiving section casing 82 corresponding to the receiving chambers 73. In the receiving chambers 73, the receiving section notches 80 are respectively positioned rearward beyond the receiving section penetration holes 79.

The roller support portions 76 are in the form of rails respectively extending from the rear end portions of the left and right side surfaces of the triangular projection 70 toward the front end portions of the corresponding left and right side surfaces of the receiving section casing 82 along the anteroposterior direction, as shown in FIGS. 9 and 10. A plurality of rollers 71 are rotatably provided on the width-directional outer side surface of each roller support portion 76. More specifically, pairs of two rollers 71 are arranged on both anteroposterior end portions of each roller support portion 76 at intervals in the anteroposterior direction.

As shown in FIG. 9, the opening/closing member 75 is generally U-shaped in side elevation view to sandwich the lower end portion of the receiving section casing 82 in the anteroposterior direction, and integrally includes a front arm portion 83, a rear arm portion 84 and an opening/closing main portion 85.

The front and rear arm portions 83 and 84 are in the form of thin plates provided with swinging shafts (not shown) on first longitudinal end portions thereof respectively. The swinging shaft (not shown) of the front arm portion 83 is inserted into a support hole (not shown) formed in the front sidewall of the receiving section casing 82, so that the front arm portion 83 is supported on the front sidewall of the receiving section casing 82 in a swingable manner. Further, the swinging shaft (not shown) of the rear arm portion 84 is inserted into a support hole (not shown) formed in the rear sidewall of the receiving section casing 82, so that the rear arm portion 84 is supported on the rear sidewall of the receiving section casing 82 in a swingable manner. The rear arm portion 84 is so arcuately formed (not shown) as to avoid a connecting projection 92 of the first transmission portion 88. The swinging centers of the front and rear arm portions 83 and 84 and the arc center of the lower sidewall of the receiving section casing 82 are on the same position in front sectional view.

The opening/closing main portion 85 is in the form of a thin plate generally arcuate in front sectional view and longitudinal in the anteroposterior direction along the lower sidewall of the receiving section casing 82. As shown in FIG. 10, the opening/closing main portion 85 is formed with four opening/closing main portion engaging holes 86 passing through the opening/closing main portion 85 along the thickness direction at the same intervals in the anteroposterior direction. Each opening/closing main portion engaging hole 86 is rectangular in plan view, and the anteroposterior size thereof is set slightly smaller than that of each receiving section penetration hole 79. The right-and-left size of each opening/closing main portion engaging hole 86 is set to about ⅕ of that of each receiving section penetration hole 79.

The opening/closing main portion 85 extends between second longitudinal end portions of the front and rear arm portions 83 and 84 opposite to the aforementioned first longitudinal end portions provided with the swinging shafts (not shown). Therefore, the opening/closing main portion 85 is swingable along the lower sidewall of the receiving section casing 82 about a swinging center defined by the arc center of the lower sidewall of the receiving section casing 82. More specifically, the opening/closing main portion 85 is swingable in the range where the opening/closing main portion engaging holes 86 is always exposed from the receiving section penetration holes 79.

The operation lever 81 is discoidal in the front elevation view, and a grasp portion 87 generally arcuate in right-side elevation view protrudes frontward from the width-sectional center of the front side surface thereof. The rear side surface of the operation lever 81 is fixed to the front side surface of the front arm portion 83 of the opening/closing member 75. In other words, the operation lever 81 is arranged on the front end portion of the cartridge receiving section 68. Thus, the user can open/close the opening/closing member 75 by grasping the grasp portion 87 from the front side of the cartridge receiving section 68 and turning the operation lever 81 clockwise or counterclockwise in front elevation view. In the following description, it is assumed that the position of the operation lever 81 where the right end edge of each opening/closing main portion engaging hole 86 aligns with that of the corresponding receiving section penetration hole 79 as shown in FIG. 11(*a*) is the lever closing position. It is also assumed that the position of the operation lever 81 where the left end edge of each opening/closing main portion engaging hole 86 aligns with that of the corresponding receiving section penetration hole 79 as shown in FIG. 11(*b*) is the lever opening position.

The first transmission portion 88 integrally includes a first support shaft 90, a first transmission gear 91 and the connecting projection 92, as shown in FIG. 8. The first support shaft 90, extending in the anteroposterior direction, is so provided as to pass through the rear sidewall of the receiving section casing 82 on a position downward beyond the attachment/detachment guide grooves 77 (see FIG. 10), and rotatably supported on this rear sidewall. The front end portion of the first support shaft 90 is located frontward beyond the front side surface of the rear sidewall of the receiving section casing 82, and provided with the first transmission gear 91. The rear end portion of the first support shaft 90 is located rearward beyond the rear side surface of the rear sidewall of the receiving section casing 82, and provided with the connecting projection 92. The first transmission gear 91 is a spur gear provided with teeth on the outer circumferential surface thereof. The connecting projection 92, protruding rearward from the rear end portion of the first support shaft 90, is formed generally in the figure of "8" smaller than the aforementioned connecting hole 49 (see FIG. 5) of the second gear 45 in rear elevation view.

Each of the three second transmission portions 89, provided correspondingly to the receiving section partition walls 72 of the receiving section casing 82 respectively, includes a second support shaft 93, an input transmission gear 94 serving as an example of an input portion, and an output transmission gear 99 serving as an example of an output portion. The second support shaft 93, extending in the anteroposterior direction, is so provided as to pass through each receiving section partition wall 72 on a position downward beyond the attachment/detachment guide grooves 77 (see FIG. 10), and rotatably supported on this receiving section partition wall 72. The front end portion of the second support shaft 93 is located frontward beyond the front side surface of each receiving section partition wall 72, and provided with the output transmission gear 99. The rear end portion of the second support shaft 93 is located rearward beyond the rear side surface of each receiving section partition wall 72, and provided with the input transmission gear 94. The input and output transmission gears 94 and 99 are spur gears provided with teeth on the outer circumferential surfaces thereof, and identical in size to the first transmission gear 91.

(3-2-2) Toner Cartridge

Figures 12A, 12B, 12C:
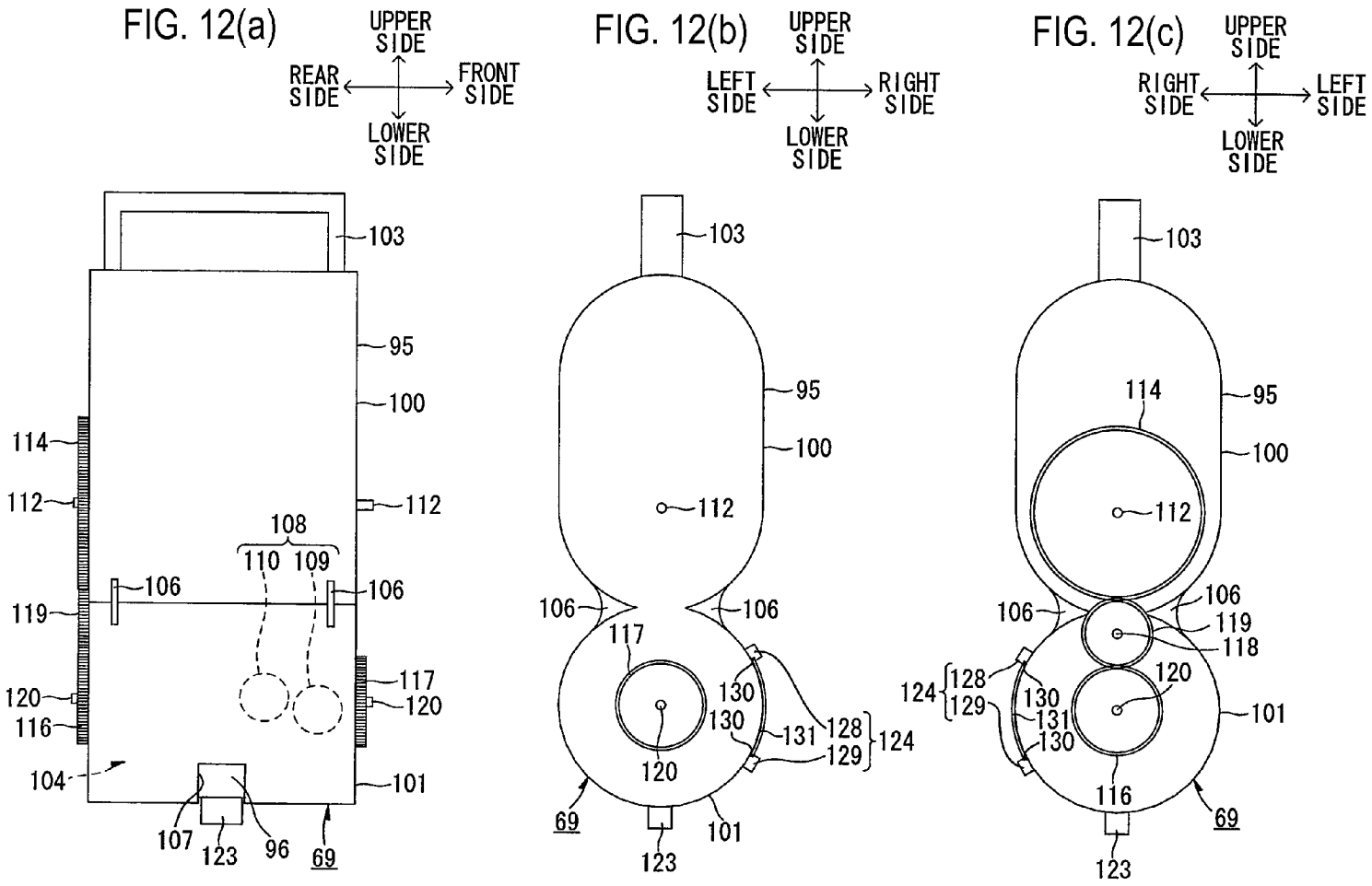
FIGS. 12(*a*), 12(*b*) and 12(*c*) are a left-side elevation view, a front elevation view and a rear elevation view of each toner cartridge respectively.
Figure 13B:
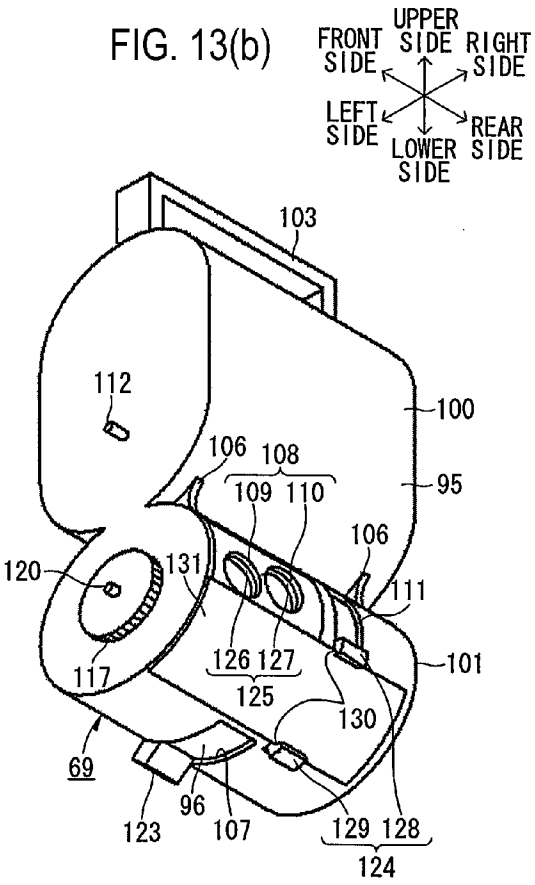
FIGS. 13(*a*) and 13(*b*) are right-side perspective views of each toner cartridge, with an inner cylinder located on a cartridge-side shutter closing position and a cartridge-side shutter opening position respectively.
Figure 13A:
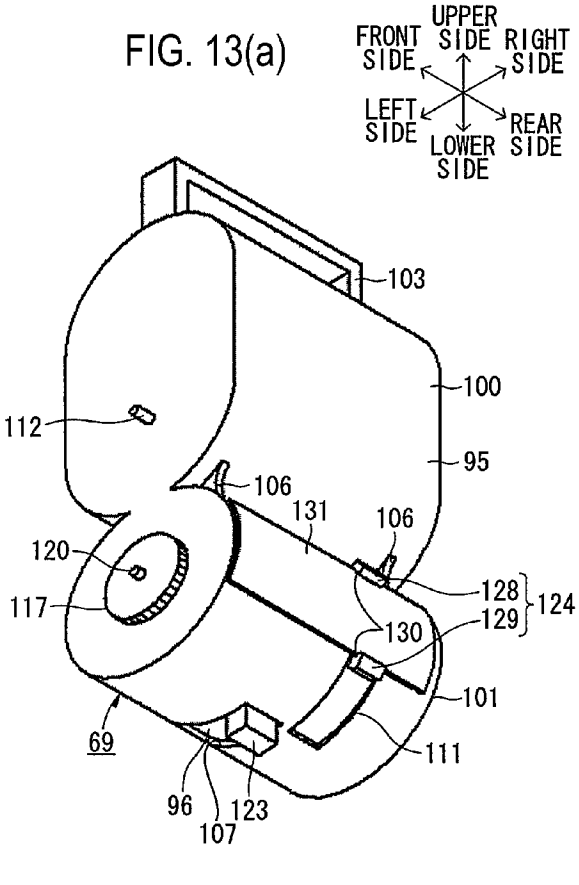
Figure 14B:
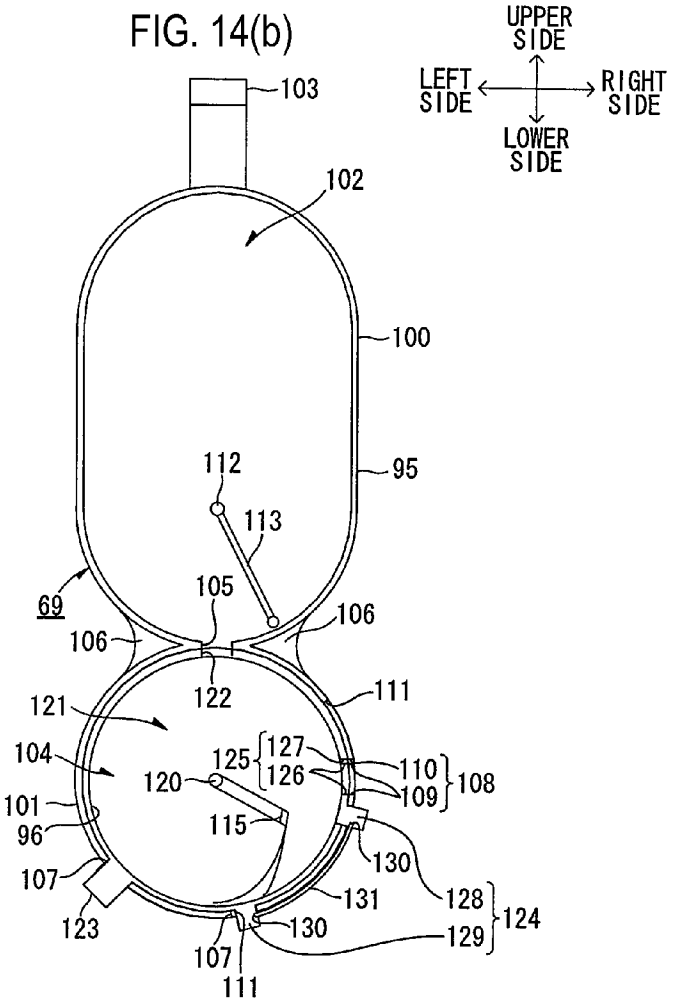
FIGS. 14(*a*) and 14(*b*) are front sectional views of each toner cartridge, with the inner cylinder located on the cartridge-side shutter closing position and the cartridge-side shutter opening position respectively.
Figure 14A:
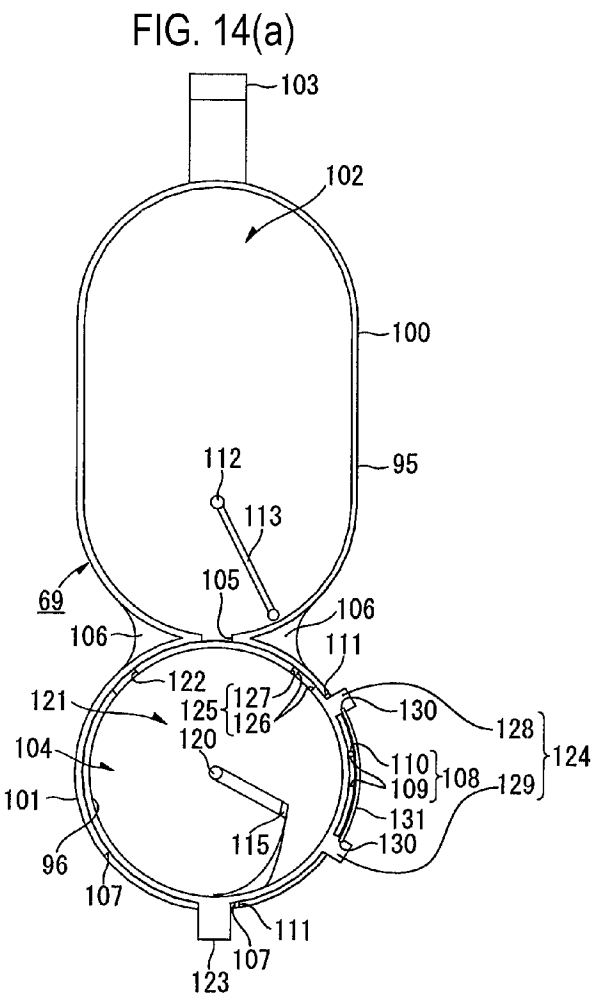

FIGS. 12(*a*), 12(*b*) and 12(*c*) are a left-side elevation view, a front elevation view and a rear elevation view of each toner cartridge respectively. FIGS. 13(*a*) and 13(*b*) are right-side perspective views of each toner cartridge, with an inner cylinder located on a cartridge-side shutter closing position and a cartridge-side shutter opening position respectively. FIGS. 14(*a*) and 14(*b*) are front sectional views of each toner cartridge, with the inner cylinder located on the cartridge-side shutter closing position and the cartridge-side shutter opening position respectively. FIGS. 14(*a*) and 14(*b*) show a first projection, a second projection, a first projection exposing hole, a second projection exposing hole, an inner-cylinder-side opening and an outer-cylinder-side opening on the same plane, for the convenience of illustration.

The four toner cartridges 69 are provided correspondingly to developing rollers 143 (see FIG. 21) serving as examples of developing agent carriers, of the processing sections 62 provided correspondingly to toners of respective colors described later. Each toner cartridge 69 is formed generally in the figure of "8" in front elevation view and generally rectangular in right-side elevation view as shown in FIGS. 12(*a*) to 12(*c*), and includes an outer cylinder 95 serving as an example of a cartridge case, and the inner cylinder 96 serving as an example of a first shutter member, a feed-side shutter, a return-side shutter or a cartridge-side shutter, as shown in FIGS. 14(*a*) and 14(*b*).

The outer cylinder 95 is a hollow member formed generally in the figure of "8" in front elevation view and generally rectangular in right-side elevation view similarly to the toner cartridge 69, and integrally includes a storage section 100 forming the upper portion thereof and a feed section 101 serving as an example of a generally cylindrical portion, forming the lower portion thereof.

The storage section 100 is in the form of an ellipse longitudinal in the up-and-down direction in front elevation view, and has a grip 103 provided on the upper end portion thereof, as shown in FIG. 12(*a*). The grip 103 is generally in an inverted U shape in left-side elevation view, and distal end portions thereof are fixed to both anteroposterior end portions of the upper end portion of the storage section 100 respectively.

A storage chamber 102 defined in the form of an ellipse longitudinal in the up-and-down direction in front elevation view is formed in the storage section 100, as shown in FIGS. 14(*a*) and 14(*b*).

The storage chamber 102 stores a toner of a corresponding color among black, cyan, magenta and yellow. The toner of each color is a positively chargeable nonmagnetic one-component polymerized toner as an example of developing agent. The toner cartridge 69 having the storage chamber 102 storing the black toner is hereinafter referred to as a black toner cartridge 69K, while the remaining toner cartridges 69 are also referred to as yellow, magenta and cyan toner cartridges 69Y, 69M and 69C according to the corresponding colors respectively.

A storage-side agitator rotating shaft 112 serving as an example of a second rotating shaft extends between the front and rear sidewalls of each storage section 100, as shown in FIG. 8. More specifically, the storage-side agitator rotating shaft 112 so anteroposteriorly extends (see FIG. 12(*b*)) as to pass through a portion close to the arc center of the lower arc of the elliptically formed storage section 100 in front elevation view, and is rotatably supported by the front and rear sidewalls of the storage section 100. The storage-side agitator rotating shaft 112 is provided with a storage-side agitator 113 serving as an example of a second agitating member.

The storage-side agitator 113 is formed in a rectangular shape in left-side elevation view, by a bar rotating along the lower arc of the storage section 100 and a member holding the bar. This storage-side agitator 113 is arranged in the storage chamber 102, and the proximal edge thereof is fixed to the storage-side agitator rotating shaft 112.

As shown in FIG. 12(*a*), the front and rear end portions of the storage-side agitator rotating shaft 112 protrude frontward and rearward from the front and rear sidewalls of the storage section 100 respectively. A storage-side agitator input gear 114 serving as an example of a storage-chamber-side input portion is provided on the portion of the storage-side agitator rotating shaft 112 protruding rearward from the rear sidewall of the storage section 100.

The storage-side agitator input gear 114 is a spur gear provided with teeth on the outer circumferential surface thereof, and the diameter of this storage-side agitator input gear 114 is so set that the storage-side agitator input gear 114 is settled inside the contour of the storage section 100 in rear elevation view as shown in FIG. 12(*c*). The anteroposterior size of the storage-side agitator input gear 114 is equalized to those of the input and output transmission gears 94 and 99, as shown in FIG. 8.

The feed section 101 is circular in front elevation view as shown in FIGS. 12(*b*) and 12(*c*), and the upper end portion thereof is connected to the lower end portion of the storage section 100. Connecting ribs 106 are respectively provided on both width-directional sides of the connecting portion between the storage section 100 and the feed section 101 for connecting the outer side surfaces of the storage section 100 and the feed section 101 with each other in the vicinity of the connecting portion. The connecting ribs 106, each provided in the form of a generally triangular thin plate in front elevation view, are provided on both anteroposterior end portions of the storage section 100 and the feed section 101 respectively. These connecting ribs 106 ensure rigidity of the outer cylinder 95 in the connecting portion between the storage section 100 and the feed section 101.

An inner cylinder accommodation chamber 104 defined generally in the form of a cylinder circular in front elevation view is formed in the feed section 101, as shown in FIGS. 14(*a*) and 14(*b*). An outer cylinder connecting hole 105 passing through the connecting portion between the storage section 100 and the feed section 101 in the up-and-down direction is formed in this connecting portion. The outer cylinder connecting hole 105 is in the form of a rectangle anteroposteriorly longitudinal in plan view, and the inner cylinder accommodation chamber 104 communicates with the storage chamber 102 through the outer cylinder connecting hole 105.

The feed section 101 is formed with the first projection exposing hole 107, the second projection exposing hole 111, and the outer-cylinder-side opening 108 serving as an example of a cartridge-side opening, as shown in FIGS. 12(*a*), 13(*a*) and 13(*b*).

The first projection exposing hole 107 is generally rectangular in left-side elevation view, and formed over the range from the six o'clock position (i.e., the lower end portion of the feed section 101) to about the eight o'clock position in front elevation view at the anteroposterior center of the feed section 101 (see FIGS. 12(*a*), 13(*b*), 14(*a*) and 14(*b*)).

The second projection exposing hole 111 is generally rectangular in right-side elevation view as shown in FIGS. 13(*a*) and 13(*b*), and formed over the range from the six o'clock position (i.e., the lower end portion of the feed section 101) to about the two o'clock position in front elevation view (see FIGS. 14(*a*) and 14(*b*)) on a generally central portion of the feed section 101 in the anteroposterior direction, more specifically on a position rearward beyond the first projection exposing hole 107.

The outer-cylinder-side opening 108 includes an outer-cylinder-side feed hole 109 serving as an example of a feed-side opening, and an outer-cylinder-side return hole 110 serving as an example of a return-side opening, as shown in FIG. 13(*b*). The outer-cylinder-side feed hole 109 and the outer-cylinder-side return hole 110 are in the form of circles generally identical in size to each other in right-side elevation view, and formed on the front half of the right end portion of the feed section 101. The outer-cylinder-side feed hole 109 and the outer-cylinder-side return hole 110 are adjacent to each other. More specifically, the outer-cylinder-side return hole 110 is adjacent to the rear side (more specifically, a portion slightly obliquely above the rear side) of the outer-cylinder-side feed hole 109.

A feed-side agitator rotating shaft 120 serving as an example of a rotating shaft or a first rotating shaft extends between the front and rear sidewalls of each feed section 101, as shown in FIG. 8. More specifically, the feed-side agitator rotating shaft 120 anteroposteriorly extends (see FIG. 12(*b*)) to pass through the circle center of the circular feed section 101 in front elevation view, and is rotatably supported by the front and rear sidewalls of the feed section 101. The feed-side agitator rotating shaft 120 is provided with a plurality of feed-side agitators 115 serving as examples of agitating members or first agitating members.

The plurality of feed-side agitators 115, each formed by a flexible film or the like generally rectangular in left-side elevation view and generally in the form of an inverted L (see FIGS. 14(*a*) and 14(*b*)) in front elevation view, are arranged in the inner cylinder accommodation chamber 104, and the proximal edges thereof are fixed to the feed-side agitator rotating shaft 120. Each feed-side agitator 115 is so formed that the distal end thereof slidably comes into contact with the inner circumferential surface of the inner cylinder accommodation chamber 104 (feed chamber 121 described later) to be deflected upstream in the rotational direction.

As shown in FIG. 12(*a*), the front and rear end portions of the feed-side agitator rotating shaft 120 protrude frontward and rearward from the front and rear sidewalls of the feed section 101 respectively. A feed-side agitator input gear 116 serving as an example of an input transmission portion is provided on the portion of the feed-side agitator rotating shaft 120 protruding rearward from the rear sidewall of the feed section 101. A feed-side agitator output gear 117 serving as an example of an output transmission portion is provided on the portion of the feed-side agitator rotating shaft 120 protruding frontward from the front sidewall of the feed section 101. The yellow toner cartridge 69Y is provided with no feed-side agitator output gear 117 (see FIG. 8).

The feed-side agitator input gear 116 and the feed-side agitator output gear 117 are spur gears, identical in size to each other, provided with teeth on the outer circumferential surfaces thereof, and the diameters thereof are set to about half of the diameter of the feed section 101 circularly formed in front elevation view, as shown in FIGS. 12(*b*) and 12(*c*). The anteroposterior size of the feed-side agitator input gear 116 and the feed-side agitator output gear 117 is equalized to that of the storage-side agitator input gear 114. The feed-side agitator rotating shaft 120, the feed-side agitator input gear 116 and the feed-side agitator output gear 117 serve as an example of a third transmission portion. Further, the first transmission portion 88, the second transmission portion 89, the feed-side agitator rotating shaft 120, the feed-side agitator input gear 116 and the feed-side agitator output gear 117 serve as an example of a transmission unit.

In the rear sidewall of the feed section 101, an intermediate gear support shaft 118 is provided on a position upward beyond the feed-side agitator input gear 116 to protrude rearward from the rear sidewall of the feed section 101, as shown in FIG. 12(*c*). The intermediate gear support shaft 118 is provided with an intermediate gear 119 serving as an example of an intermediate transmission portion. The storage-side agitator rotating shaft 112, the storage-side agitator input gear 114 and the intermediate gear 119 serve as an example of a storage-chamber-side transmission portion.

The intermediate gear 119 is a spur gear provided with teeth on the outer circumferential surface thereof, and the diameter thereof is equalized to the opposition interval between the feed-side agitator input gear 116 and the storage-side agitator input gear 114. The intermediate gear 119 meshes with the feed-side agitator input gear 116 and the storage-side agitator input gear 114. The anteroposterior size of the intermediate gear 119 is equalized to that of the feed-side agitator input gear 116 (see FIG. 12(*a*)).

The inner cylinder 96 is generally in the form of a hollow cylinder along the inner cylinder accommodation chamber 104 of the feed section 101 of the outer cylinder 95, and accommodated in the inner cylinder accommodation chamber 104 coaxially with the feed-side agitator rotating shaft 120, as shown in FIGS. 14(*a*) and 14(*b*). The aforementioned feed-side agitator rotating shaft 120 anteroposteriorly extends in the interior (referred to as the feed chamber 121) of the inner cylinder 96 accommodated in the inner cylinder accommodation chamber 104, and the feed-side agitators 115 are arranged in the feed chamber 121. The inner cylinder 96 is pivotable about the feed-side agitator rotating shaft 120 in sliding contact with the inner circumferential surface of the feed section 101 of the outer cylinder 95.

An inner cylinder communication hole 122 and the inner-cylinder-side opening 125 (see FIG. 13(*b*)) are formed in the inner cylinder 96.

The inner cylinder communication hole 122 is formed on a portion of the circumference of the inner cylinder 96, in the form of a rectangle generally identical in size to the outer cylinder connecting hole 105 as viewed from the center of the pivoting shaft of the inner cylinder 96.

The inner-cylinder-side opening 125, formed on a portion of the circumference of the front half of the inner cylinder 96 as shown in FIG. 13(*b*), includes an inner-cylinder-side feed hole 126 and an inner-cylinder-side return hole 127. The inner-cylinder-side feed hole 126 and the inner-cylinder-side return hole 127 are in the form of circles generally identical in size to the outer-cylinder-side feed hole 109 and the outer-cylinder-side return hole 110 as viewed from the center of the pivoting shaft of the inner cylinder 96. The inner-cylinder-side feed hole 126 and the inner-cylinder-side return hole 127 are adjacent to each other. More specifically, the inner-cylinder-side return hole 127 is adjacent to the rear side (more specifically, a portion slightly obliquely above the rear side) of the inner-cylinder-side feed hole 126.

The inner cylinder 96 is provided with the first and second projections 123 and 124.

The first projection 123 is provided on a portion of the circumference of the anteroposterior center of the inner cylinder 96, more specifically on a position (see FIGS. 14(*a*) and 14(*b*)) deviating from the inner-cylinder-side return hole 127 by about 135□ clockwise in front elevation view, and is generally in the form of a rectangular parallelepiped protruding outward in the radial direction of the inner cylinder 96. The anteroposterior size of the first projection 123 is set slightly smaller than those of the first projection exposing hole 107 of the outer cylinder 95 and the opening/closing main portion engaging hole 86 (see FIG. 10) of the opening/closing member 75 of the cartridge receiving section 68. The peripheral size (along the circumferential surface of the inner cylinder 96) of the first projection 123 is set to about ¼ of the peripheral size (along the circumferential surface of the feed section 101 of the outer cylinder 95) of the first projection exposing hole 107 and slightly smaller than the right-and-left size of the opening/closing main portion engaging hole 86 (see FIG. 10). When the inner cylinder 96 is accommodated in the inner cylinder accommodation chamber 104 of the outer cylinder 95 (see FIGS. 14(*a*) and 14(*b*)), the first projection 123 is exposed through the first projection exposing hole 107 of the outer cylinder 95 so that the distal end thereof protrudes outward in the radial direction of the feed section 101 beyond the outer side surface of the feed section 101.

The second projection 124 includes an upper second projection 128 and a lower second projection 129 identical in size to each other.

The upper second projection 128 is generally in the form of a rectangular parallelepiped protruding outward in the radial direction of the inner cylinder 96 on the outer circumferential surface of the inner cylinder 96, e.g., on a position obliquely under the rear side of the inner-cylinder-side return hole 127 in FIG. 13(*b*).

The lower second projection 129 is formed on the outer circumferential surface of the inner cylinder 96 on a position deviating from the upper second projection 128 by about 50□ clockwise (see FIGS. 14(*a*) and 14(*b*)).

The anteroposterior size of the upper and lower second projections 128 and 129 is set slightly smaller than that of the second projection exposing hole 111 of the outer cylinder 95. Further, the peripheral size (along the circumferential surface of the inner cylinder 96) of the upper and lower second projections 128 and 129 is set to about 1/10 of the peripheral size (along the circumferential surface of the feed section 101 of the outer cylinder 95) of the second projection exposing hole 111. The upper and lower second projections 128 and 129 are respectively formed with shutter support grooves 130 recessed reversely to the direction of opposition in which the upper and lower second projections 128 and 129 are opposed to each other along the circumferential surface of the inner cylinder 96 in generally central portions thereof along the direction of protrusion. When the inner cylinder 96 is accommodated in the inner cylinder accommodation chamber 104 of the outer cylinder 95 (see FIGS. 14(*a*) and 14(*b*)), the upper and lower second projections 128 and 129 are exposed through the second projection exposing hole 111 of the outer cylinder 95 so that the distal ends thereof protrude outward in the radial direction of the feed section 101 beyond the outer side surface of the feed section 101. The shutter support grooves 130 of the upper and lower second projections 128 and 129 are positioned slightly outward beyond the outer side surface of the feed section 101 in the radial direction of the feed section 101 (see FIGS. 14(*a*) and 14(*b*)).

A cartridge outside shutter 131 is mounted on the shutter support grooves 130 of the upper and lower second projections 128 and 129. The cartridge outside shutter 131 is in the form of a thin plate arcuate along the outer peripheral surface of the feed section 101 and anteroposteriorly longitudinal in front elevation view. A peripheral end edge (upper end edge) of the cartridge outside shutter 131 is engaged to the shutter support groove 130 of the upper second projection 128, while the other peripheral end edge (lower end edge) thereof is engaged to the shutter support groove 130 of the lower second projection 129. Thus, the cartridge outside shutter 131 is sandwiched between the upper and lower second projections 128 and 129 on a position slightly outward beyond the outer side surface of the feed section 101 in the radial direction of the feed section 101.

When accommodated in the inner cylinder accommodation chamber 104 of the outer cylinder 95, the inner cylinder 96 is pivotable with respect to the inner circumferential surface of the feed section 101 of the outer cylinder 95 between the cartridge-side shutter closing position (see FIG. 14(*a*)) inhibited from counterclockwise pivot in front elevation view, and the cartridge-side shutter opening position (see FIG. 14(*b*)) inhibited from clockwise pivot.

When the inner cylinder 96 is located on the cartridge-side shutter closing position, the first projection 123 is in contact with the right end edge of the first projection exposing hole 107 while the upper second projection 128 of the second projection 124 is in contact with the upper end edge of the second projection exposing hole 111, as shown in FIG. 14(*a*). A portion of the inner cylinder 96 located downward beyond the inner-cylinder-side opening 125 closes the outer-cylinder-side opening 108 of the outer cylinder 95 from inside in the radial direction of the inner cylinder 96, while the cartridge outside shutter 131 closes the outer-cylinder-side opening 108 from outside in the radial direction of the inner cylinder 96. Further, another portion of the inner cylinder 96 located rightward beyond the inner cylinder communication hole 122 closes the outer cylinder connecting hole 105 of the outer cylinder 95 from inside in the radial direction of the inner cylinder 96. Thus, the storage chamber 102 and the feed chamber 121 are isolated from each other.

When the inner cylinder 96 is located on the cartridge-side shutter opening position, on the other hand, the first projection 123 is in contact with the left end edge of the first projection exposing hole 107 while the lower second projection 129 of the second projection 124 is in contact with the lower end edge of the second projection exposing hole 111, as shown in FIG. 14(*b*). The inner-cylinder-side opening 125 of the inner cylinder 96 and the outer-cylinder-side opening 108 of the outer cylinder 95 are opposed to each other, and the cartridge outside shutter 131 opens the outer-cylinder-side opening 108 from outside in the radial direction of the inner cylinder 96. More specially, when the inner-cylinder-side opening 125 and the outer-cylinder-side opening 108 are opposed to each other, the inner-cylinder-side return hole 127 and the outer-cylinder-side return hole 110 are opposed to each other while the inner-cylinder-side feed hole 126 and the outer-cylinder-side feed hole 109 are also opposed to each other. Thus, the feed chamber 121 of the inner cylinder 96 communicates with the exterior through the inner-cylinder-side opening 125 and the outer-cylinder-side opening 108. Further, the inner cylinder communication hole 122 and the outer cylinder connecting hole 105 are opposed to each other. Thus, the storage chamber 102 of the outer cylinder 95 and the feed chamber 121 of the inner cylinder 96 communicate with each other. When the inner-cylinder-side return hole 127 and the outer-cylinder-side return hole 110 are opposed to each other, a clearance formed between the peripheral edges of the inner-cylinder-side return hole 127 and the outer-cylinder-side return hole 110 in the direction of opposition thereof is sealed with a cartridge sealing member (not shown) of felt, sponge or the like. Similarly, when the inner-cylinder-side feed hole 126 and the outer-cylinder-side feed hole 109 are opposed to each other, a clearance formed between the peripheral edges of the inner-cylinder-side feed hole 126 and the outer-cylinder-side feed hole 109 in the direction of opposition thereof is also sealed with the cartridge sealing member (not shown).

Figure 15:
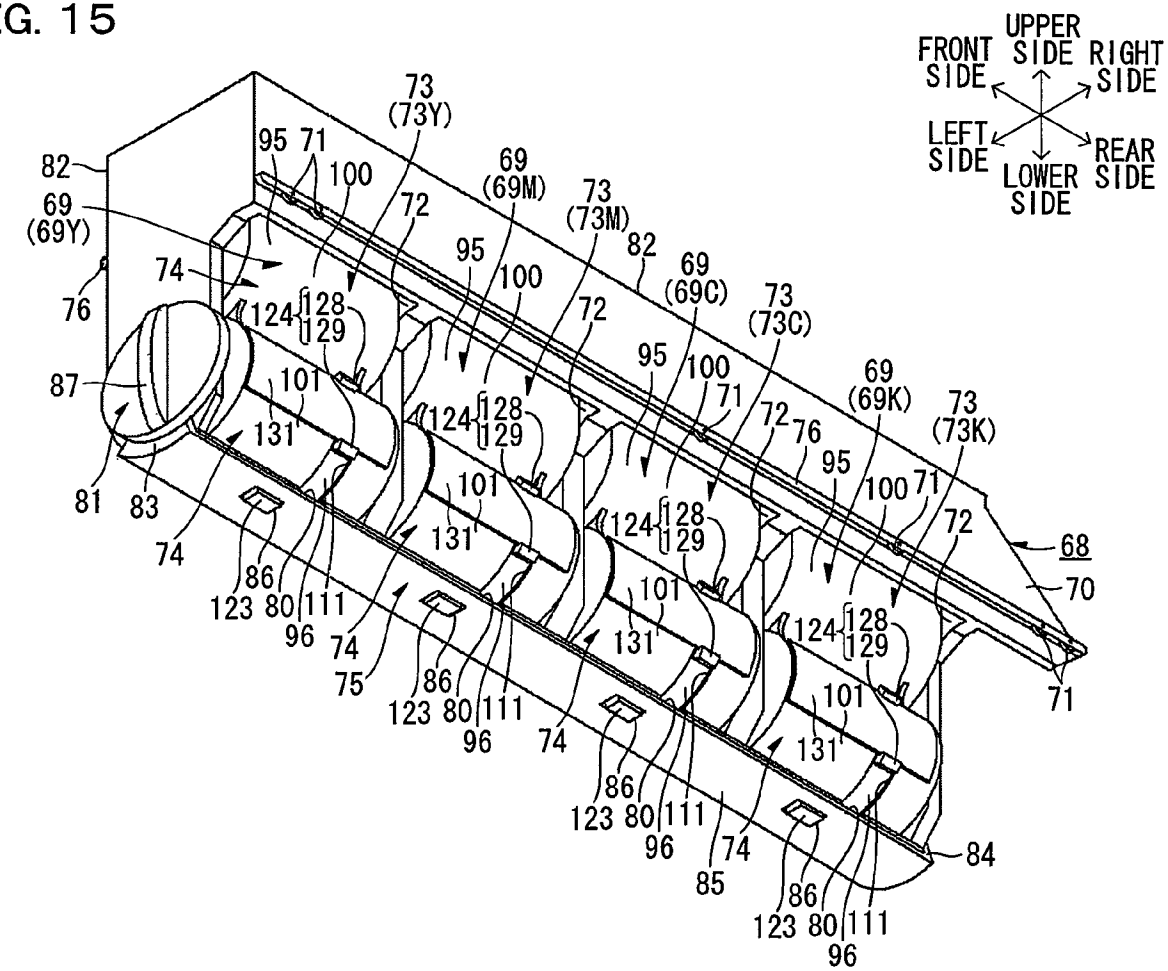
FIG. 15 is a right-side perspective view of the cartridge receiving section accommodating all the toner cartridges, with the inner cylinders located on the cartridge-side shutter closing position.
Figure 16:
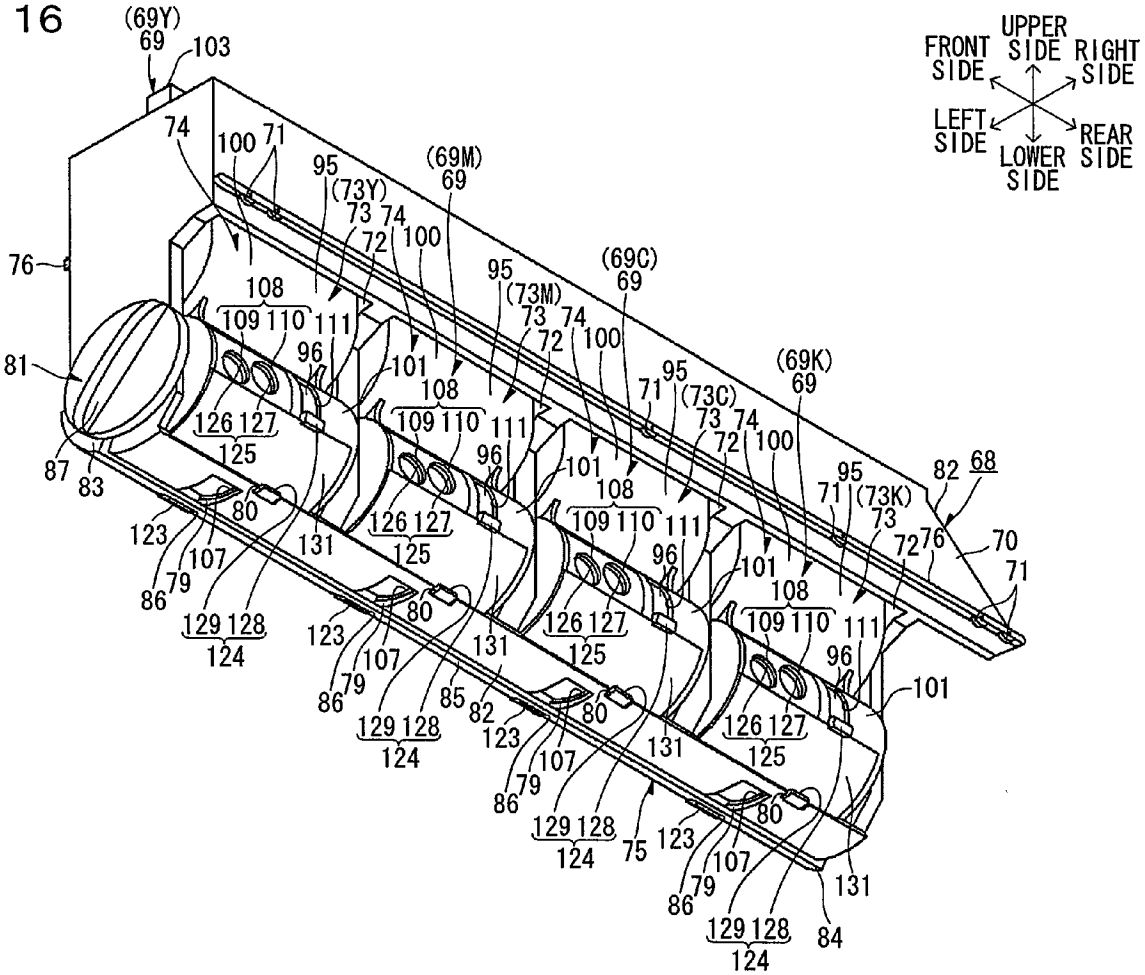
FIG. 16 is a right-side perspective view of FIG. 15, showing the inner cylinders of the toner cartridges located on the cartridge-side shutter opening position.
Figure 17B:
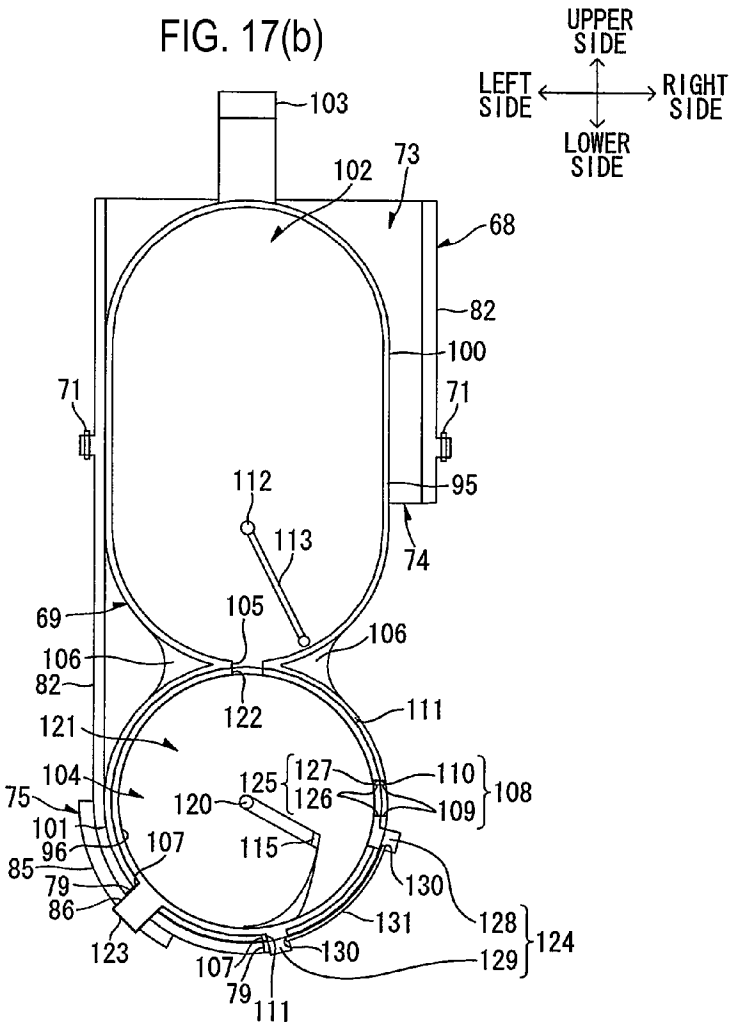
FIGS. 17(*a*) and 17(*b*) are front sectional views of the cartridge receiving section accommodating each toner cartridge, with the inner cylinder located on the cartridge-side shutter closing position and the cartridge-side shutter opening position respectively.
Figure 17A:
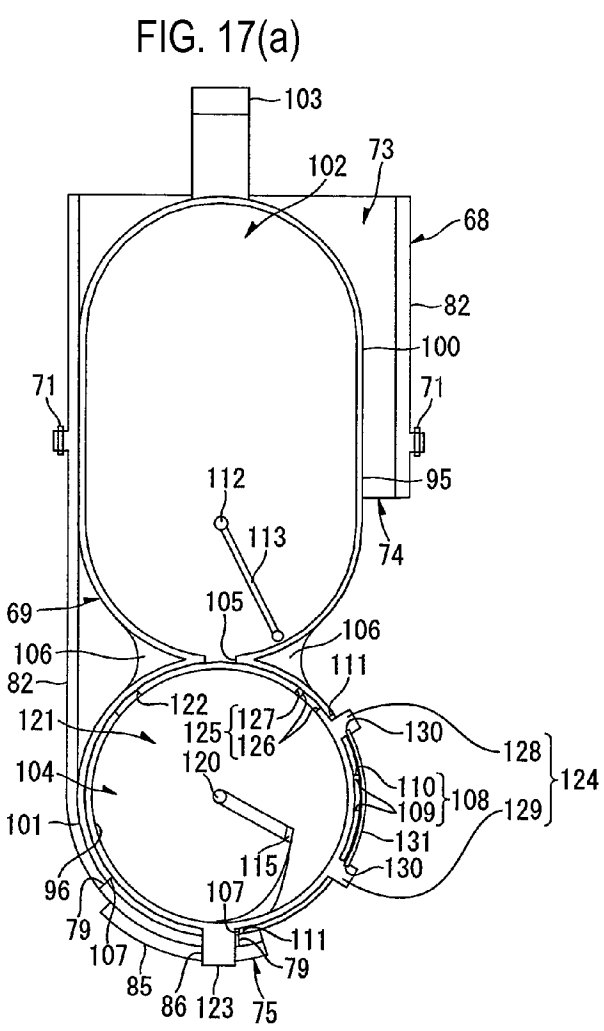

(3-2-3) Attachment/Detachment of Toner Cartridge to/from Cartridge Receiving Section FIG. 15 is a right-side perspective view of the cartridge receiving section accommodating all the toner cartridges, with the inner cylinders of the toner cartridges located on the cartridge-side shutter closing position. FIG. 16 is a right-side perspective view of FIG. 15, showing the inner cylinders of the toner cartridges located on the cartridge-side shutter opening position. FIGS. 17(*a*) and 17(*b*) are front sectional views of the cartridge receiving section accommodating each toner cartridge, with the inner cylinder located on the cartridge-side shutter closing position and the cartridge-side shutter opening position respectively. FIGS. 17(*a*) and 17(*b*) show the first projection, the second projection, the first projection exposing hole, the second projection exposing hole, the inner-cylinder-side opening, the outer-cylinder-side opening and the opening/closing main portion engaging hole on the same plane, for the convenience of illustration.

First, the user grasps the grip 103 of the toner cartridge 69 (see FIG. 13(*a*)) having the inner cylinder 96 located on the cartridge-side shutter closing position. Then, the user mounts from above the toner cartridge 69 in the corresponding receiving chamber 73 (see FIG. 10) of the cartridge receiving section 68 having the operation lever 81 located on the lever closing position while keeping the feed-side agitator output gear 117 on the front side. The receiving chambers 73, corresponding to the colors of the toners similarly to the toner cartridges 69, are hereinafter referred to as yellow, magenta, cyan and black receiving chambers 73Y, 73M, 73C and 73K respectively in this order from the front side, as shown in FIG. 10.

When each toner cartridge 69 is mounted in the corresponding receiving chamber 73, the front end portions (see FIGS. 12(*a*) to 12(*c*)) of the storage-side agitator rotating shaft 112 and the feed-side agitator rotating shaft 120 are received in the attachment/detachment guide groove 77 positioned frontward in the receiving chamber 73, while the rear end portions (see FIGS. 12(*a*) to 12(*c*)) of the storage-side agitator rotating shaft 112 and the feed-side agitator rotating shaft 120 are received in the attachment/detachment guide groove 77 positioned rearward in the receiving chamber 73. Thus, the toner cartridge 69 moves generally downward in the receiving chamber 73 through the front and rear end portions of the storage-side agitator rotating shaft 112 and the feed-side agitator rotating shaft 120 (see FIGS. 12(*a*) to 12(*c*)) guided into the corresponding attachment/detachment guide grooves 77 respectively. When the front and rear end portions of the feed-side agitator rotating shaft 120 (see FIGS. 12(*a*) to 12(*c*)) come into contact with the lower end edge of the corresponding attachment/detachment guide grooves 77 beyond the receiving section positioning projections 78 thereof, each toner cartridge 69 is completely received in the corresponding receiving chamber 73, as shown in FIG. 15. All the toner cartridges 69 received in the corresponding receiving chambers 73 respectively are parallelly arranged along the anteroposterior direction.

At this time, the first projection 123 of each toner cartridge 69 engages with the corresponding opening/closing main portion engaging hole 86 of the opening/closing member 75 of the cartridge receiving section 68 in the corresponding receiving chamber 73. In each receiving chamber 73, further, the feed-side agitator input gear 116 of the toner cartridge 69 meshes with the output transmission gear 99 of the second transmission portion 89 from above while the feed-side agitator output gear 117 meshes with the input transmission gear 94 of the second transmission portion 89 from above, as shown in FIG. 8. When all the toner cartridges 69 are accommodated in the corresponding receiving chambers 73 respectively, the second transmission portions 89 are positioned between the toner cartridges 69 adjacent to each other in the anteroposterior direction.

In the black receiving chamber 73K, the feed-side agitator input gear 116 of the black toner cartridge 69K meshes with the first transmission gear 91 of the first transmission portion 88.

When each toner cartridge 69 is accommodated in the corresponding receiving chamber 73 as shown in FIG. 15, the lower half of the storage section 100 and the feed section 101 are exposed from the receiving-section-side opening 74 in the right side of the toner cartridge 69. The exposed portion of the feed section 101 includes the outer-cylinder-side opening 108, the inner-cylinder-side opening 125, the second projection 124 and the cartridge outside shutter 131, as shown in FIG. 16.

The user can detach each toner cartridge 69 from the cartridge receiving section 68 by grasping the grip 103 (see FIGS. 12(*a*) to 12(*c*)) and moving the toner cartridge 69 accommodated in the corresponding receiving chamber 73 generally upward as shown in FIG. 15, contrarily to the aforementioned procedure.

Figure 18:
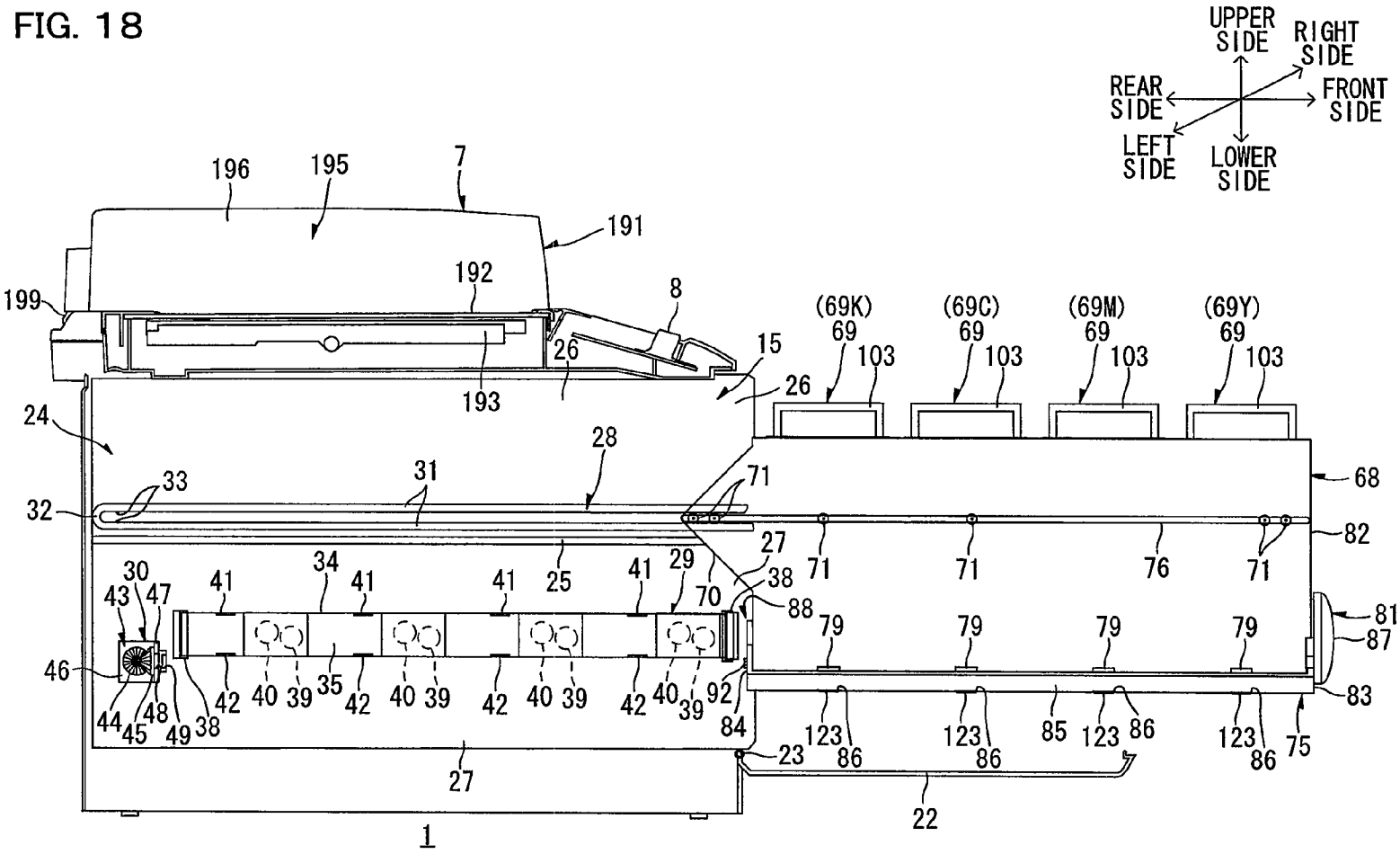
FIG. 18 is a left-side sectional view of FIG. 5, showing a cartridge receiving section drawn out from a main body casing to a position (attachment/detachment position) where all the toner cartridges are exposed frontward from the main body casing.
Figure 19:
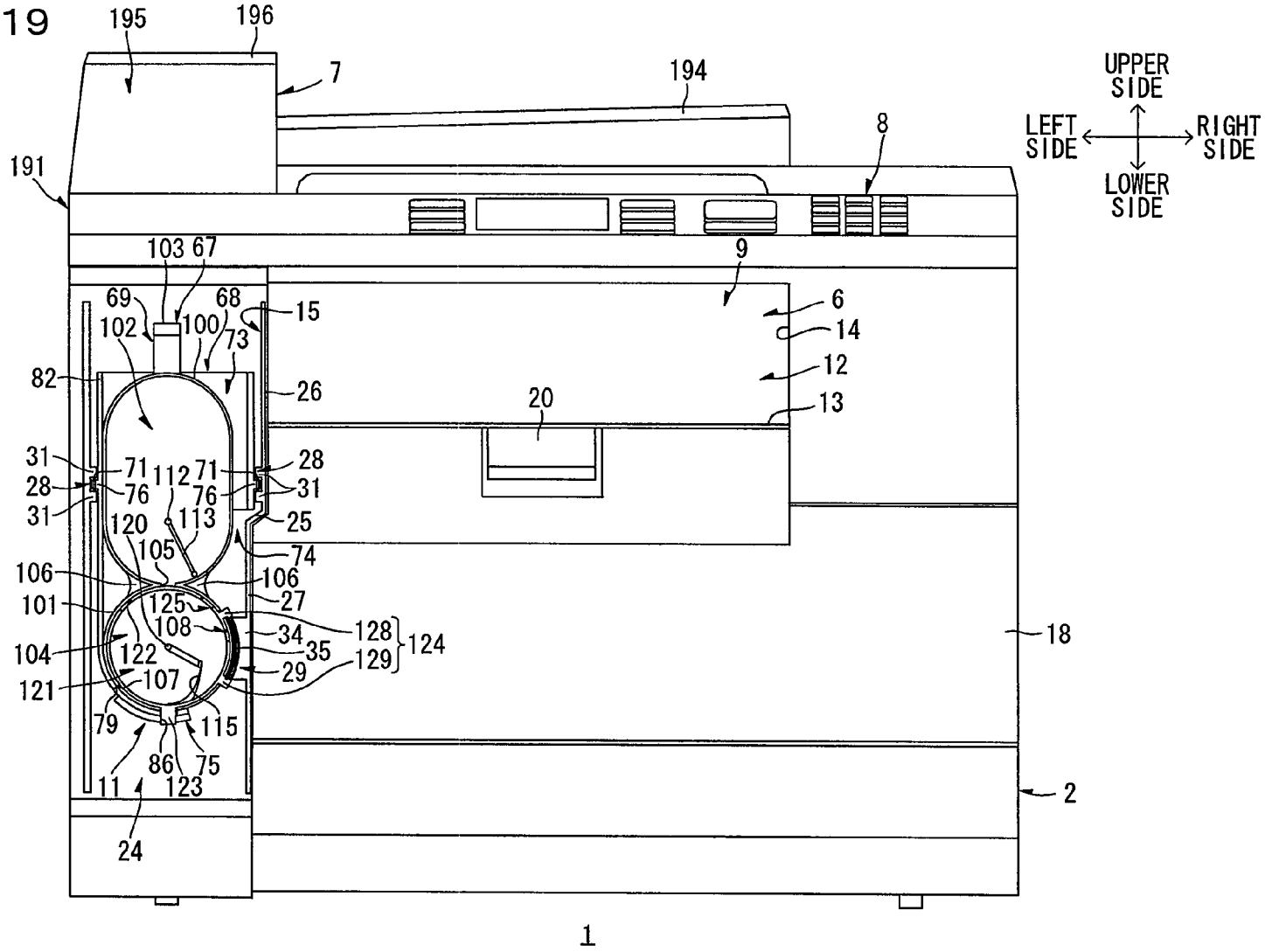
FIG. 19 is a front elevation view of the color laser printer, showing the cartridge receiving section accommodation space, the cartridge receiving section and the toner cartridge in a front sectional view.
Figure 20B:
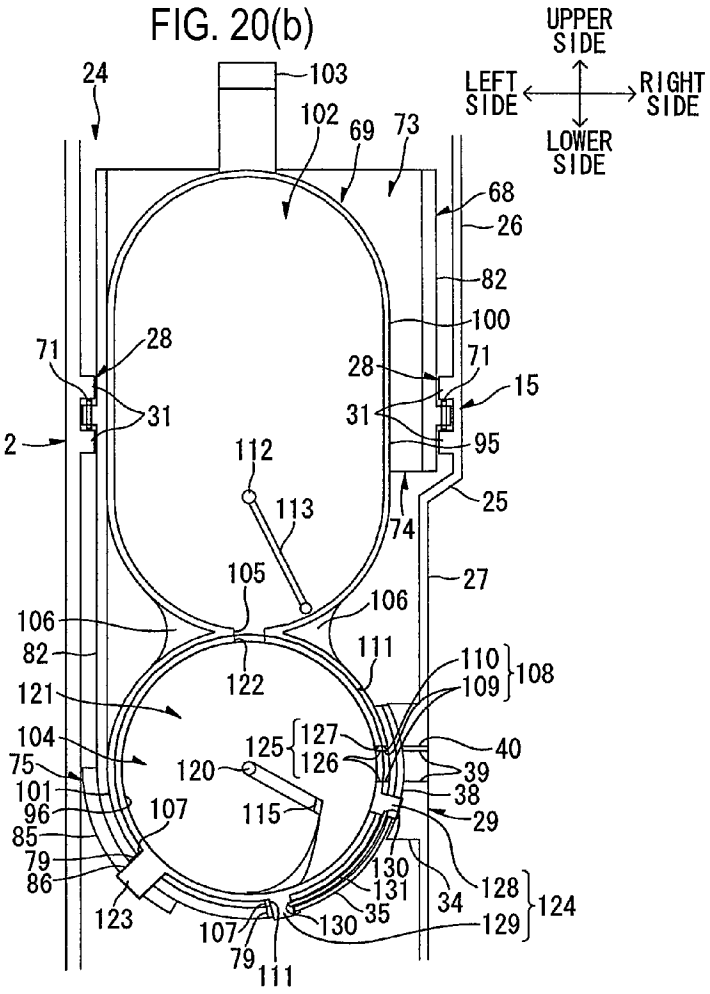
FIGS. 20(*a*) and 20(*b*) excerpt the front sectional view of the cartridge receiving section accommodation space, the cartridge receiving section and the toner cartridge from FIG. 19, with the inner cylinder located on the cartridge-side-shutter closing position and the cartridge-side-shutter opening position respectively.
Figure 20A:
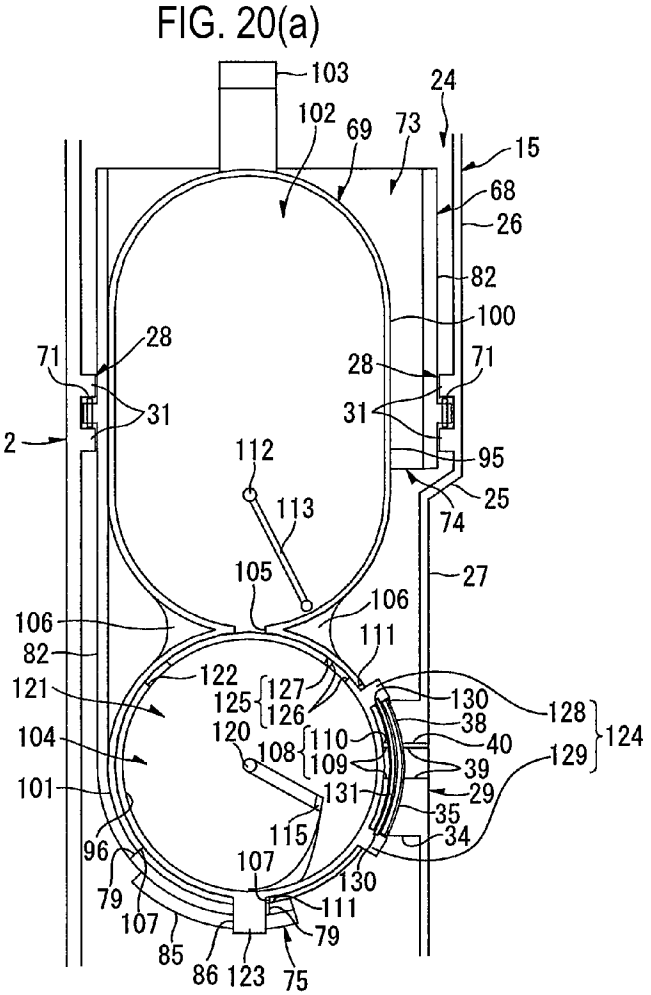

(3-2-4) Attachment/Detachment of Cartridge Receiving Section to/from Main Body Casing FIG. 18 is a left-side sectional view of FIG. 5, showing a cartridge receiving section drawn out from the main body casing 2 to a position (attachment/detachment position) where all the toner cartridges are exposed frontward from the main body casing. FIG. 19 is a front elevation view of the color laser printer, showing the cartridge receiving section accommodation space, the cartridge receiving section and the toner cartridge in a front sectional view. FIGS. 20(*a*) and 20(*b*) excerpt the front sectional view of the cartridge receiving section accommodation space, the cartridge receiving section and the toner cartridge from FIG. 19, with the inner cylinder located on the cartridge-side-shutter closing position and the cartridge-side-shutter opening position respectively. FIGS. 20(*a*) and 20(*b*) show the first projection, the second projection, the first projection exposing hole, the second projection exposing hole, the inner-cylinder-side opening, the outer-cylinder-side opening, the opening/closing main portion engaging hole, the partition-wall-side feed hole and the partition-wall-side return hole on the same plane, for the convenience of illustration.

When the partition-wall-side shutter 35 is located on the partition-wall-side shutter closing position in the main body casing 2 as shown in FIG. 6(*a*), the first cover 22 is opened for opening the cartridge receiving section mounting port 11 as shown in FIG. 4. Then, the cartridge receiving section 68 accommodating all the toner cartridges 69 corresponding to the respective colors is inserted into the cartridge receiving section accommodation space 24 from the front side, as shown in FIG. 18. At this time, the rollers 71 provided on both width-directional sides of the cartridge receiving section 68 are received in the corresponding guide rails 28 of the main body casing 2. More specifically, each roller 71 is sandwiched in the up-and-down direction between the pair of ridges 31 of the corresponding guide rail 28. Thus, the cartridge receiving section 68 slidingly moves rearward in the cartridge receiving section accommodation space 24 through the rollers 71 guided by the corresponding guide rails 28. When the rearmost ones of the rollers 71 provided on the both width-directional sides of the cartridge receiving section 68 come into contact with the inner peripheral surfaces of the rear end portions of the corresponding guide rails 28 beyond the guide rail positioning projections 33 thereof, the cartridge receiving section 68 is completely accommodated in the cartridge receiving section accommodation space 24, as shown in FIG. 4. When the first cover 22 is closed, the cartridge receiving section 68 is completely mounted in the main body casing 2. The anteroposterior position of the cartridge receiving section 68 completely mounted in the main body casing 2 is referred to as a mount position. In this state, the upper end portion of each toner cartridge 69, more specifically the upper end portion of the storage section 100, is located upward beyond the ejection tray 13, as shown in FIG. 7.

When the cartridge receiving section 68 is mounted in the main body casing 2, the connecting projection 92 of the first transmission portion 88 thereof is connected to the connecting hole 49 of the second gear 45 provided on the driving mechanism 30 of the main body casing 2. When the aforementioned agitator driving motor (not shown) is driven in this state, the driving force thereof is transmitted to the first gear 44 of the driving mechanism 30. This driving force is further transmitted to the second gear 45 meshing with the first gear 44, thereby rotating the second gear 45 counterclockwise in rear elevation view. Therefore, the connecting projection 92 connected to the connecting hole 49 of the second gear 45 co-rotates with the second gear 45 counterclockwise in rear elevation view due to the transmitted driving force of the agitator driving motor (not shown). This driving force rotates the first support shaft 90 and the first transmission gear 91 in the same direction, as shown in FIG. 8.

The driving force rotating the first support shaft 90 and the first transmission gear 91 is transmitted to the feed-side agitator input gear 116 of the black toner cartridge 69K meshing with the first transmission gear 91. Thus, the feed-side agitator input gear 116 is rotated clockwise in rear elevation view (counterclockwise in front elevation view), thereby rotating the feed-side agitator rotating shaft 120 provided with the feed-side agitator input gear 116 as well as the feed-side agitators 115 and the feed-side agitator output gear 117 provided on the feed-side agitator rotating shaft 120 clockwise in rear elevation view (counterclockwise in front elevation view). Further, this driving force is transmitted to the storage-side agitator input gear 114 meshing with the intermediate gear 119 via the intermediate gear 119 meshing with the feed-side agitator input gear 116. Thus, the storage-side agitator input gear 114 is rotated clockwise in rear elevation view (counterclockwise in front elevation view), thereby rotating the storage-side agitator rotating shaft 112 provided with the storage-side agitator input gear 114 and the storage-side agitator 113 provided on the storage-side agitator rotating shaft 112 clockwise in rear elevation view (counterclockwise in front elevation view).

This driving force is output from the feed-side agitator output gear 117 of the black toner cartridge 69K and transmitted to the second transmission portion 89, more specifically transmitted to the second support shaft 93 through the input transmission gear 94 meshing with the feed-side agitator output gear 117 in front of the black toner cartridge 69K. Thus, the second support shaft 93 and the output transmission gear 99 are rotated counterclockwise in rear elevation view, similarly to the first support shaft 90 and the first transmission gear 91. In the cyan toner cartridge 69C, the driving force received from the output transmission gear 99 is transmitted to the feed-side agitator input gear 116 meshing with the output transmission gear 99 of the second transmission portion 89, and is further transmitted to the feed-side agitator rotating shaft 120, the feed-side agitator output gear 117, the intermediate gear 119, the storage-side agitator input gear 114 and the storage-side agitator rotating shaft 112, thereby rotating the feed-side agitators 115 and the storage-side agitator 113.

In other words, the driving force rotating the first support shaft 90 in the first transmission portion 88 rotates the feed-side agitator 115 and the storage-side agitator 113 of the black toner cartridge 69K, and is thereafter successively transmitted to the feed-side agitators 115 and the storage-side agitators 113 of the cyan toner cartridge 69C adjacent to the front side of the black toner cartridge 69K, the magenta toner cartridge 69M adjacent to the front side of the cyan toner cartridge 69C and the yellow toner cartridge 69Y adjacent to the front side of the magenta toner cartridge 69M in this order. Thus, the feed-side agitator 115 and the storage-side agitator 113 of each toner cartridge 69 are so rotated as to agitate the toner in the feed chamber 121 and the storage chamber 102 of the toner cartridge 69. When the inner cylinder 96 of each toner cartridge 69 is located on the cartridge-side shutter opening position as shown in FIG. 17(*b*), the inner cylinder communication hole 122 and the outer cylinder connecting hole 105 are opposed to each other, and the storage chamber 102 and the feed chamber 121 communicate with each other, whereby the toner can be fed from the storage chamber 102 into the feed chamber 121 through the storage-side agitator 113 agitating the toner stored in the storage chamber 102 in addition to the own weight of the toner.

When each toner cartridge 69 is accommodated in the corresponding receiving chamber 73 as shown in FIGS. 15 and 16, the operation lever 81 located on the lever closing position is turned clockwise in front elevation view to move to the lever opening position, whereby the opening/closing member 75 also pivots clockwise about a swinging shaft (not shown) along with the movement of the operation lever 81. Further, the first projection 123 of each toner cartridge 69 engaging with the opening/closing main portion engaging hole 86 of the opening/closing member 75 collectively moves in the first projection exposing hole 107 of the outer cylinder 95 in the same direction also along with the opening/closing member 75. Due to this movement of the first projection 123, the inner cylinder 96 provided with the first projection 123 also pivots from the cartridge-side shutter closing position (see FIG. 15) to the cartridge-side shutter opening position (see FIG. 16). Then, the upper and lower second projections 128 and 129 provided on the inner cylinder 96 move in the second projection exposing hole 111 in the same direction, and the lower second projection 129 is engaged to the corresponding receiving section notch 80 of the receiving section casing 82 and the first projection 123 comes into contact with the left end edge of the receiving section penetration hole 79 of the receiving section casing 82 as shown in FIG. 16 when the inner cylinder 96 pivots to the cartridge-side shutter opening position (see FIG. 17(*b*)).

When the cartridge receiving section 68 is mounted in the main body casing 2, the upper and lower second projections 128 and 129 of each toner cartridge 69 accommodated in the cartridge receiving section 68 sandwich in the up-and-down direction the partition-wall-side shutter 35 located on the partition-wall-side shutter closing position in front elevation view, as shown in FIG. 19. More specifically, the aforementioned upper and lower notches 41 and 42 (see FIG. 5) of the partition-wall-side shutter 35 correspond to the toner cartridge 69 of each color such that the upper second projection 128 engages with the foremost upper notch 41 (see FIG. 5) and the lower second projection 129 engages with the foremost lower notch 42 (see FIG. 5) in the yellow toner cartridge 69Y (see FIG. 15), for example. In each of the toner cartridges 69 of the remaining colors, the upper and lower second projections 128 and 129 similarly engage with the corresponding upper and second notches 41 and 42 respectively.

When the cartridge receiving section 68 is mounted in the main body casing 2, the outer-cylinder-side feed hole 109 (see FIG. 13(*b*)) of the outer-cylinder-side opening 108 of each toner cartridge 69 accommodated in the cartridge receiving section 68, is width-directionally opposed to the partition-wall-side feed hole 39 (see FIG. 5) of the partition-wall-side toner passing portion 34 with the partition-wall-side shutter 35 and the cartridge outside shutter 131 interposed therebetween, as shown in FIG. 20(*a*). Similarly, the outer-cylinder-side return hole 110 (see FIG. 13(*b*)) is width-directionally opposed to the partition-wall-side return hole 40 (see FIG. 5) of the partition-wall-side toner passing portion 34 with the partition-wall-side shutter 35 and the cartridge outside shutter 131 interposed therebetween.

More specifically, the partition-wall-side feed hole 39 and the partition-wall-side return hole 40 (see FIG. 5) also correspond to the toner cartridge 69 of each color similarly to the upper and lower notches 41 and 42 such that the outer-cylinder-side feed hole 109 is opposed to the foremost partition-wall-side feed hole 39 (see FIG. 5) and the outer-cylinder-side return hole 110 is opposed to the foremost partition-wall-side return hole 40 (see FIG. 5) in the yellow toner cartridge 69Y (see FIG. 15), for example. Similarly in each of the toner cartridges 69 corresponding to the remaining colors, the outer-cylinder-side feed hole 109 is opposed to the corresponding partition-wall-side feed hole 39 while the outer-cylinder-side return hole 110 is opposed to the partition-wall-side return hole 40 corresponding to the partition-wall-side feed hole 39. Each toner cartridge 69 is opposed to the developing roller 143 of each processing section 62 described later in the width direction (longitudinal direction of the developing roller 143) on the right side surface provided with the outer-cylinder-side feed hole 109 and the outer-cylinder-side return hole 110, as shown in FIG. 7.

When the operation lever 81 (see FIG. 16) located on the lever closing position is moved to the lever opening position in this state as described above, the partition-wall-side shutter 35 sandwiched between the upper and lower second projections 128 and 129 slidingly moves from the partition-wall-side shutter closing position to the partition-wall-side shutter opening position following pivot of the inner cylinder 96 of the toner cartridge 69 from the cartridge-side shutter closing position to the cartridge-side shutter opening position. When the partition-wall-side shutter 35 reaches the partition-wall-side shutter opening position, the outer-cylinder-side feed hole 109 of each toner cartridge 69 and the corresponding partition-wall-side feed hole 39 communicate with each other while the outer-cylinder-side return hole 110 and the corresponding partition-wall-side return hole 40 also communicate with each other, as shown in FIG. 20(*b*). When the driving force of the agitator driving motor (not shown) is so supplied as to rotate the feed-side agitators 115 counterclockwise in front elevation view as described above, therefore, the toner is fed from the feed chamber 121 to the inner-cylinder-side feed hole 126, and transmitted rightward (toward a developer-side feed hole 171 describe later) beyond the partition wall 15 through the outer-cylinder-side feed hole 109 and the partition-wall-side feed hole 39. The feed-side agitator 115 is notched on a portion opposed to the inner-cylinder-side return hole 127, in order to feed no toner to the inner-cylinder-side return hole 127 while in order to feed the toner from the feed chamber 121 to the cylinder-side feed hole 126 during rotation.

When the outer-cylinder-side feed hole 109 communicates with the corresponding partition-wall-side feed hole 39 and the outer-cylinder-side return hole 110 communicates with the corresponding partition-wall-side return hole 40, right-and-left clearances formed between the peripheral edges of the partition-wall-side feed hole 39 and the outer-cylinder-side feed hole 109 and between the peripheral edges of the partition-wall-side feed hole 40 and the outer-cylinder-side return hole 110, are sealed with the aforementioned partition wall sealing member (not shown). Further, the right-and-left clearances formed between the peripheral edges of the inner-cylinder-side feed hole 126 and the outer-cylinder-side feed hole 109 in the direction of opposition and between the peripheral edges of the inner-cylinder-side return hole 127 and the outer-cylinder-side return hole 110, are sealed with the cartridge sealing member (not shown), as described above. Therefore, the toner fed from the feed chamber 121 passes through the inner-cylinder-side feed hole 126, the outer-cylinder-side feed hole 109 and the partition-wall-side feed hole 39 with no intermediate leakage.

Contrarily to the aforementioned procedure, when the first cover 22 is opened as shown in FIG. 4 for moving the operation lever 81 (see FIGS. 14(*a*) and 14(*b*)) to the lever closing position while moving the inner cylinder 96 and the partition-wall-side shutter 35 to the cartridge-side-shutter closing position and the partition-wall-side shutter closing position (see FIG. 20(*a*)) respectively and the cartridge receiving section 68 is drawn out frontward from the mount position, the cartridge receiving section 68 can be detached from the main body casing 2 in a sliding manner. When the rollers 71 provided on the rear end of the cartridge receiving section 68 are located on the front end portion of the corresponding guide rail 28 as shown in FIG. 18, all the toner cartridges 69 are exposed from the main body casing 2. The current anteroposterior position of the cartridge receiving section 68 is referred to as the attachment/detachment position. When the cartridge receiving section 68 is located on the attachment/detachment position, each toner cartridge 69 can be attached/detached to/from the cartridge receiving section 68.

When the cartridge receiving section 68 is further drawn out from the attachment/detachment position and the rollers 71 provided on the rear end of the cartridge receiving section 68 are displaced frontward from the front edges of the corresponding guide rail 28, the cartridge receiving section 68 is completely detached from the main body casing 2.

(3-3) Processing Section

Figure 21:
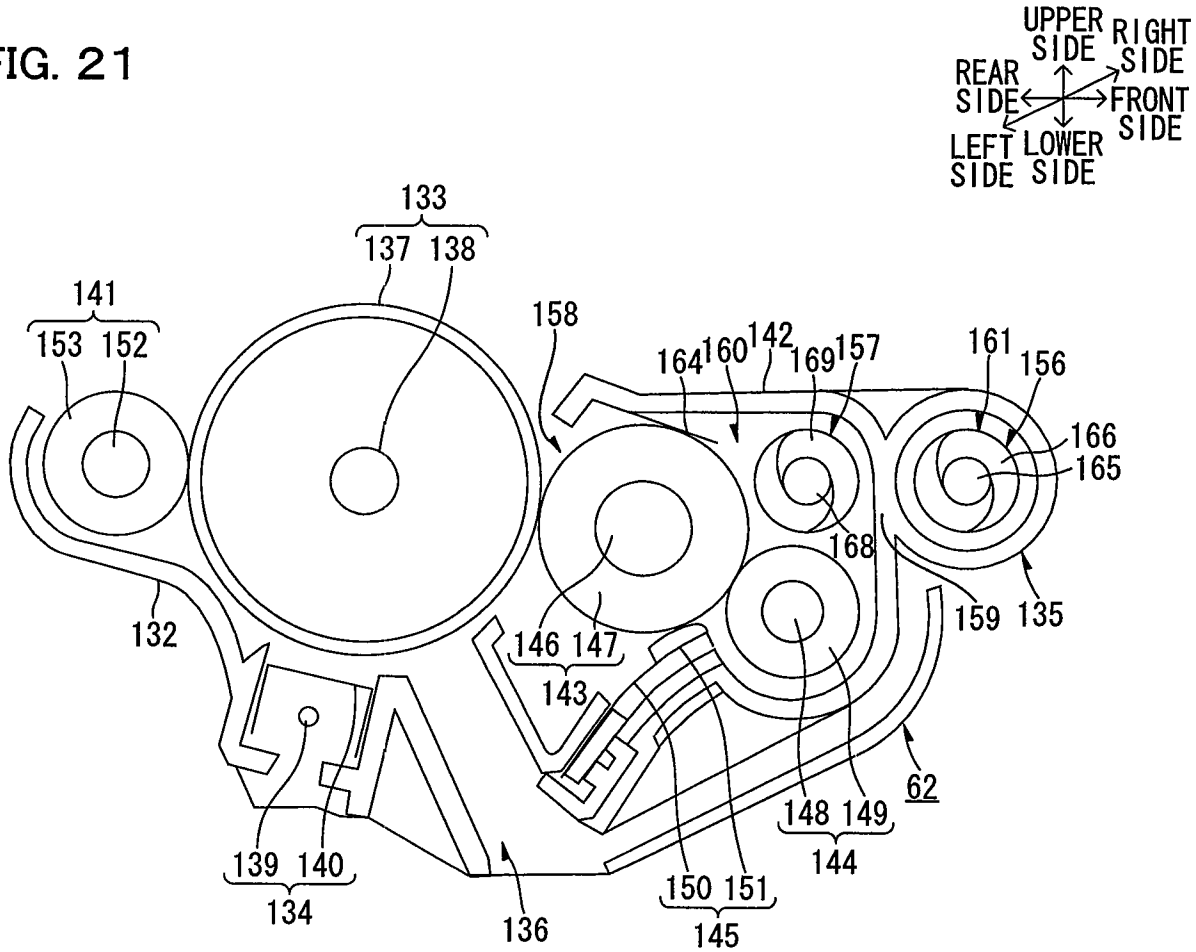
FIG. 21 excerpts each processing section from FIG. 1.
Figure 22:
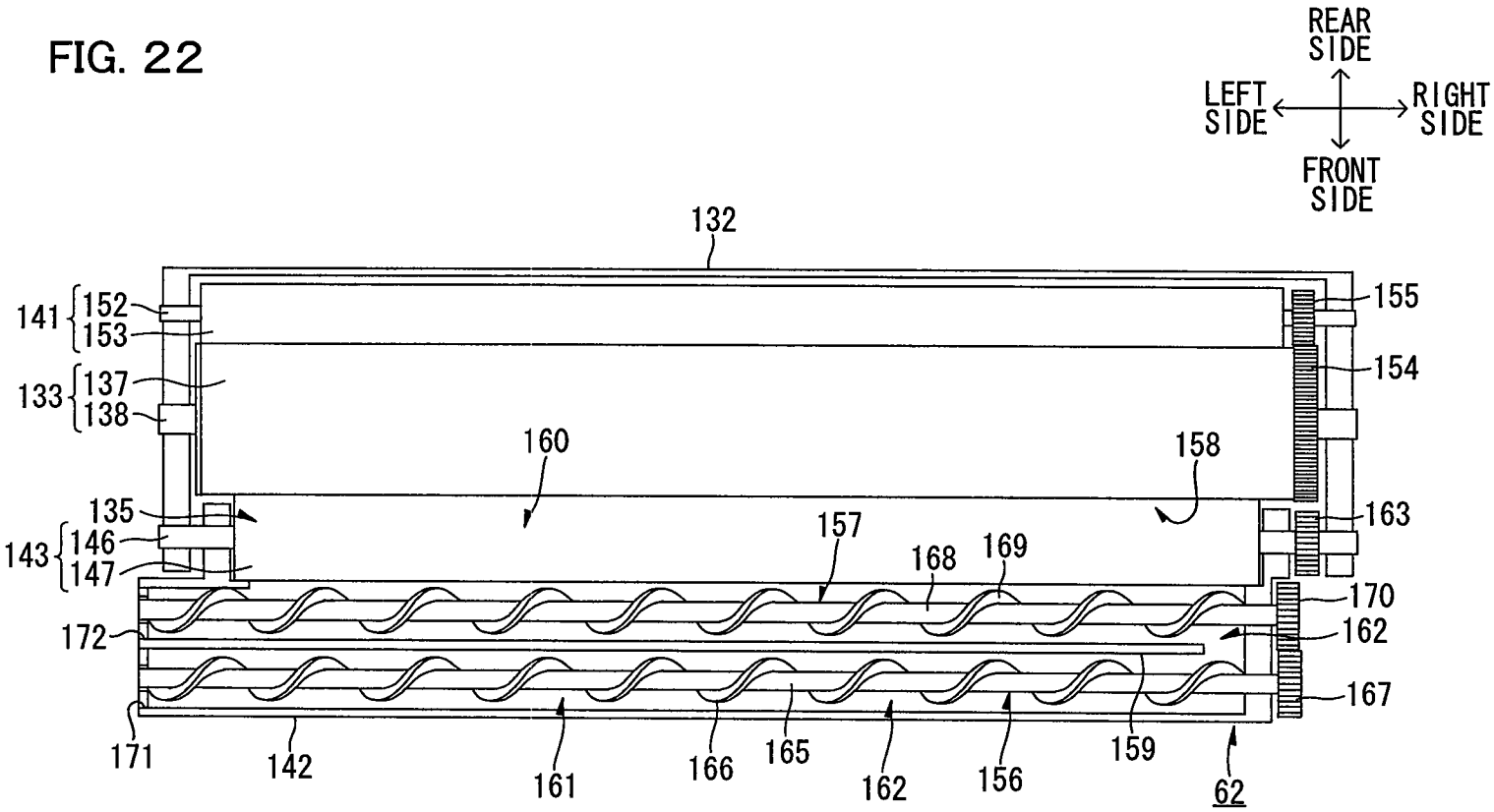
FIG. 22 is a plan view of the processing section in a state where the upper sidewall of a developer casing is removed.
Figure 23:
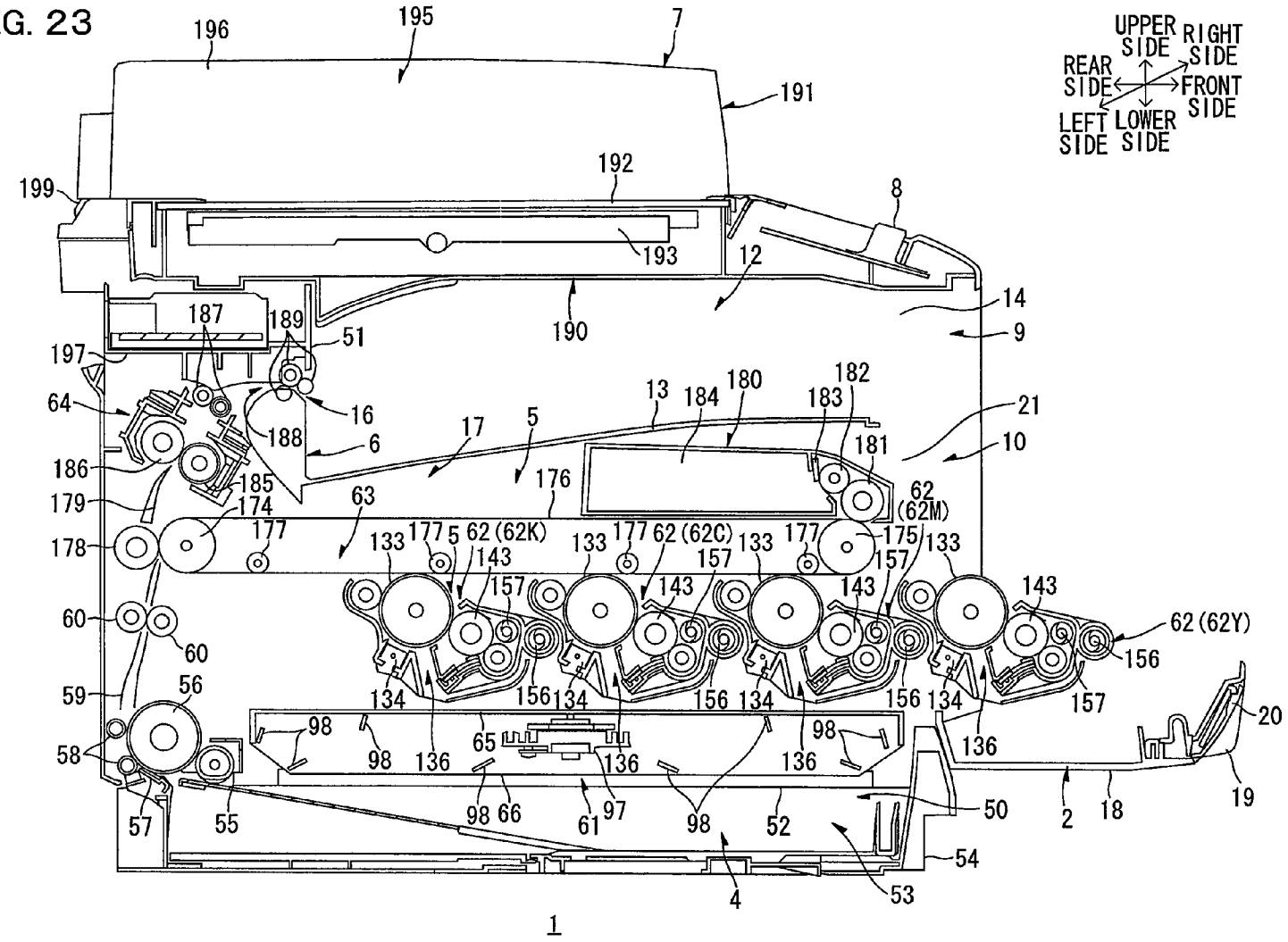
FIG. 23 is a left-side sectional view of FIG. 1, showing an intermediate stage of attaching/detaching the processing sections.

FIG. 21 excerpts each processing section from FIG. 1. FIG. 22 is a plan view of the processing section in a state where the upper sidewall of a developer casing is removed. FIG. 23 is a left-side sectional view of FIG. 1, showing an intermediate stage of attaching/detaching the processing sections.

As shown in FIG. 1, the plurality of processing sections 62 is provided correspondingly to the toners of the respective colors. In other words, the processing sections 62 are formed by four sections, i.e., a yellow processing section 62Y, a magenta processing section 62M, a cyan processing section 62C and a black processing section 62K. The four processing sections 62 are parallelly arranged at intervals from the front side toward the rear side. More specifically, the yellow, magenta, cyan and black processing sections 62Y, 62M, 62C and 62K are arranged from the front side in this order. The four processing sections 62 are connected together with connecting members (not shown), and accommodated in the process accommodation space 17 of the main body casing 2. When the second cover 18 of the main body casing 2 is opened to open the processing section mounting port 10 (see FIG. 3) and thereafter the four processing sections 62 are anteroposteriorly moved, the four processing sections 62 are together slidably attached/detached to/from the main body casing 2, as shown in FIG. 23.

Each processing section 62 includes a process casing 132, the photosensitive drum 133, a scorotron charger 134, a cleaning roller 141 and a developing section 135, as shown in FIG. 21.

The process casing 132 is in the form of a bottomed frame member generally U-shaped in left-side sectional view and width-directionally longitudinal, and provided on the lower end portion thereof with an irradiation window 136 passing through the lower sidewall of the process casing 132 in the thickness direction. The irradiation window 136 is generally in the form of a rectangle width-directionally longitudinal in bottom-side elevation view.

The photosensitive drum 133 includes a drum body 137 and a drum rotation shaft 138. The drum body 137 has a hollow cylindrical shape and is formed by a positively chargeable photosensitive layer with an outermost layer of polycarbonate or the like. The drum rotation shaft 138 extends along the rotating shaft of the drum body 137 at the center of this rotating shaft. The drum rotation shaft 138 is unrotatably supported on both width-directional sidewalls of the process casing 132. The drum body 137 is rotatable with respect to the drum rotation shaft 138, and the upper half thereof is exposed upward from the upper end edge of the process casing 132. As shown in FIG. 22, a gear portion (drum gear portion 154) is provided on the right end portion of the drum body 137. The driving force of a process driving motor (not shown) of the main body casing 2 is transmitted through the drum gear portion 154 thereby to rotationally drive the drum body 137 counterclockwise in left-side elevation view, as shown in FIG. 21.

The scorotron charger 134 is a positively chargeable scorotron charger including a wire 139 and a grid 140 for generating corona discharge through application of a charging bias. This scorotron charger 134 is opposed to the photosensitive drum 133 from under the same at an interval, so as not to come into contact with the photosensitive drum 133.

The cleaning roller 141 includes a cleaning roller shaft 152 of a metal and a cleaning foaming roller 153 of a conductive foamed material covering the cleaning roller shaft 152. The cleaning roller shaft 152 is rotatably supported on the both width-directional sidewalls of the process casing 132 at the back of the photosensitive drum 133. As shown in FIG. 22, a gear portion (cleaning gear portion 155) meshing with the drum gear portion 154 is provided on the right end portion of the cleaning roller shaft 152. The cleaning foaming roller 153 is so arranged as to come into contact with the photosensitive drum 133 from behind. On this contact position, the cleaning foaming roller 153 is rotated along with the cleaning roller shaft 152 in the direction (clockwise) opposite to the rotational direction of the photosensitive drum 133 as shown in FIG. 21, due to the driving force of the aforementioned process driving motor (not shown) transmitted thereto through the drum gear portion 154 and the cleaning gear portion 155 as shown in FIG. 22. In image formation, a cleaning bias is applied to the cleaning roller 141 from a high-pressure substrate (not shown) provided in the main body casing 2.

The developing section 135 is arranged in front of the photosensitive drum 133, and includes the developer casing 142 as well as the developing roller 143, a feed roller 144, a layer-thickness regulating member 145, a feed auger 156, a return auger 157 and a developer seal 164 arranged in the developer casing 142.

The developer casing 142 is in the form of a box generally triangular in left-side elevation view and width-directionally longitudinal. A rectangular developer connecting hole 158 width-directionally longitudinal in rear elevation view is formed on the rear end portion of the developer casing 142. A developer partition wall 159 is formed in the developer casing 142, and divides the interior of the developer casing 142 into a developing chamber 160 and a toner feed chamber 161. The toner feed chamber 161 is positioned on the front end portion of the developer casing 142, and defined generally in the form of a circle in left-side elevation view. The front end portion of the developer casing 142 is in the form of a hollow cylinder corresponding to the left-side sectional shape of the toner feed chamber 161. The developing chamber 160 is positioned on the rear side of the toner feed chamber 161 with the developer partition wall 159 interposed, and defined generally in the form of a trapezoid in right-side sectional view. As shown in FIG. 22, the developer partition wall 159 is formed on the right end portion thereof with a toner connecting hole 162 passing through the developer partition wall 159 in the thickness direction, and the developing chamber 160 and the toner feed chamber 161 communicate with each other through the toner connecting hole 162. The developing roller 143, the feed roller 144, the layer-thickness regulating member 145, the return auger 157 and the developer seal 164 are arranged in the developing chamber 160 while the feed auger 156 is arranged in the toner feed chamber 161, as shown in FIG. 21.

The developing roller 143 is arranged on a rear portion of the developing chamber 160, and the rear end portion thereof is exposed rearward through the developer connecting hole 158 and brought into pressure contact with the photosensitive drum 133 from the front side. The developing roller 143 is formed by covering a developing roller rotation shaft 146 of a metal with a rubber roller 147 of an elastic member prepared from a conductive rubber material or the like. The developing roller rotation shaft 146 is rotatably supported on both width-directional sidewalls of the developer casing 142, and provided with a gear portion (developer gear portion 163) on the right end portion thereof, as shown in FIG. 22. The driving force of the aforementioned process driving motor (not shown) is transmitted to the developer gear portion 163 to rotate the developing roller 143 in the direction (clockwise) opposite to the rotational direction of the photosensitive drum 133, as shown in FIG. 21. In image formation, a developing bias is applied to the developing roller 143 from the high-pressure substrate (not shown) provided in the main body casing 2.

The feed roller 144 is opposed to the developing roller 143 obliquely from under the front side, and brought into pressure contact with the developing roller 143. This feed roller 144 is formed by covering a feed roller rotation shaft 148 of a metal with a sponge roller 149 formed by a conductive sponge member. The feed roller rotation shaft 148 is rotatably supported on the both width-directional sidewalls of the developer casing 142, and a gear portion (not shown: feed gear portion) is provided on the right end portion thereof. The driving force of the aforementioned process driving motor (not shown) is transmitted to this feed gear portion (not shown) to rotate the feed roller 144 in the same direction (clockwise) as the rotational direction of the developing roller 143.

The layer-thickness regulating member 145 includes a blade body 150 and a pressuring portion 151. The blade body 150, having a proximal edge supported on the rear end portion of the lower end portion of the developer casing 142, is formed by a leaf spring member of a metal. The pressuring portion 151, provided on the distal end of the blade body 150, is prepared from insulating silicone rubber to be generally rectangular in sectional view. In the layer-thickness regulating member 145, the pressuring portion 151 is brought into pressure contact with the surface of the developing roller 143 at the back of the feed roller 144, due to the elastic force of the blade body 150.

The feed auger 156 integrally includes a feed-side rotation shaft 165 longitudinal in the width direction and a feed-side transport portion 166, as shown in FIG. 22. The feed-side rotation shaft 165 is rotatably supported on the both width-directional sidewalls of the developer casing 142. The feed-side transport portion 166 is spirally formed on the outer circumferential surface of the feed-side rotation shaft 165 along the axial direction thereof. A gear portion (feed auger gear portion 167) is provided on the right end portion of the feed-side rotation shaft 165, so that the driving force of the process driving motor (not shown) of the main body casing 2 is transmitted through this feed auger gear portion 167. Thus, the feed auger 156 is rotationally driven in the toner feed chamber 161 clockwise in left-side elevation view, as shown in FIG. 21. The developer-side feed hole 171 is formed on a portion of the left sidewall of the developer casing 142 opposed to the feed auger 156, for making the interior of the toner feed chamber 161 communicate with the exterior, as shown in FIG. 22. When the processing section 62 is mounted in the main body casing 2, the developer-side feed hole 171 is opposed to and communicates with the partition-wall-side feed hole 39 (see FIG. 5) corresponding to each toner.

The return auger 157 is arranged above the feed roller 144 at an interval in the developing chamber 160 as shown in FIG. 21, and integrally includes a return-side rotation shaft 168 longitudinal in the width direction and a return-side transport portion 169, as shown in FIG. 22. The return-side rotation shaft 168 is rotatably supported on the both width-directional sidewalls of the developer casing 142. The return-side transport portion 169 is spirally formed on the outer circumferential surface of the return-side rotation shaft 168 along the axial direction thereof. The spiral directions of the return-side transport portion 169 and the feed-side transport portion 166 are equalized to each other. A gear portion (return auger gear portion 170) meshing with the feed auger gear portion 167 is provided on the right end portion of the return-side rotation shaft 168. The driving force of the process driving motor (not shown) of the main body casing 2 is transmitted to the return auger 157 through the feed auger gear portion 167 and the return auger gear portion 170, thereby rotationally driving the return auger 157 counterclockwise in the developing chamber 160, as shown in FIG. 21. A developer-side return hole 172 is formed on a portion of the left sidewall of the developer casing 142 opposed to the return auger 157, for making the interior of the developing chamber 160 communicate with the exterior, as shown in FIG. 22. When the processing section 62 is mounted in the main body casing 2, the developer-side return hole 172 is opposed to and communicates with the partition-wall-side return hole 40 (see FIG. 5) corresponding to each toner.

In image formation, the toner accommodated in each toner cartridge 69 having the inner cylinder 96 located on the cartridge-side shutter opening position, is agitated by the feed-side agitator 115 in the feed chamber 121, as described above and as shown in FIG. 20(*b*). Then, the toner is fed through the inner-cylinder-side feed hole 126 to pass through the outer-cylinder-side feed hole 109, the partition-wall-side feed hole 39 and the developer-side feed hole 171 (see FIG. 22) and discharged into the toner feed chamber 161, as shown in FIG. 22.

The toner discharged into the toner feed chamber 161 is transported rightward in the toner feed chamber 161 by the feed-side transport portion 166 of the rotationally driven feed auger 156. This toner is transported into the developing chamber 160 and fed to the right end portion of the return auger 157 through the toner connecting hole 162 on the right end portion of the toner feed chamber 161. The toner fed to the right end portion of the return auger 157 is transported leftward by the return-side transport portion 169 of the rotationally driven return auger 157, and fed to the feed roller 144 (see FIG. 21) arranged under the return auger 157.

The toner reaching the developer-side return hole 172 without being fed to the feed roller 144 passes through the partition-wall-side return hole 40 and the outer-cylinder-side return hole 110 and thereafter enters the inner-cylinder-side return hole 127, to be collected in the feed chamber 121 of the corresponding toner cartridge 69, as shown in FIGS. 20(*a*) and 20(*b*). The toner reaching the developer-side return hole 172 is that transported leftward by the return-side transport portion 169 due to the aforementioned circulation of the toner, or that having been retained in the developing chamber 160 and transported leftward by the return-side transport portion 169 to reach the developer-side return hole 172.

The toner fed to the feed roller 144 is then fed to the developing roller 143 due to the rotation of the feed roller 144, as shown in FIG. 21. At this time, the toner is triboelectrically positively charged between the feed roller 144 and the developer roller 143 to which the developing bias is applied. The triboelectrically charged toner enters the space between the pressuring portion 151 of the layer-thickness regulating member 145 and the rubber roller 147 of the developing roller 143 following the rotation of the developing roller 143 to form a thin layer of a constant thickness, which in turn is carried on the rubber roller 147 of the developing roller 143.

On the other hand, the scorotron charger 134 generates corona discharge through application of the charging bias, to uniformly positively charge the surface of the drum body 137 of the photosensitive drum 133. The surface of the drum body 137, uniformly positively charged by the scorotron charger 134 following the rotation thereof, is thereafter exposed by high-speed scanning of a laser beam emitted from the corresponding exit window (not shown) of the scanner unit 61 (see FIG. 1) and received through the irradiation window 136, thereby forming an electrostatic latent image of each color corresponding to the image to be formed on each sheet 3.

Upon further rotation of the drum body 137, the positively charged toner carried on the surface of the developing roller 143 is fed to the electrostatic latent image formed on the surface of the drum body 137 when facing and coming into contact with the photosensitive drum 133 due to the rotation of the developing roller 143. Thus, the electrostatic latent image formed on the drum body 137 is visualized, and a toner image (developing agent image) resulting from reversal development is carried on the surface of the drum body 137 correspondingly to each color.

The developer seal 164 is in the form of a film longitudinal in the width direction and generally rectangular in plan view, and the upper end portion thereof is mounted on the upper sidewall of the developer casing 142. The developer seal 164 is uniformly in sliding contact with the developing roller 143 from above along the axial direction thereof, and prevents the toner from leaking through the space between the upper sidewall of the developer casing 142 and the developing roller 143.

The developing roller 143 collects the residual toner remaining on the surface of the photosensitive drum 133 after primary transfer described later. Further, the cleaning foaming roller 153 collects sheet dust coming from the sheet 3 and adhering onto the photosensitive drum 133 after the primary transfer.

(3-4) Transferring Section

As shown in FIG. 1, the transferring section 63 is arranged above the processing sections 62 along the anteroposterior direction in the process accommodation space 17 of the main body casing 2. This transferring section 63 includes a driving roller 174, a driven roller 175, the intermediate transfer belt 176, primary transfer rollers 177, the secondary transfer roller 178, a relay path 179 and a cleaning section 180.

The driving roller 174 is arranged obliquely above the rear side of the photosensitive drum 133 of the black processing section 62K. In image formation, the driving roller 174 is rotationally driven in the direction (clockwise in FIG. 1) opposite to the rotational direction of the photosensitive drums 133.

The driven roller 175 is arranged obliquely above the front side of the photosensitive drum 133 of the yellow processing section 62Y, to be anteroposteriorly opposed to the driving roller 174. This driven roller 175 is driven and rotated in the same direction (clockwise in FIG. 1) as the rotational direction of the driving roller 174 upon the rotation of the driving roller 174.

The intermediate transfer belt 176 is an endless belt of resin such as conductive polycarbonate or polyimide in which conductive particles of carbon or the like are dispersed. This intermediate transfer belt 176 is wound around the driving roller 174 and the driven roller 175, and so arranged that the outer contact surface thereof oppositely comes into contact with all the photosensitive drums 133 of the processing sections 62.

The driving roller 174 drives the driven roller 175, and the intermediate transfer belt 176 circumferentially travels between the driving roller 174 and the driven roller 175 clockwise in FIG. 1.

Inside the intermediate transfer belt 176 wound around the driving roller 174 and the driven roller 175, each primary transfer roller 177 is opposed to the photosensitive drum 133 of each processing section 62 to sandwich the intermediate transfer belt 176 between the same and the photosensitive drum 133. This primary transfer roller 177 is formed by covering a roller rotating shaft of a metal with a rubber roller of an elastic member such as a conductive rubber material. The roller rotating shaft of the primary transfer roller 177 extends along the width direction and is rotatably supported on the main body casing 2, and a primary transferring bias is applied to the primary transfer roller 177 in primary transfer described later. The primary transfer roller 177 rotates in the same direction (clockwise in FIG. 1) as the direction of the circumferential travel of the intermediate transfer belt 176 on the position (primary transfer position) in opposing contact with the intermediate transfer belt 176.

The secondary transfer roller 178 is opposed to the rear portion of the driving roller 174 to sandwich the intermediate transfer belt 176 between the same and the driving roller 174. The roller rotating shaft of the secondary transfer roller 178 extends along the width direction and is rotatably supported on the main body casing 2, and a secondary transferring bias is applied to the secondary transfer roller 178 in secondary transfer. The secondary transfer roller 178 rotates in the direction (counterclockwise in FIG. 1) opposite to the direction of the circumferential travel of the intermediate transfer belt 176 on the position (secondary transfer position) in opposing contact with the intermediate transfer belt 176.

The relay path 179 is so formed as to extend generally upward from the aforementioned secondary transfer position toward the fixing section 64.

The intermediate transfer belt 176 circumferentially traveling around the driving roller 174 and the driven roller 175 sequentially passes through the contact positions (primary transfer positions) between the same and the photosensitive drums 133 of the processing sections 62 from the front side toward the rear side. In the process of this passage, the toner images corresponding to the respective colors and carried on the photosensitive drums 133 of the processing sections 62 are sequentially transferred to the intermediate transfer belt 176 through the primary transferring biases applied to the primary transfer rollers 177 respectively, so that a color image is formed on the intermediate transfer belt 176.

That is, when the yellow toner image carried on the surface of the photosensitive drum 133 of the yellow processing section 62Y is transferred to the intermediate transfer belt 176, for example, the magenta toner image carried on the surface of the photosensitive drum 133 of the magenta processing section 62M is thereafter transferred to the intermediate transfer belt 176, to be superposed on the already transferred yellow toner image. Similarly, the cyan and black toner images carried on the surfaces of the photosensitive drums 133 of the cyan and black processing sections 62C and 62K are subsequently transferred to the intermediate transfer belt 176 to be superposed on the yellow and magenta toner images, so that the color image is formed on the intermediate transfer belt 176.

The color image formed on the intermediate transfer belt 176 is collectively transferred to each sheet 3 transported from the sheet feeding section 4 to the secondary transfer position through the secondary transferring bias applied to the secondary transfer roller 178 when the intermediate transfer belt 176 passes through the contact position (secondary transfer position) between the same and the secondary transfer roller 178. The sheet 3 having the color image transferred thereto is transported to the fixing section 64 along the relay path 179.

The cleaning section 180 is arranged above the intermediate transfer belt 176, and includes a primary cleaning roller 181, a secondary cleaning roller 182, a scraping blade 183 and a toner storage section 184.

The toners adhering to the surface of the intermediate transfer belt 176 in the aforementioned transfer operation are first transferred from the surface of the intermediate transfer belt 176 to the primary cleaning roller 181 in the cleaning section 180 through a primary cleaning bias. The toners transferred to the primary cleaning roller 181 are then transferred to the secondary cleaning roller 182 through a secondary cleaning bias. Thereafter the toners transferred to the secondary cleaning roller 182 are scraped off by the scraping blade 183 to fall from the secondary cleaning roller 182, and stored in the toner storage section 184.

(3-5) Fixing Section

The fixing section 64 is arranged above the aforementioned secondary transfer position, and includes a heating roller 185 and a pressure roller 186 pressing the heating roller 185. The color image transferred to the sheet 3 is heated and pressed in the fixing section 64 when the sheet 3 passes between the heating roller 185 and the pressure roller 186, to be thermally fixed to the sheet 3.

(4) Sheet Ejecting Section

The sheet ejecting section 6 includes a pair of transport rollers 187, a sheet ejecting transport path 188, sheet ejecting rollers 189 and the aforementioned ejection tray 13. The pair of transport rollers 187 are so arranged as to come into contact with each other on a position obliquely above the front sides of the heating roller 185 and the pressure roller 186. The sheet ejecting transport path 188 is so formed as to generally horizontally extend frontward from the contact position between the pair of transport rollers 187 toward the ejection hole 16 of the ejection wall 51. The sheet ejecting rollers 189 include three rollers so arranged that two of these rollers are in contact with the remaining roller. This sheet ejecting rollers 189 are arranged in front of the sheet ejecting transport path 188 so that one of the rollers is exposed through the ejection hole 16 into the sheet ejection space 12.

Each sheet 3 having the color image fixed thereon in the fixing section 64 is transported by the transport rollers 187 along the sheet ejecting transport path 188 in the sheet ejecting section 6, and ejected onto the ejection tray 13 by the sheet ejecting rollers 189 through the ejection hole 16.

(5) Scanning Unit (5-1) General Structure of Scanning Unit

The scanning unit 7 includes a document board 190 connected to the upper sidewall of the main body casing 2 and a cover 191 supported on the document board 190 in an openable/closable manner.

The document board 190 is in the form of a thick plate rectangular in plan view, and a glass surface 192 for receiving a document is formed on the upper surface thereof.

The glass surface 192 is formed by embedding a glass plate in the document board 190 so that the upper surface of the document board 190 is flattened. This glass surface 192 is in the form of a rectangle similar to the document board 190 in plan view.

The document board 190 is provided therein with a CCD sensor 193 for reading the document and a scanning/driving motor (not shown) for driving the CCD sensor 193 to scan the document in a state of being opposed to the glass surface 192.

The CCD sensor 193, movably supported in the right-and-left direction inside (under) the glass surface 192, is normally set on standby on the left end of the glass surface 192, and driven by a scanning driving motor (not shown) in ordinary document reading to scan the document from the left side toward the right side in the state of being opposed to the glass surface 192.

The cover 191 for pressing a document is in the form of a rectangular thin plate similar to the document board 190 in plan view, and provided with an ADF (auto document feeder) device 195 for automatically reading the document on the left upper end portion thereof, as shown in FIG. 2. This ADF device 195 includes a casing 196, a document transport roller (not shown), a document transportation driving motor (not shown) and a document sensor (not shown). The casing 196 is in the form of an anteroposteriorly longitudinal box containing the document transport roller (not shown) and the document transportation driving motor (not shown), and is provided with a standby sheet tray 194 on the up-and-down center of the right sidewall thereof. The standby sheet tray 194 is in the form of a thin plate generally sectorial in plan view and has a left end portion supported by the ADF device 195 and a right end portion extending rightward, and documents can be set on the upper side surface thereof in a stacked manner.

A document inlet (not shown) for introducing each document into the casing 196 is formed on the right sidewall of the casing 196 above the standby sheet tray 194, while a document outlet (not shown) for ejecting the document from the casing 196 is formed under the standby sheet tray 194. The document inlet (not shown) and the document outlet (not shown) are in the form of anteroposteriorly longitudinal rectangles.

The rear end portion of the cover 191 is supported on the rear end portion of the document board 190 in a swingable manner through a hinge 199, as shown in FIG. 1.

The front end portion of the cover 191 swings in the up-and-down direction about the hinge 199 provided on the rear end portion thereof. The glass surface 192 of the document board 190 is exposed when the user raises the front end portion of the cover 191, and covered when the user lowers the front end portion of the cover 191. Thus, the cover 191 covers the glass surface 192 of the document board 190 in an openable/closable manner.

(5-2) Ordinary Document Reading in Scanning Unit

In this scanning unit 7, the user raises the front end portion of the cover 191 and sets the document on the glass surface 192, thereafter lowers the front end portion of the cover 191 and operates any operation key of the operation panel 8 of the main body casing 2. Then, the CCD sensor 193 is driven by the scanning/driving motor (not shown) to scan the document from the left side toward the right side in the state of being opposed to the document set on the glass surface 192, thereby reading image information from the document.

When the image information is completely read from the document, the user raises the front end portion of the cover 191 again and removes the document from the glass surface 192. When completely scanning the document, the CCD sensor 193 is driven by the scanning/driving motor (not shown) to automatically move to the left end of the glass surface 192 to return to the standby state.

(5-3) Automatic Document Reading in Scanning Unit

When the document sensor (not shown) senses a document set on the standby sheet tray 194 (see FIG. 2) in automatic document reading with the ADF device 195, the CCD sensor 193 is fixed onto an automatic document reading position (not shown), dissimilarly to the aforementioned ordinary document reading. Then, the user operates the operation key of the operation panel 8, thereby driving the document transportation driving motor (not shown) of the ADF device 195 and rotating the document transport roller (not shown) by the driving force thereof, so that the document moves leftward due to the rotation of the document transport roller (not shown) and is introduced into the casing 196 through the document inlet (not shown). The introduced document passes through a document transport path (not shown) and is opposed to the CCD sensor 193. At this time, the CCD sensor 193 reads image information by scanning the document, and thereafter the document is transported rightward from the document outlet (not shown) to be ejected onto the upper surface of the cover 191.

(5-4) Image Formation Based on Image Information Read from Document

The image forming section 5 creates image data on the basis of the aforementioned image information read from the document by the CCD sensor 193, and forms the image on each sheet 3 as described above.

2. Functions and Effects (1) Function and Effect 1

In this color laser printer 1, the plurality of toner cartridges 69 provided correspondingly to the developing rollers 143 as shown in FIG. 7 are together attached/detached to/from the main body casing 2 independently of the photosensitive drums 133 and the developing rollers 143 along one direction, i.e., the anteroposterior direction, as shown in FIG. 4. When only the toner cartridges 69 are increased in size in order to ensure sufficient volumes of the toners, therefore, the main body casing 2 may not be correspondingly increased in size but can be compactly formed.

Further, the toner cartridges 69 are opposed to the developing rollers 143 along the longitudinal direction (width direction) of the developing rollers 143 when mounted on the main body casing 2, as shown in FIG. 7. Assuming that the main body casing 2 has a constant size in the up-and-down direction intersecting with the longitudinal direction of the developing rollers 143, therefore, the up-and-down size of the toner cartridges 69 can be increased by the length corresponding to the up-and-down size of the developing rollers 143 as compared with that in a case of opposing the toner cartridges 69 to the developing rollers 143 in the up-and-down direction. Further, assuming that the main body casing 2 also has a constant size in the anteroposterior direction intersecting with the longitudinal direction of the developing rollers 143, the anteroposterior size of the toner cartridges 69 can be increased by the length corresponding to the anteroposterior size of the developing rollers 143 as compared with that in a case of anteroposteriorly opposing the toner cartridges 69 to the developing rollers 143.

Thus, the volumes of the toners in the toner cartridges 69 can be sufficiently ensured.

Further, only the toner cartridges 69 can be together attached/detached to/from the main body casing 2 along the anteroposterior direction, whereby the operability can be improved and the running cost can be reduced.

Consequently, the volumes of the toners can be sufficiently ensured in the toner cartridges 69, the color laser printer 1 can be miniaturized, the operability thereof can be improved, and the maintenance cost can be reduced.

The toner cartridges 69 are anteroposteriorly slidably attached/detached to/from the main body casing 2 in the state of being received in the cartridge receiving section 68, as shown in FIG. 18. Therefore, the operability can be improved.

Further, the toner cartridges 69 are attached/detached to/from the cartridge receiving section 68 in the up-and-down direction intersecting with the anteroposterior and right-and-left directions. Therefore, the toner cartridges 69 can be smoothly attached/detached to/from the cartridge receiving section 68, thereby further improving the operability.

In addition, the toner cartridges 69 are detachably mountable to the cartridge receiving section 68 generally along the up-and-down direction, whereby the cartridge receiving section 68 accommodating the toner cartridges 69 can be attached/detached to/from the main body casing 2 in the anteroposterior direction, i.e., the right-and-left direction, after the toner cartridges 69 are generally vertically attached to the cartridge receiving section 68. Thus, the operability can be further improved.

The cartridge receiving section 68 is completely detachable from the main body casing 2, whereby all toner cartridges 69 can be reliably attached/detached to/from the cartridge receiving section 68.

In the main body casing 2, the toner cartridges 69 protrude upward beyond the ejection tray 13, as shown in FIG. 7. In other words, the upper end portion of the storage section 100 of each toner cartridge 69 is located upward beyond the ejection tray 13, whereby the volume of the toner accommodated in the toner cartridge 69 can be sufficiently ensured. More specifically, the ejection tray 13 receiving the sheets 3 stacked thereon requires a space corresponding to the thicknesses of the stacked sheets 3. Therefore, the main body casing 2 can protrude upward beyond the ejection tray 13 due to the space for receiving the sheets 3. The space resulting from this protrusion of the main body casing 2 is so effectively utilized as to ensure sufficient volumes of the toners.

Each toner cartridge 69 is formed with the outer-cylinder-side feed hole 109 for feeding the toner and the outer-cylinder-side return hole 110 for receiving the toner on the position opposed to the developing roller 143, is provided with the inner cylinder 96 covering the outer-cylinder-side feed hole 109 and the outer-cylinder-side return hole 110 in an openable/closable manner as shown in FIGS. 14(*a*) and 14(*b*).

Thus, as shown in FIG. 14(*a*) the inner cylinder 96 is closed (moved to the cartridge-side shutter closing position) when the toner cartridge 69 is attached/detached to/from the main body casing 2, so that the toner can be prevented from leaking through the outer-cylinder-side feed hole 109 and the outer-cylinder-side return hole 110. When the toner cartridge 69 is mounted to the main body casing 2, the inner cylinder 96 is opened (moved to the cartridge-side shutter opening position) as shown in FIG. 14(*b*), so that the toner can be fed to the developing roller 143 through the outer-cylinder-side feed hole 109 while the toner returned from the developing roller 143 can be recovered through the outer-cylinder-side return hole 110. Therefore, the toner is prevented from leaking from the toner cartridge 69 in attachment/detachment and can be reliably fed from the toner cartridge 69 in mounting, so that defective development can be prevented by ensuring circulation of the toner between the toner cartridge 69 and the corresponding developing roller 143.

The cartridge receiving section 68 is formed with the receiving-section-side opening 74, through which each toner passes, on the position opposed to the outer-cylinder-side feed hole 109 and the outer-cylinder-side return hole 110, as shown in FIGS. 17(*a*) and 17(*b*).

When each toner cartridge 69 is mounted on the cartridge receiving section 68, therefore, the toner can be fed to the developing roller 143 from the outer-cylinder-side feed hole 109 of the toner cartridge 69 through the receiving-section-side opening 74 of the cartridge receiving section 68. Thus, the toner can be reliably fed to the developing roller 143. Further, the toner returned from the developing roller 143 can be recovered from the outer-cylinder-side return hole 110 through the receiving-section-side opening 74, whereby the circulation of the toner between the toner cartridge 69 and the corresponding developing roller 143 can be reliably ensured to prevent defective development.

The plurality of developing rollers 143 and the plurality of photosensitive drums 133 are together attached/detached to/from the main body casing 2 as the processing sections 62 along the anteroposterior direction identical to the attachment/detachment direction (see FIG. 18) for the toner cartridges 69, as shown in FIG. 23.

Therefore, the plurality of developing rollers 143 and the plurality of photosensitive drums 133 as well as the toner cartridges 69 can be attached/detached along the same direction, for improving the operability.

As shown in FIG. 2, the main body casing 2 has the cartridge receiving section mounting port 11 (see FIG. 4) formed on the position anteroposteriorly opposed to the toner cartridges 69 for passing the toner cartridges 69 therethrough, and the processing section mounting port 10 (see FIG. 3) formed on the position anteroposteriorly opposed to the developing rollers 143 and the photosensitive drums 133 (processing sections 62) for passing the processing sections 62 therethrough. The main body casing 2 further has the first and second covers 22 and 18 provided adjacently to each other on the front side surface thereof for covering the cartridge receiving section mounting port 11 and the processing section mounting port 10 in an openable/closable manner respectively.

Thus, the toner cartridges 69 can be attached/detached through the cartridge receiving section mounting port 11 by opening the first cover 22 as shown in FIG. 4, while the developing rollers 143 and the photosensitive drums 133 (processing sections 62) can be attached/detached through the processing section mounting port 10 by opening the second cover 18 as shown in FIG. 3. Therefore, attachment/detachment of the toner cartridges 69 and that of the developing rollers 143 and the photosensitive drums 133 can be controlled on the same side surface of the main body casing 2, thereby further improving the operability.

As shown in FIGS. 3 and 4, the main body casing 2 is provided with the partition wall 15 for separating the cartridge receiving section accommodation space 24 accommodating the plurality of toner cartridges 69 from the process accommodation space 17 accommodating the plurality of developing rollers 143 and the plurality of photosensitive drums 133 along the anteroposterior direction between the cartridge receiving section mounting port 11 and the processing section mounting port 10.

Therefore, the plurality of toner cartridges 69 can be smoothly attached/detached to/from the cartridge receiving section accommodation space 24 along the anteroposterior direction, while the plurality of developing rollers 143 and the plurality of photosensitive drums 133 can also be smoothly attached/detached to/from the process accommodation space 17 along the anteroposterior direction.

As shown in FIGS. 20(*a*) and 20(*b*), the partition wall 15 has the partition-wall-side feed hole 39 formed between the toner cartridge 69 and the developing roller 143 for passing toner, and has the partition-wall-side shutter 35 provided on the side of the partition wall 15 closer to the cartridge receiving section accommodation space 24 for covering the partition-wall-side feed hole 39 in an openable/closable manner, and the partition-wall-side shutter 35 is opened/closed in association with opening/closing of the inner cylinder 96.

When each toner cartridge 69 is attached/detached to/from the main body casing 2, therefore, in case where the inner cylinder 96 is closed, the partition-wall-side shutter 35 is also closed (moved to the partition-wall-side shutter closing position) in association with closing of the inner cylinder 96 as shown in FIG. 20(*a*), whereby the toner can be prevented from leaking through both sides of the toner cartridge 69 and the cartridge receiving section accommodation space 24. When the toner cartridge 69 is mounted to the main body casing 2, in case where the inner cylinder 69 is opened, the partition-wall-side shutter 35 is also opened (moved to the partition-wall-side shutter opening position) in association with opening of the inner cylinder 96 as shown in FIG. 20(*b*), whereby the toner can be fed to the developing roller 143 from the outer-cylinder-side feed hole 109 through the partition-wall-side feed hole 39. Therefore, the toner is prevented from leaking through the both sides of the toner cartridge 69 and the cartridge receiving section accommodation space 24 in attachment/detachment, and can be reliably fed from the toner cartridge 69 in mounting.

The color laser printer 1, including the scanning unit 7 provided above the main casing 2 for reading the image information from the document as shown in FIG. 1, can form the image on each sheet 3 through the image information read by the scanning unit 7, thereby implementing a composite apparatus also serving as a copying machine.

In this color laser printer 1, further, the toner cartridges 69 can be together attached/detached to/from the main body casing 2 along the anteroposterior direction independently of the photosensitive drums 133 and the developing rollers 143, regardless of the scanning unit 7 provided above the main body casing 2. Therefore, the toner cartridges 69 can be increased in size for ensuring sufficient volumes of the toners while compactly forming the main body casing 2 of the color laser printer 1 serving as a composite apparatus. Further, the toner cartridges 69 (cartridge receiving section 68) are anteroposteriorly attached/detached to/from the main body casing 2, so that the scanning unit 7 provided above the main body casing 2 may not be retracted in attachment/detachment of the toner cartridges 69. In addition, the volumes of the toners accommodated in the toner cartridges 69 can be increased by approximating the upper portions of the toner cartridges 69 to the scanning unit 7.

(2) Function and Effect 2

In the color laser printer 1, the driving force of the agitator driving motor (not shown) is transmitted to the feed-side agitators 115 of the black toner cartridge 69K through the first transmission portion 88 connected to the driving mechanism 30 (see FIG. 5) as well as the feed-side agitator input gear 116 and the feed-side agitator rotating shaft 120 of the black toner cartridge 69K, as shown in FIG. 8. This driving force is then transmitted to the feed-side agitators 115 of the cyan toner cartridge 69C through the feed-side agitator output gear 117 of the black toner cartridge 69K, the corresponding second transmission portion 89 as well as the feed-side agitator input gear 116 and the feed-side agitator rotating shaft 120 of the cyan toner cartridge 69C adjacent to the front side of the black toner cartridge 69K. Similarly, the driving force received by the feed-side agitators 115 of the cyan toner cartridge 69C is transmitted to the feed-side agitators 115 of the magenta toner cartridge 69M adjacent to the front side of the cyan toner cartridge 69C, and further transmitted to the feed-side agitators 115 of the yellow toner cartridge 69Y adjacent to the front side of the magenta toner cartridge 69M.

Thus, the driving force supplied from the driving mechanism 30 to the feed-side agitators 115 of the black toner cartridge 69K through the first transmission portion 88, is sequentially transmitted from the feed-side agitators 115 of the rear toner cartridges 69 to those of the front toner cartridges 69 adjacent thereto through the feed-side agitator output gears 117, the second transmission portions 89, the feed-side agitator input gears 116 and the feed-side agitator rotating shafts 120. Therefore, this driving force is also transmitted to the feed-side agitators 115 of the remaining three toner cartridges 69C, 69M and 69Y, whereby the feed-side agitators 115 of all the toner cartridges 69 can be driven in a more compact structure as compared with a structure individually providing the driving mechanism 30 (see FIG. 5) for each toner cartridge 69 or individually supplying the driving force from the driving mechanism 30 (see FIG. 5) to the feed-side agitators 115 of each toner cartridge 69.

Therefore, the structure (the first transmission portion 88, the second transmission portions 89, the feed-side agitator input gears 116, the feed-side agitator rotating shafts 120 and the feed-side agitator output gears 117) supplying the driving force to all the feed-side agitators 115 can be arranged in the color laser printer 1 without reducing the size of the toner cartridges 69.

Consequently, the driving force can be supplied to the feed-side agitators 115 provided on the respective toner cartridges 69 while ensuring sufficient volumes of the toners in the toner cartridges 69 when the color laser printer 1 is miniaturized.

The toner cartridges 69 are parallelly arranged along the anteroposterior direction, and the driving mechanism 30 supplies the driving force to the feed-side agitators 115 of the black toner cartridge 69K arranged on the rear end side in the anteroposterior direction. The second transmission portions 89, the feed-side agitator input gears 116, the feed-side agitator rotating shafts 120 and the feed-side agitator output gears 117 sequentially transmit the driving force to the feed-side agitators 115 of the cyan, magenta and yellow toner cartridges 69C, 69M and 69Y provided on the front end side in the anteroposterior direction. Thus, the driving force can be systematically supplied to the feed-side agitators 115 of all the toner cartridges 69.

More specifically, the driving force of the driving mechanism 30 can be reliably transmitted to the feed-side agitators 115 of the black toner cartridge 69K arranged on the rear end side through the first transmission portion 88.

Further, the second transmission portions 89 are arranged between the toner cartridges 69, so that the driving force transmitted to the feed-side agitators 115 of the rear toner cartridges 69 can be reliably transmitted to those of the front toner cartridges 69 adjacent thereto through the second transmission portions 89.

In each toner cartridge 69, the feed-side agitator input gear 116 provided on the rear end portion of the feed-side agitator rotating shaft 120 engages with the first transmission portion 88 or the second transmission portion 89, thereby transmitting the driving force of the driving mechanism 30 to the feed-side agitator rotating shaft 120 from the first transmission portion 88 or the second transmission portion 89 through the feed-side agitator input gear 116.

The feed-side agitator rotating shaft 120 is rotated by the driving force transmitted thereto, so that the feed-side agitators 115 provided thereon are rotated about the feed-side agitator rotating shaft 120, thereby agitating the toner accommodated in the toner cartridge 69.

The feed-side agitator output gear 117 provided on the front end portion of the feed-side agitator rotating shaft 120 engages with the second transmission portion 89 adjacent to the first transmission portion 88 engaging with the feed-side agitator input gear 116 or another second transmission portion 89 adjacent to the second transmission portion 89 engaging with the feed-side agitator input gear 116. The second transmission portion 89 adjacent to the first transmission portion 88 is the second transmission portion 89 located between the black and cyan toner cartridges 69K and 69C, and the other second transmission portion 89 is the second transmission portion 89 provided in front of the second transmission portion 89 located between the black and cyan toner cartridges 69K and 69C. Thus, the driving force transmitted to the feed-side agitator rotating shaft 120 through the feed-side agitator input gear 116 is transmitted to the second transmission portion 89 adjacent to the first transmission portion 88 engaging with the feed-side agitator input gear 116 or the front-side second transmission portion 89 adjacent to the second transmission portion 89 engaging with the feed-side agitator input gear 116 through the feed-side agitator output gear 117.

Therefore, the transmission of the driving force from the first transmission portion 88 to the second transmission portion 89 or from the second transmission portion 89 to the other second transmission portion 89, and the rotation of the feed-side agitators 115 can be carried out through the feed-side agitator rotating shaft 120, the feed-side agitator input gear 116 and the feed-side agitator output gear 117, whereby the driving force can be efficiently transmitted and the number of the components can be reduced.

The second transmission portion 89 includes the input transmission gear 94 and the output transmission gear 99, and in the second transmission portion 89 the driving force is transmitted to the input transmission gear 94 from the feed-side agitator output gear 117 of the rear-side toner cartridge 69 and further transmitted from the output transmission gear 99 to the feed-side agitator input gear 116 of the front-side toner cartridge 69 adjacent to the rear-side toner cartridge 69.

Consequently, the second transmission portion 89 can reliably transmit the driving force received by the feed-side agitators 115 of the rear-side toner cartridge 69 to the feed-side agitator input gear 116 of the front-side toner cartridge 69 adjacent to the rear-side toner cartridge 69.

Further, the cartridge receiving section 68 can move all the toner cartridges 69 together.

This cartridge receiving section 68 includes the aforementioned first and second transmission portions 88 and 89, and the first transmission portion 88 is connected to the driving mechanism 30 when the cartridge receiving section 68 is located on the mount position. Therefore, the driving force can be supplied to the feed-side agitators 115 of all the toner cartridges by transmitting the driving force of the driving mechanism 30 to the feed-side agitators 115 of the black toner cartridge 69K arranged on the rear end side and sequentially transmitting this driving force to the feed-side agitators 115 of the front-side toner cartridges 69 adjacent thereto through the operation of simply moving the cartridge receiving section 68 accommodating the toner cartridges 69 to the mount position.

Each toner cartridge 69 is opposed to the corresponding developing roller 143 in the longitudinal direction (width direction) of the developing roller 143.

Assuming that the color laser printer 1 has a constant size in the up-and-down direction intersecting with the longitudinal direction of the developing rollers 143, therefore, the up-and-down size of the toner cartridge 69 can be increased by the length corresponding to the up-and-down size of the developing roller 143 as compared with that in the case of opposing the toner cartridge 69 to the developing roller 143 in the up-and-down direction. Further, assuming that the color laser printer 1 also has a constant size in the anteroposterior direction intersecting with the longitudinal direction of the developing roller 143, the anteroposterior size of the toner cartridge 69 can be increased by the length corresponding to the anteroposterior size of the developing roller 143 as compared with that in the case of anteroposteriorly opposing the toner cartridge 69 to the developing roller 143.

Consequently, the volume of the toner in the toner cartridge 69 can be sufficiently ensured.

The toner cartridge 69 includes the storage chamber 102 and the feed chamber 121, whereby the toner stored in the storage chamber 102 is fed to the feed chamber 121 and agitated by the feed-side agitators 115 in the feed chamber 121, and a necessary volume of toner is thereafter fed from the feed chamber 121 to the developing roller 143. Thus, the toner can be efficiently fed.

Further, the toner cartridge 69 is opposed to the corresponding developing roller 143 in the longitudinal direction (width direction) of the developing roller 143 as described above, whereby the feed-side agitator rotating shaft 120 serving as the rotation center of the feed-side agitators 115 is opposed to the developing roller 143 (see FIG. 7). In other words, the developing roller 143 is positioned in the rotational direction of the feed-side agitators 115, so that the toner can be more smoothly fed.

The storage chamber 102 includes the storage-side agitator 113, which in turn agitates the toner stored in the storage chamber 102. Therefore, the toner stored in the storage chamber 102 can be maintained in a state always feedable to the feed chamber 121.

The toner cartridge 69 further includes the storage-side agitator rotating shaft 112, the storage-side agitator input gear 114 and the intermediate gear 119, and the intermediate gear 119 engages with the aforementioned feed-side agitator input gear 116 and the aforementioned storage-side agitator input gear 114, whereby the driving force received by the feed-side agitator input gear 116 is transmitted to the storage-side agitator input gear 114 through the intermediate gear 119. The storage-side agitator input gear 114 is provided on the rear end portion of the storage-side agitator rotating shaft 112, so that the driving force received by the storage-side agitator input gear 114 is transmitted to the storage-side agitator rotating shaft 112.

The storage-side agitator rotating shaft 112 is rotated by the driving force transmitted thereto, and the storage-side agitator 113 provided thereon is rotated about the storage-side agitator rotating shaft 112 to agitate the toner stored in the storage chamber 102.

Consequently, no additional structure may be provided for supplying driving force to the storage-side agitator 113 but the driving force input in the feed-side agitator input gear 116 can be reliably transmitted to the storage-side agitator 113 in the simple structure, thereby agitating the toner stored in the storage chamber 102.

(3) Function and Effect 3

In the color laser printer 1, the inner cylinder 96 of each toner cartridge 69 is opened (moved to the cartridge-side shutter opening position) to open the outer-cylinder-side opening 108 as shown in FIG. 16, whereby the toner accommodated in the toner cartridge 69 can be fed to the corresponding developing roller 143 through the outer-cylinder-side opening 108. On the other hand, the inner cylinder 96 is closed (moved to the cartridge-side shutter closing position) to close the outer-cylinder-side opening 108, whereby the toner accommodated in the toner cartridge 69 can be prevented from leaking through the outer-cylinder-side opening 108 (see FIG. 15).

In the color laser printer 1, the single opening/closing member 75 collectively opens/closes all the inner cylinders 96 with no opening/closing mechanisms respectively provided on the toner cartridges 69 for opening/closing the inner cylinders 96, whereby the structure for opening/closing all the inner cylinders 96 can be compactly designed.

Therefore, the opening/closing member 75 can be arranged in the color laser printer 1 without reducing the toner cartridges 69 in size.

Consequently, all inner cylinders 96 can be reliably opened/closed while sufficiently ensuring the volumes of the toners in the toner cartridges 69 when the color laser printer 1 is miniaturized.

Further, the cartridge receiving section 68 can move all the toner cartridges 69 together.

The operation lever 81 operated for opening/closing the opening/closing member 75 is provided on the front end portion of the cartridge receiving section 68 in the anteroposterior direction along which the toner cartridges 69 are parallelly arranged, whereby the inner cylinders 96 of all the toner cartridges 69 can be collectively opened/closed by operating the operation lever 81 to open/close the opening/closing member 75. Consequently, the operability can be improved.

As shown in FIG. 5, the partition wall 15 of the main body casing 2 is formed with the partition-wall-side feed holes 39 and the partition-wall-side return holes 40 communicating with the outer-cylinder-side feed holes 109 and the outer-cylinder-side return holes 110 of the outer-cylinder-side openings 108 respectively, and is provided with the partition-wall-side shutter 35 opening/closing all the partition-wall-side feed holes 39 and all the partition-wall-side return holes 40.

When the partition-wall-side shutter 35 is opened (moved to the partition-wall-side shutter opening position) as shown in FIG. 20(*b*), therefore, each partition-wall-side feed hole 39 and each partition-wall-side return hole 40 are opened to communicate with the corresponding outer-cylinder-side feed hole 109 and the corresponding outer-cylinder-side return hole 110 respectively. Thus, the toner accommodated in each toner cartridge 69 can be fed to the corresponding developing roller 143 through the outer-cylinder-side opening 108, the partition-wall-side feed hole 39 and the partition-wall-side return hole 40.

When the partition-wall-side shutter 35 is closed (moved to the partition-wall-side shutter closing position) as shown in FIG. 20(*a*), on the other hand, the partition-wall-side feed hole 39 and the partition-wall-side return hole 40 are closed and blocked from the corresponding outer-cylinder-side opening 108. Thus, the toner accommodated in the toner cartridge 69 can be prevented from being fed to the developing roller 143.

In the color laser printer 1, the partition-wall-side shutter 35 opens/closes all the partition-wall-side feed holes 39 and all the partition-wall-side return holes 40 as shown in FIG. 5, whereby the structure for opening/closing all the partition-wall-side feed holes 39 and all the partition-wall-side return holes 40 can be compactly designed. Thus, the main body casing 2 provided with the partition-wall-side shutter 35 can be miniaturized. Consequently, the color laser printer 1 can be miniaturized.

The partition-wall-side shutter 35 is opened/closed by opening/closing each inner cylinder 96. In other words, the partition-wall-side shutter 35 is opened by opening the inner cylinder 96, and closed by closing the inner cylinder 96, whereby the inner cylinder 96 and the partition-wall-side shutter 35 can be reliably opened/closed in association with each other.

More specifically, each toner cartridge 69 includes the first projection 123 engaging with the opening/closing member 75 for opening/closing the inner cylinder 96 in association with operation of the opening/closing member 75, and the second projection 124 engaging with the partition-wall-side shutter 35 for opening/closing the partition-wall-side shutter 35 in association with the movement of the first projection 123.

When the opening/closing member 75 is opened/closed, the first projection 123 engaging therewith opens/closes the inner cylinder 96 in association with the opening/closing of the opening/closing member 75, and the second projection 124 engaging with the partition-wall-side shutter 35 opens/closes the partition-wall-side shutter 35 in association with operation of the first projection 123.

Therefore, the inner cylinder 96 and the partition-wall-side shutter 35 can be reliably opened/closed in association with each other by simply providing the first and second projections 123 and 124 on the toner cartridge 69.

Further, the first and second projections 123 and 124 are provided on the inner cylinder 96, whereby the structure can be simplified.

Second Embodiment

Figure 24:
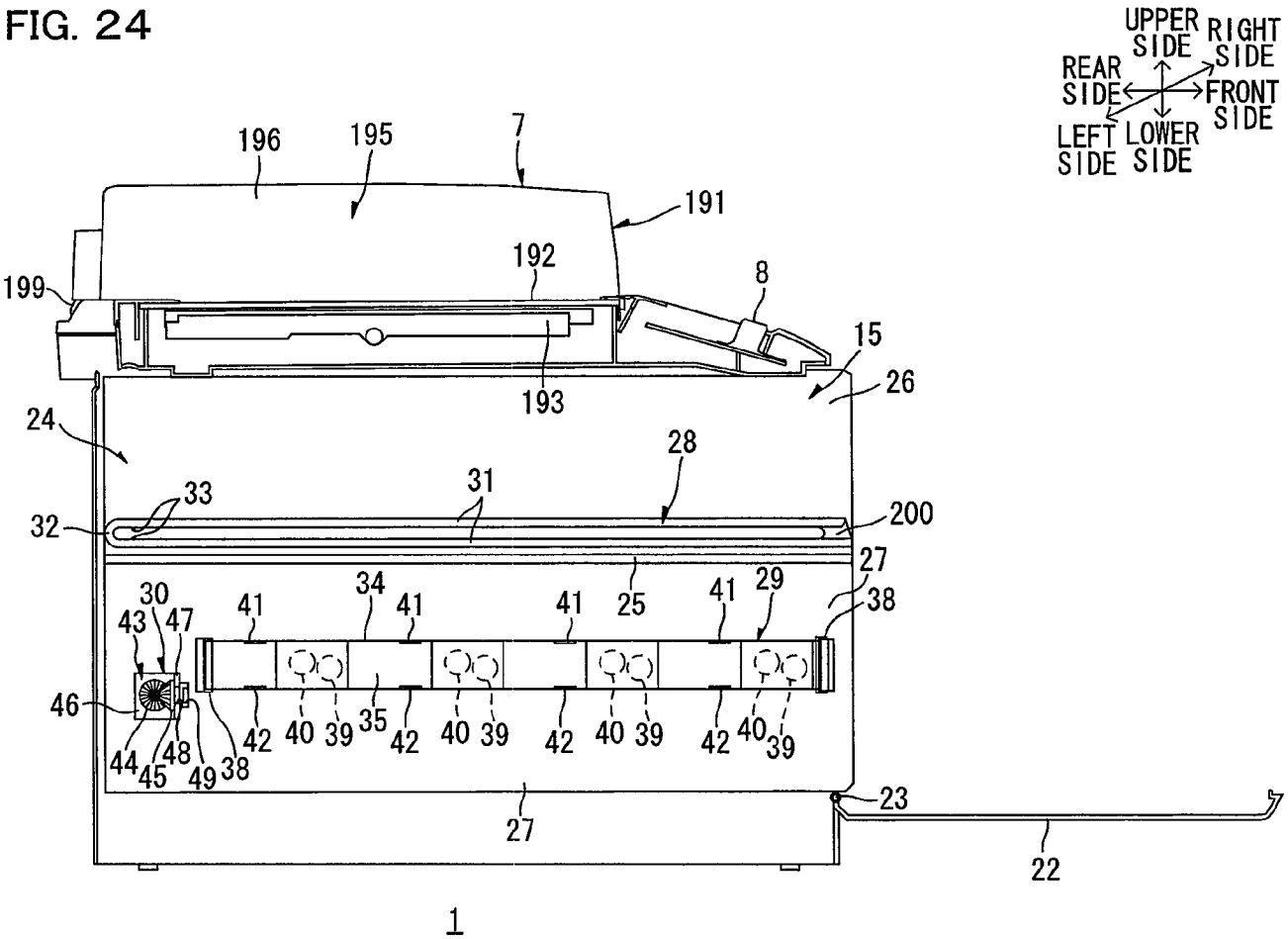
FIG. 24 is a left-side sectional view of FIG. 18, showing a second embodiment of one or more aspects of the present invention.

FIG. 24 is a left-side sectional view of FIG. 18, showing a second embodiment of one or more aspects of the present invention. Referring to FIG. 24, members similar to the aforementioned ones are denoted by the same reference numerals, and the descriptions thereof are not repeated.

As shown in FIG. 18, the front end portions of the pair of ridges 31 are opposed to each other at an interval in the up-and-down direction in the guide rail 28. When the cartridge receiving section 68 located on the attachment/detachment position is further drawn frontward as described above, therefore, the rollers 71 provided on the rear end of the cartridge receiving section 68 are displaced frontward from the front end edge of the corresponding guide rail 28, so that the cartridge receiving section 68 is completely detached from the main body casing 2.

Alternatively, the front end portions of a pair of ridges 31 may be connected with each other, as shown in FIG. 24. More specifically, a width-directionally thin connecting plate 200 extends between the front end portions of the right end edges of the pair of ridges 31 of a guide rail 28 provided on a partition wall 15. Another connecting plate 200 of the same shape extends between the front end portions of the left end edges of a pair of ridges 31 of another guide rail 28 (see FIG. 20) provided on the right side surface of the left sidewall of a main body casing 2. The connecting plate 200 is generally rectangular in left-side elevation view, and the rear end edge thereof is in the form of a frontwardly recessed arc.

Further, only the aforementioned rollers 71 (see FIG. 18) provided on the rear end are width-directionally increased in size as compared with the remaining rollers 71 located frontward beyond these rollers 71. More specifically, the right one of the rollers 71 provided on the rear end is so formed as to protrude rightward beyond the connecting plate 200 in front elevation view in the state of being sandwiched between the corresponding pair of ridges 31, while the left one of the rollers 71 provided on the rear end is so formed as to protrude leftward beyond the connecting plate 200 in front elevation view in the state of being sandwiched between the corresponding pair of ridges 31.

In this case, the rollers 71 positioned frontward beyond the rollers 71 provided on the rear end move frontward through the front end portions of the corresponding pair of ridges 31 when the cartridge receiving section 68 located on the mount position is detached from the main body casing 2, while the rollers 71 provided on the rear end are caught on the rear end edge of the corresponding connecting plate 20. Thus, the cartridge receiving section 68 can be stopped on the position (attachment/detachment position) where all the toner cartridges 69 are exposed from the main body casing 2 to be detachable from the cartridge receiving section 68. Therefore, all the toner cartridges 69 can be reliably attached/detached to/from the cartridge receiving section 68 without detaching the cartridge receiving section 68 from the main body casing 2.

Third Embodiment

Figure 25:
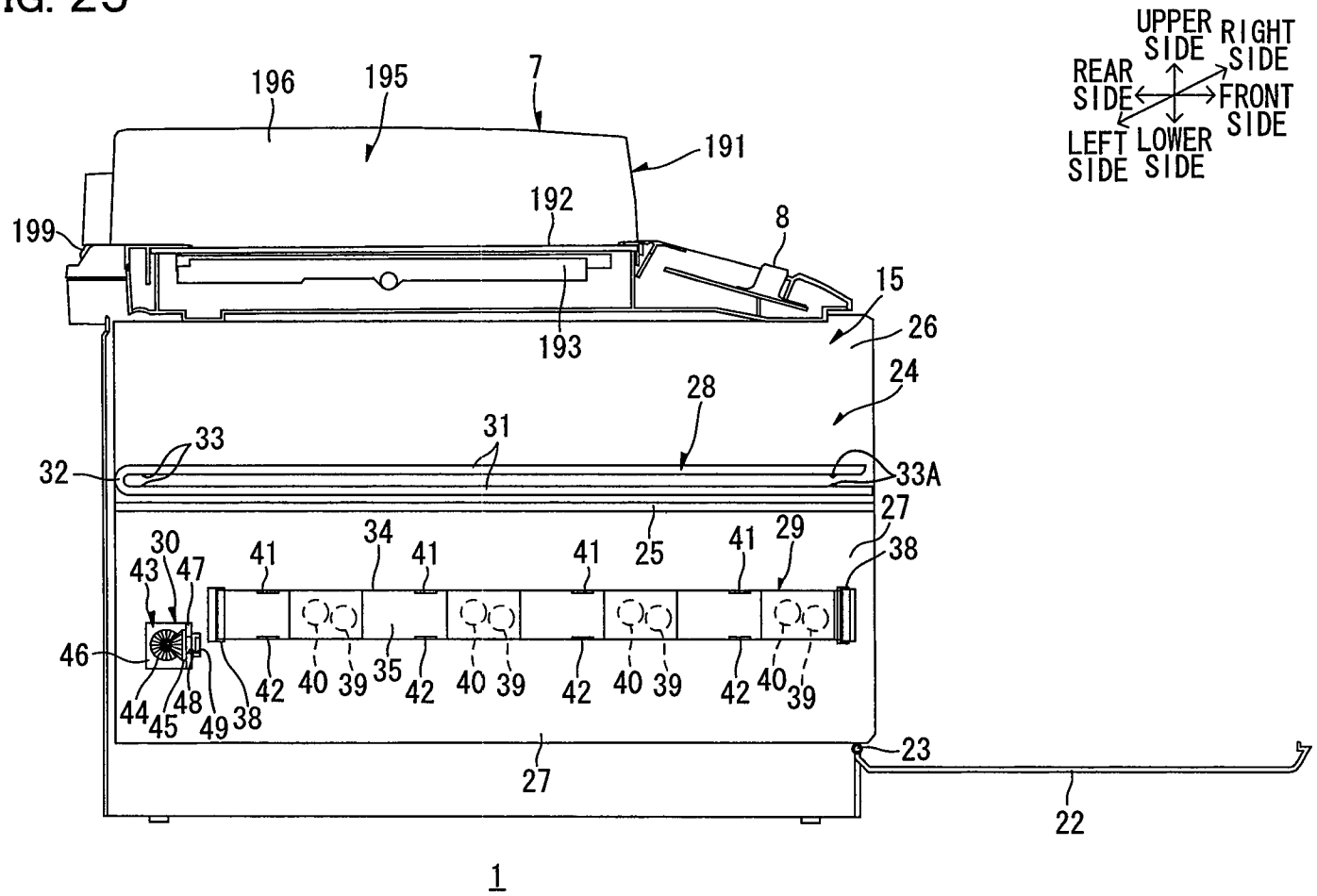
FIG. 25 is a left-side sectional view of FIG. 18, showing a third embodiment of one or more aspects of the present invention.

FIG. 25 is a left-side sectional view of FIG. 18, showing a third embodiment of one or more aspects of the present invention. Referring to FIG. 25, members similar to the aforementioned ones are denoted by the same reference numerals, and the descriptions thereof are not repeated.

As shown in FIG. 18, the guide rail positioning projections 33 are provided on the rear end portions of the opposed portions of the pair of ridges 31 of each guide rail 28 in the aforementioned embodiments, so that the rollers 71 provided on the rear end of the cartridge receiving section 68 go beyond the guide rail positioning projections 33 when the cartridge receiving section 68 is completely mounted on the cartridge receiving section accommodation space 24 of the main body casing 2. Additionally, guide rail positioning projections 33 may be provided on the front end portions (referred to as front end projections 33A) of opposed portions of a pair of ridges 31, as shown in FIG. 25.

In this case, the aforementioned rollers 71 provided on the rear end are caught on the front end projections 33A when the cartridge receiving section 68 located on the mount position is detached from the main body casing 2, so that the cartridge receiving section 68 can be stopped on the position (attachment/detachment position) where all the toner cartridges 69 are exposed from the main body casing 2 to be detachable from the cartridge receiving section 68. Therefore, all the toner cartridges 69 can be reliably attached/detached to/from the cartridge receiving section 68 without detaching the cartridge receiving section 68 from the main body casing 2.

Fourth Embodiment

While the intermediate transfer type color laser printer 1 temporarily transferring the toner images of the respective colors from the photosensitive drums 133 to the intermediate transfer belt 176 and thereafter collectively transferring the toner images to each sheet 3, is illustrated in the aforementioned embodiments, the present invention is not limited to this but is also applicable to a direct transfer type color laser printer directly transferring toner images of respective colors from the respective photosensitive drums 133 to each sheet 3, for example.

The embodiments described above are illustrative and explanatory of the invention. The foregoing disclosure is not intended to be precisely followed to limit the present invention. In light of the foregoing description, various modifications and alterations may be made by embodying the invention. The embodiments are selected and described for explaining the essentials and practical application schemes of the present invention which allow those skilled in the art to utilize the present invention in various embodiments and various alterations suitable for anticipated specific use. The scope of the present invention is to be defined by the appended claims and their equivalents.

What is claimed is:

1. An image forming apparatus, comprising:

a plurality of photosensitive drums arranged in a first direction, each of the plurality of photosensitive drums being configured to have an image formed thereon and to rotate about an axis extending along a second direction perpendicular to the first direction;

a plurality of developing rollers, each of which being configured to feed developing agent to a corresponding one of the plurality of photosensitive drums;

a plurality of feed rollers, each of which being configured to feed developing agent to a corresponding one of the plurality of developing rollers;

an endless belt extending above the plurality of developing rollers in the first direction;

a developing agent conveyor configured to convey the developing agent in the second direction; and a plurality of cartridges, each of which accommodating the developing agent and being detachably attached to a frame of the image forming apparatus, wherein the developing agent conveyor is disposed below the endless belt, wherein each of the plurality of cartridges overlaps with the endless belt when viewed from the second direction, and wherein the developing agent conveyor extends in the second direction by a distance from one end to another end in the second direction of one of the developing rollers at a position that is above one of the feed rollers and below the endless belt.

2. An image forming apparatus according to claim 1, wherein the developing agent conveyor includes an auger configured to rotate about an axis extending in the second direction.

3. An image forming apparatus according to claim 1, wherein the developing agent conveyor is disposed between the closest one of the plurality of feed rollers and the endless belt.

4. An image forming apparatus according to claim 1, wherein the developing agent conveyor is configured to convey the developing agent toward one of the plurality of cartridges.

5. An image forming apparatus according to claim 1, wherein the developing agent conveyor is configured to convey the developing agent from one of the plurality of cartridges.

6. An image forming apparatus according to claim 1, wherein the developing agent conveyor is disposed above a closest one of the plurality of feed rollers relative to the developing agent conveyor.

7. An image forming apparatus according to claim 1, further comprising a secondary transfer roller, wherein the endless belt is an intermediate transfer belt, and the intermediate transfer belt and the secondary transfer roller are configured to transfer the image on each of the plurality of photosensitive drums onto a sheet.

8. An image forming apparatus, comprising:

a plurality of photosensitive drums arranged in a first direction, each of the plurality of photosensitive drums being configured to have an image formed thereon and to rotate about an axis extending along a second direction perpendicular to the first direction;

a plurality of developing rollers, each of which being configured to feed developing agent to a corresponding one of the plurality of photosensitive drums;

a plurality of feed rollers each of which being configured to feed developing agent to a corresponding one of the plurality of developing rollers;

an endless belt extending above the plurality of developing rollers in the first direction;

a plurality of developing agent conveyors, each of which being configured to convey the developing agent in the second direction; and a plurality of cartridges, each of which accommodating the developing agent and being detachably attached to a frame of the image forming apparatus, wherein each of the plurality of developing agent conveyors is disposed below the endless belt, wherein each of the plurality of the cartridges overlaps with the endless belt when viewed from the second direction, and wherein each of the plurality of the developing agent conveyors extends in the second direction by a distance from one end to another end in the second direction of one of the developing rollers at a position that is above one of the feed rollers and below the endless belt.

9. An image forming apparatus according to claim 8, wherein each of the plurality of developing agent conveyors includes an auger configured to rotate about an axis extending in the second direction.

10. An image forming apparatus according to claim 8, wherein each of the plurality of developing agent conveyors is disposed between the closest one of the plurality of feed rollers and the endless belt.

11. An image forming apparatus according to claim 8, wherein each of the plurality of developing agent conveyors is configured to convey the developing agent toward a corresponding one of the plurality of cartridges.

12. An image forming apparatus according to claim 8, wherein each of the plurality of developing agent conveyors is configured to convey the developing agent from a corresponding one of the plurality of cartridges.

13. An image forming apparatus according to claim 8, wherein each of the plurality of developing agent conveyors is disposed above a corresponding one of the plurality of feed rollers relative to the developing agent conveyor.

14. An image forming apparatus according to claim 8, further comprising a secondary transfer roller, wherein the endless belt is an intermediate transfer belt, and the intermediate transfer belt and the secondary transfer roller are configured to transfer the image on each of the plurality of photosensitive drums onto a sheet.

15. An image forming apparatus, comprising:

a plurality of photosensitive drums arranged in a first direction, each of the plurality of photosensitive drums being configured to have an image formed thereon and to rotate about an axis extending along a second direction perpendicular to the first direction;

a plurality of developing rollers, each of which being configured to feed developing agent to a corresponding one of the plurality of photosensitive drums;

a plurality of feed rollers, each of which being configured to feed developing agent to a corresponding one of the plurality of developing rollers;

an intermediate transfer belt extending above the plurality of developing rollers in the first direction;

a plurality of primary transfer rollers configured to transfer the image formed on each of the plurality of photosensitive drums to the intermediate transfer belt;

a secondary transfer roller configured to transfer the image on the intermediate transfer belt onto a sheet; and a developing agent conveyor configured to convey the developing agent in the second direction, wherein the developing agent conveyor is disposed below the intermediate transfer belt and extends in the second direction by a distance from one end to another end in the second direction of one of the developing rollers at a position that is above one of the feed rollers and below the intermediate transfer belt.

16. An image forming apparatus according to claim 15, wherein the developing agent conveyor includes an auger configured to rotate about an axis extending in the second direction.

17. An image forming apparatus according to claim 15, wherein the developing agent conveyor is disposed between the closest one of the plurality of feed rollers and the intermediate transfer belt.

18. An image forming apparatus according to claim 15, further comprising a plurality of cartridges detachably attached to a frame of the image forming apparatus.

19. An image forming apparatus according to claim 18, wherein the developing agent conveyor is configured to convey the developing agent toward one of the plurality of cartridges.

20. An image forming apparatus according to claim 18, wherein the developing agent conveyor is configured to convey the developing agent from one of the plurality of cartridges.

21. An image forming apparatus according to claim 15, wherein the developing agent conveyor is disposed above a closest one of the plurality of feed rollers relative to the developing agent conveyor.

22. An image forming apparatus according to claim 15, wherein the developing agent conveyor is disposed below the secondary transfer roller.

23. An image forming apparatus, comprising:

a plurality of photosensitive drums arranged in a first direction, each of the plurality of photosensitive drums being configured to have an image formed thereon and to rotate about an axis extending along a second direction perpendicular to the first direction;

a plurality of developing rollers, each of which being configured to feed developing agent to a corresponding one of the plurality of photosensitive drums;

a plurality of feed rollers, each of which being configured to feed developing agent to a corresponding one of the plurality of developing rollers;

an intermediate transfer belt extending above the plurality of developing rollers in the first direction;

a plurality of primary transfer rollers configured to transfer the image formed on each of the plurality of photosensitive drums to the intermediate transfer belt;

a secondary transfer roller configured to transfer the image on the intermediate transfer belt onto a sheet; and a plurality of developing agent conveyors, each of which being configured to convey the developing agent in the second direction, wherein each of the plurality of developing agent conveyors is disposed below the intermediate transfer belt and extends in the second direction by a distance from one end to another end in the second direction of one of the developing rollers at a position that is above one of the feed rollers and below the intermediate transfer belt.

24. An image forming apparatus according to claim 23, wherein each of the plurality of developing agent conveyors includes an auger configured to rotate about an axis extending in the second direction.

25. An image forming apparatus according to claim 23, wherein each of the plurality of developing agent conveyors is disposed between the closest one of the plurality of feed rollers and the intermediate transfer belt.

26. An image forming apparatus according to claim 23, further comprising a plurality of cartridges detachably attached to a frame of the image forming apparatus.

27. An image forming apparatus according to claim 26, wherein each of the plurality of developing agent conveyors is configured to convey the developing agent toward a corresponding one of the plurality of cartridges.

28. An image forming apparatus according to claim 26, wherein each of the plurality of developing agent conveyors is configured to convey the developing agent from a corresponding one of the plurality of cartridges.

29. An image forming apparatus according to claim 23, wherein each of the plurality of developing agent conveyors is disposed above a corresponding one of the plurality of feed rollers.

30. An image forming apparatus according to claim 23, wherein each of the plurality of developing agent conveyors is disposed below the secondary transfer roller.

* * * * *